US011105094B2

(12) United States Patent
Boyce et al.

(10) Patent No.: US 11,105,094 B2
(45) Date of Patent: Aug. 31, 2021

(54) CEMENT FORM WITH EXTENSION

(71) Applicant: MONO SLAB EZ FORM LLC, Island Park, ID (US)

(72) Inventors: Lance N. Boyce, Island Park, ID (US); Amber C. Boyce, Island Park, ID (US)

(73) Assignee: Mono Slab EZ Form LLC, Island Park, ID (US)

( * ) Notice: Subject to any disclaimer, the term of this patent is extended or adjusted under 35 U.S.C. 154(b) by 0 days.

(21) Appl. No.: 16/571,496

(22) Filed: Sep. 16, 2019

(65) Prior Publication Data

US 2021/0079669 A1 Mar. 18, 2021

(51) Int. Cl.

| | |
|---|---|
| ***E04B 5/36*** | (2006.01) |
| ***E04G 11/36*** | (2006.01) |
| ***E01C 19/50*** | (2006.01) |
| ***E04B 5/32*** | (2006.01) |
| ***E04B 1/16*** | (2006.01) |

(52) U.S. Cl.

CPC ..... *E04B 5/36* (2013.01); *E01C 19/502* (2013.01); *E04B 1/163* (2013.01); *E04B 5/32* (2013.01); *E04G 11/36* (2013.01); *E04B 2103/02* (2013.01)

(58) Field of Classification Search

CPC ..... E01C 19/50; E01C 19/502; E04B 5/36; E04B 2005/322; E04B 5/32; E04G 11/365

USPC ..... 5/603, 621, 630, 653, 655, 655.9, 656, 5/946, 953; 428/158, 159, 160

See application file for complete search history.

(56) References Cited

U.S. PATENT DOCUMENTS

| | | | | |
|---|---|---|---|---|
| 1,527,698 A | | 2/1925 | Pearthree | |
| 1,682,008 A | | 8/1928 | Heltzel | |
| 1,944,511 A | | 1/1934 | Heltzel | |
| 2,678,482 A | | 5/1954 | Cuthbertson et al. | |
| 2,835,017 A | | 5/1958 | Hoerr | |
| 2,875,500 A | | 3/1959 | Stough | |
| 2,917,803 A | | 12/1959 | Phillips | |
| 3,281,894 A | * | 11/1966 | Buff | B29C 44/324 425/182 |
| 3,476,845 A | * | 11/1969 | Buff | B29C 33/36 264/54 |

(Continued)

FOREIGN PATENT DOCUMENTS

| | | | | |
|---|---|---|---|---|
| CN | 104968871 A | | 10/2015 | |
| DE | 3837377 | * | 5/1990 | E04D 13/1415 |

(Continued)

OTHER PUBLICATIONS

Translation of DE-202013000686. (Year: 2014).*

Product Book 2014, Concrete Accessories II, Dee Concrete, Division of Tesko Enterprises, Norridge, IL (28 pp.).

*Primary Examiner* — Michael Safavi

(74) *Attorney, Agent, or Firm* — Holland & Hart LLP

(57) ABSTRACT

A cement form includes a single piece, unitary body member having a solid, continuous construction and a wedge-shaped cross-section. The body member includes a first surface arranged vertically and configured to support a volume of cement, a second surface arranged horizontally and configured to contact a ground support surface, a foam material, an elongate construction with a greater length dimension in a horizontal direction than a height dimension in a vertical direction, and a notch formed at an intersection of the first and second surfaces, the notch being receptive of a portion of a foam sheet or other foam extension member.

12 Claims, 36 Drawing Sheets

(56) References Cited

U.S. PATENT DOCUMENTS

| | | | | | |
|---|---|---|---|---|---|
| 3,782,680 | A | | 1/1974 | Hopkins | |
| 3,888,209 | A | | 6/1975 | Boots | |
| 3,938,205 | A | * | 2/1976 | Spann | A47C 20/027 5/632 |
| 4,191,722 | A | * | 3/1980 | Gould | B29C 44/12 264/45.5 |
| 4,214,326 | A | * | 7/1980 | Spann | A47C 20/027 5/424 |
| 4,233,700 | A | * | 11/1980 | Spann | A47C 20/027 5/632 |
| 4,372,299 | A | * | 2/1983 | Fixel | A61F 5/0193 5/648 |
| 4,463,934 | A | | 8/1984 | Ochoa et al. | |
| 4,574,017 | A | * | 3/1986 | Stegmeier | E04H 4/141 156/247 |
| 4,823,534 | A | | 4/1989 | Hebinck | |
| 4,863,307 | A | | 9/1989 | Jones | |
| RE33,550 | E | | 3/1991 | Jones | |
| 5,007,122 | A | * | 4/1991 | Daughdrill | A47G 9/10 5/637 |
| 5,027,551 | A | | 7/1991 | Rodriguez | |
| 5,035,015 | A | * | 7/1991 | Maietta | A47D 13/00 5/630 |
| 5,073,061 | A | | 12/1991 | Jones | |
| 5,092,091 | A | | 3/1992 | Hull et al. | |
| D326,976 | S | * | 6/1992 | Wickis, Jr. | D24/183 |
| 5,134,817 | A | | 8/1992 | Richardt | |
| 5,212,917 | A | | 5/1993 | Kurtz et al. | |
| 5,452,963 | A | | 9/1995 | Christensen | |
| 5,454,195 | A | | 10/1995 | Hallsten | |
| 5,524,640 | A | * | 6/1996 | Lisak | A47D 13/08 128/869 |
| 5,605,416 | A | | 2/1997 | Roach | |
| 5,611,641 | A | | 3/1997 | Christensen | |
| 5,694,723 | A | | 12/1997 | Parker | |
| 5,772,357 | A | | 6/1998 | Evans | |
| D399,573 | S | * | 10/1998 | Stegmeier | D25/2 |
| 5,836,714 | A | | 11/1998 | Christensen | |
| 5,843,327 | A | | 12/1998 | Lindgren | |
| 5,956,912 | A | | 9/1999 | Carter et al. | |
| 6,021,994 | A | | 2/2000 | Shartzer, Jr. | |
| 6,026,623 | A | | 2/2000 | Anderson | |
| 6,195,956 | B1 | | 3/2001 | Reyneveld | |
| 6,324,782 | B1 | | 12/2001 | Gaston | |
| 6,536,737 | B1 | | 3/2003 | Davis | |
| 6,705,582 | B2 | | 3/2004 | Osborn | |
| 6,735,793 | B2 | | 5/2004 | Peterson | |
| 6,742,758 | B2 | | 6/2004 | Janesky | |
| 6,951,434 | B2 | | 10/2005 | Yodock, Jr. et al. | |
| 7,051,988 | B2 | | 5/2006 | Shaw et al. | |
| D552,250 | S | | 10/2007 | Christensen et al. | |
| 7,445,403 | B2 | | 11/2008 | Williams et al. | |
| 7,967,524 | B2 | | 6/2011 | Jones | |
| 8,011,144 | B2 | | 9/2011 | Compton | |
| 8,266,844 | B2 | | 9/2012 | Kurtz et al. | |
| D679,173 | S | | 4/2013 | Parady et al. | |
| 8,485,603 | B2 | * | 7/2013 | Albecker | A47C 7/40 297/284.4 |
| 8,662,790 | B2 | | 3/2014 | Phelps | |
| 9,004,815 | B2 | | 4/2015 | Taylor | |
| 9,016,980 | B2 | | 4/2015 | Wheeler et al. | |
| 9,068,364 | B2 | | 6/2015 | Troudt | |
| 9,173,350 | B1 | | 11/2015 | Beutler | |
| 9,346,454 | B1 | | 5/2016 | Leith | |
| 9,394,650 | B2 | | 7/2016 | Diamond | |
| 9,551,163 | B2 | | 1/2017 | Anaya Perez | |
| D781,463 | S | | 3/2017 | Otto | |
| 2002/0145099 | A1 | | 10/2002 | Hoyle et al. | |
| 2002/0157325 | A1 | | 10/2002 | Domanico | |
| 2004/0041074 | A1 | | 3/2004 | Takagi | |
| 2004/0156680 | A1 | | 8/2004 | Gibbs | |
| 2006/0016956 | A1 | | 1/2006 | Bennett et al. | |
| 2006/0131475 | A1 | | 6/2006 | Testa | |
| 2006/0284049 | A1 | | 12/2006 | England | |
| 2007/0107342 | A1 | * | 5/2007 | Friedlich | E04F 19/049 52/311.1 |
| 2007/0228254 | A1 | * | 10/2007 | England | E04G 15/068 249/114.1 |
| 2007/0259520 | A1 | | 11/2007 | Cooper et al. | |
| 2008/0079269 | A1 | * | 4/2008 | Bushey | E05C 17/54 292/342 |
| 2009/0249704 | A1 | * | 10/2009 | Wilson | E04D 13/076 52/12 |
| 2010/0024321 | A1 | | 2/2010 | Scherer | |
| 2012/0047818 | A1 | * | 3/2012 | Lopez | E04D 13/076 52/12 |
| 2012/0076588 | A1 | | 3/2012 | Dupuis et al. | |
| 2012/0126084 | A1 | | 5/2012 | Christeson | |
| 2014/0260022 | A1 | | 9/2014 | Lewis | |
| 2014/0295725 | A1 | * | 10/2014 | Passmann | B32B 37/144 442/221 |
| 2015/0184350 | A1 | | 7/2015 | Taylor | |
| 2015/0354160 | A1 | | 12/2015 | Ragsdale, Jr. | |
| 2016/0032585 | A1 | | 2/2016 | Park | |
| 2017/0291055 | A1 | | 10/2017 | Madion | |

FOREIGN PATENT DOCUMENTS

| | | | | | |
|---|---|---|---|---|---|
| DE | 19520723 | A1 | * | 12/1996 | E04B 5/32 |
| DE | 202013000686 | | * | 4/2014 | E06B 1/6023 |
| GB | 2434543 | | * | 8/2007 | A61F 5/0102 |
| JP | 2013231290 | A | | 11/2013 | |
| KR | 100844278 | | * | 7/2008 | A62C 3/16 |
| WO | WO-9738167 | A1 | * | 10/1997 | E01C 11/02 |

* cited by examiner

CEMENT FORM WITH EXTENSION

TECHNICAL FIELD

The present disclosure generally relates to cement forms used to create cement structures such as building foundations.

BACKGROUND

Traditionally, cement forms are held in place with an arrangement of metal stakes, kickers and other supporting structure. The traditional methods for forming a monolithic building foundation are particularly time intensive to set up and take down after the cement monolithic foundation is poured. After the form is removed, dirt is backfilled around the foundation to provide support and soil grading. In certain cold climates, foam insulation sheets are positioned against the sidewall of the foundation and extending laterally from the sidewall after the form is removed and before dirt is backfilled around the foundation. The foam insulation provide a desired R value that helps hold in heat from the building within the foundation, thereby providing protection again extreme expansion and contraction of the foundation resulting from outside temperature changes.

SUMMARY

According to one aspect of the present disclosure, a cement form includes a first surface arranged vertically and configured to support a volume of cement, a second surface arranged horizontally and configured to contact a ground support surface, and at least one of a foam material and a polymer material.

The cement form may have a wedge-shaped cross-section. The cement form may have a triangular cross-section shape. The cement form may further include a weight bearing surface facing at least in part in a vertical direction. The cement form may include a connector groove extending along at least a portion of a length of the cement form. The connector groove may be configured to receive a connecting member that extends between adjacent positioned cement forms. The cement form may include at least one aperture sized to receive a support stake extending through the cement form.

Another aspect of the present disclosure related to a cement form that includes an elongate member having a wedge-shaped cross-sectional shape and is formed from a foam material. The elongate member may include a connector groove sized to receive a connecting member that spans between adjacent positioned cement forms. The elongate member may be configured to receive a support stake through the foam material to connect the cement form to a ground surface without pre-forming a pass-through bore in the elongate member sized to receive the support stake. The cement form may be configured to be at least partially covered with backfill dirt prior to forming a cement structure using the cement form. The elongate member may include a first surface arranged vertically and configured to support a volume of cement, and a second surface arranged horizontally and configured to contact a ground support surface. The foam material may include at least one of expanded polyethylene and high density foam.

A further aspect of the present disclosure relates to a cement form assembly that includes at least two cement forms each comprising at least one of a foam material and a polymer material, and each having at least one connector groove formed therein. The cement form assembly also includes at least one connecting member positioned in the connector grooves and spanning between the at least two cement forms to interconnect the at least two cement forms, and a plurality of support stakes extending through the at least two cement forms and into a ground support.

The at least two cement forms may each have a wedge-shaped cross-section. The cement form assembly may also include an inner insert configured to be spaced inward from the at least two cement forms and arranged to be positioned under a cement structure formed using the cement form. The at least two cement forms each include at least one pass-through bore sized to receive one of the plurality of support stakes.

Another aspect of the present disclosure relates to a method of forming a monolithic foundation. The method includes providing a plurality of cement forms each comprising a foam material, staking the plurality of cement forms to a ground surface, interconnecting at least some of the plurality of cement forms, covering at least a portion of the plurality of cement forms with backfill dirt, thereafter, pouring cement into contact with the plurality of cement forms to form a monolithic foundation, and leaving the plurality of cement forms covered and in contact with the monolithic foundation after the cement cures to provide insulation for the monolithic foundation.

Staking the plurality of cement forms may include driving a stake through the foam material, and driving the stake through the foam material concurrently forms a pass-through aperture through the foam material. Interconnecting the plurality of cement forms may include removably inserting a connecting member into connector grooves of adjacent positioned cement forms. The method may include removing the connecting member from the connector grooves after the cement is cured. The method may include inserting a foam strip into the connector grooves after removing the connecting member.

The present disclosure also relates to a cement form that includes a unitary body portion. The unitary body portion includes a first surface arranged vertically and configured to support a volume of cement, a second surface arranged horizontally and configured to contact a ground support surface, a foam material, and a detachable portion.

The cement form may have a triangular cross-section shape. The cement form may include a weight bearing surface extending from the first surface to the second surface, wherein the weight bearing surface faces at least in part in a vertical direction and is arranged at an angle in the range of about 20° to about 60° relative to the second surface. The cement form may include a connector groove formed in the weight bearing surface and extending along at least a portion of a length of the body portion, wherein the connector groove is configured to receive a connecting member that extends between adjacent positioned cement forms. The detachable portion may be positioned adjacent to the connector groove. The body portion may be free of pre-formed holes for receiving support stakes.

Another aspect of the present disclosure relates to a cement form that includes an elongate member having a wedge-shaped cross-sectional shape, a foam material, a detachable portion, and at least one relief cut to facilitate disconnection of the detachable portion. The detachable portion may include a tip portion or tip structure of the cement form.

The elongate member may include a connector groove sized to receive a connecting member that spans between adjacent positioned cement forms. The detachable tip portion may be positioned at an entry point into the connector groove. The at least one relief cut may include first and second relief cuts. The elongate member may include a first surface arranged vertically and configured to support a volume of cement, and a second surface arranged horizontally and configured to contact a ground support surface. The foam material may include at least one of expanded polyethylene and high density foam. An end of the elongate member may have a 45° shape relative to a length dimension of the elongate member.

Another aspect of the present disclosure relates to a cement form assembly that includes at least two cement forms, at least one connecting member, and a plurality of states. The cement forms each include a foam material, at least one connector groove, a detachable portion, and at least one relief cut configured to partially disconnect the detachable portion. The at least one connecting member is configured to span between adjacent positioned cement forms and extend into the at least one connector groove to interconnect the at least two cement forms. The plurality of support stakes extend through the at least two cement forms and into a ground support.

The at least two cement forms may each have a wedge-shaped cross-section along an entire length thereof. The cement form assembly may also include at least one inner insert configured to be spaced inward from the at least two cement forms and arranged to be positioned under a cement structure formed using the at least two cement forms. The at least one inner insert may have a wedge-shaped cross-section. The at least one relief cut may include first and second relief cuts, wherein one of the first and second relief cuts is formed within the at least one connector groove. Each cement form may include a first surface arranged vertically and configured to support a volume of cement of a building foundation, a second surface arranged horizontally and configured to contact a ground support surface, and a weight bearing surface extending from the first surface to the second surface. The at least one connector groove may be formed in the weight bearing surface. The cement form assembly may also include a foam strip configured to be inserted into the at least one connector groove after removing the at least one connecting member.

According to one aspect of the present disclosure, a cement form includes a single piece, unitary body member having a solid, continuous construction and a wedge-shaped cross-section. The body member includes a first surface arranged vertically and configured to support a volume of cement, a second surface arranged horizontally and configured to contact a ground support surface, a foam material, an elongate construction with a greater length dimension in a horizontal direction than a height dimension in a vertical direction, and a notch formed at an intersection of the first and second surfaces, the notch being receptive of a portion of a foam sheet.

The cement form may have a triangular cross-section shape. The cement form may further include a weight-bearing surface extending from the first surface to the second surface. The weight-bearing surface may face at least in part in a vertical direction. The weight-bearing surface may be arranged at an angle in the range of about 20° to about 60° relative to the second surface. The cement form may further include a connector groove formed in the weight-bearing surface and extending along at least a portion of a length of the body member. The connector groove may be configured to receive a connecting member that extends between adjacent positioned cement forms. The connector groove may be open in a vertically upward direction and having a closed bottom end. The notch may have a rectangular cross-sectional shape. The notch may have a length along the second side that is at least 3 inches and a height along the first surface that is at least 2 inches.

Another aspect of the present disclosure relates to a cement form that includes an elongate member having a wedge cross-sectional shape, a foam material, first and second ends and a length measured therebetween, and a cement support surface extending vertically and configured to support a volume of cement. The cement support surface extends from a bottom most edge to an upper most edge of the elongate member. The cement support surface defines a height of the elongate member, and the height is less than the length. The elongate member further includes a notch formed in the cement support surface at the bottom most edge. The cement form may also include an extension member having a first end inserted into the notch and a second end extending away from the cement support surface.

The elongate member may include a connector groove extending along the length of the elongate member and being spaced away from the cement support surface. The connector groove may be open in a vertical direction and sized to receive a connecting member that spans between adjacent positioned cement forms. The extension member may have a greater width between the first and second ends in a horizontal direction than a thickness in a vertical direction. The extension member may have a first portion extending horizontally from the elongate member, and a second portion extending at an angle relative to the first portion. The extension member may have a length that is substantially the same as the length of the elongate member, a thickness that is substantially the same as a height of the notch along the cement support surface, and a width that is less than the length of the extension member.

The elongate member may include a bottom surface arranged horizontally and configured to contact a ground support surface. The bottom surface may be arranged perpendicular to the cement support surface. The notch may be formed at least in part in the cement support surface and at least in part in the ground support surface. Ann end of the second portion may be arranged at an angle of about 45 degrees relative to the first portion.

The cement form may include a removable member, wherein the removable member may be disconnected from a elongate member along the cement support surface at the bottom most edge to form the notch, and the removable member may be positionable at the upper most edge of the elongate member and in alignment with the cement support surface to increase the height of the elongate member. At least a portion of the extension member may be configured to extend vertically below the volume of cement.

The present disclosure also relates to a cement form that includes a single piece first foam member having first and second ends and a length measured between the first and second ends, a cement support surface oriented vertically and arranged to support a volume of cement, the support surface defining a height of the elongate member, wherein the height is less than the length, and a wedge cross-sectional shape. The cement form also includes an extension member having a first edge arranged to contact the first foam member and a second edge extending away from the first foam member.

The first member may have a connector groove formed therein. The connector groove may be open in a vertical direction and extend along an entire length of the first member. The connector groove may be configured to receive at least one connecting member configured to span between and interconnect adjacent positioned cement forms. The extension member may have a first portion extending horizontally from the elongate member, and a second portion extending at an angle relative to the first portion. An end of the second portion may be arranged at an angle of about 45 degrees relative to the first portion. The first foam member may include a notch formed in the cement support surface. The first edge of the extension member may be configured to be inserted into the notch. At least a portion of the extension member may be configured to extend vertically below the volume of cement. The extension member may have a greater length and width than a thickness.

The above summary is not intended to describe each embodiment or every implementation of embodiments of the present disclosure. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
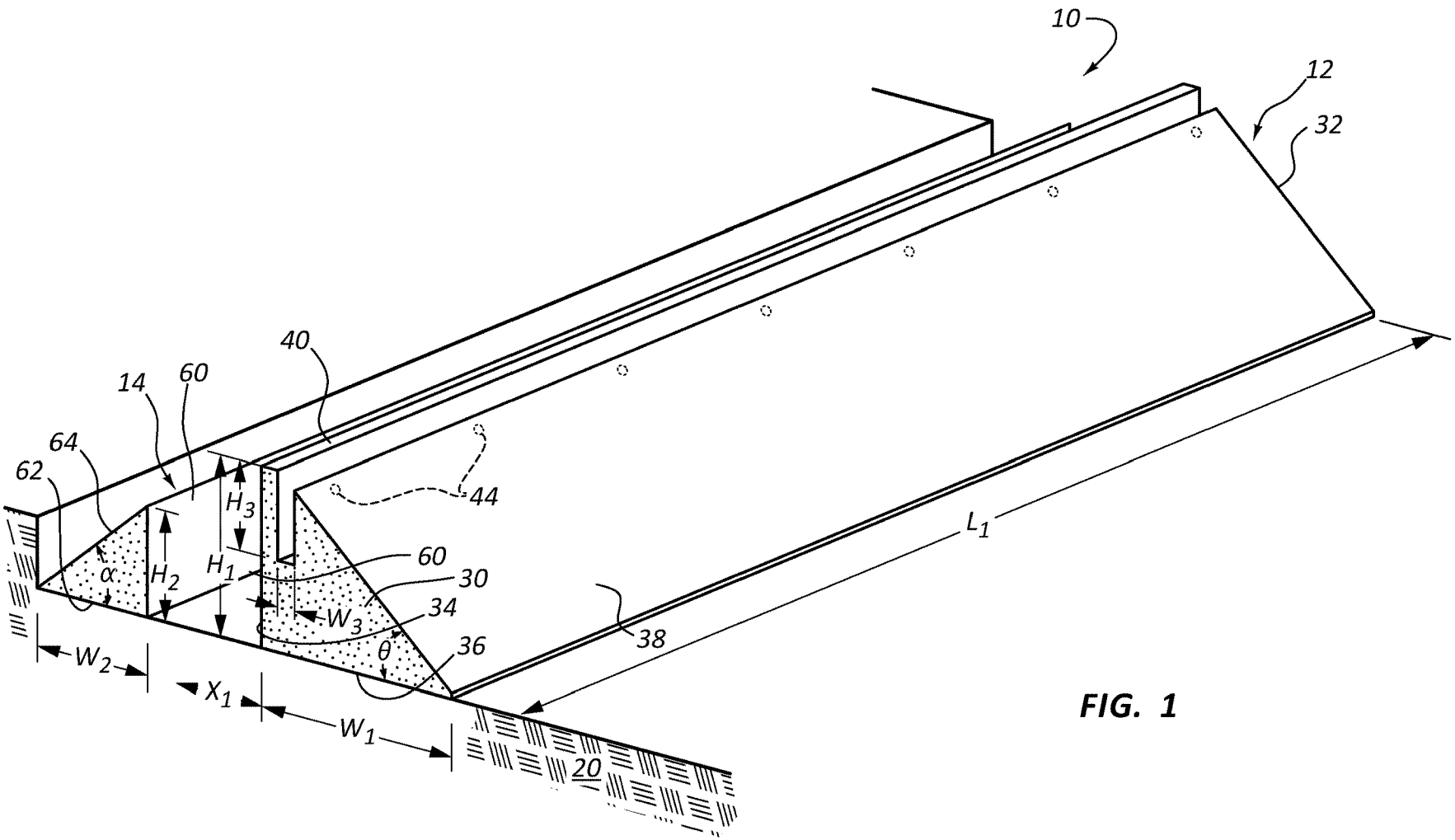
FIG. 1 is a perspective view of a cement form assembly in accordance with the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure generally relates to cement forms used to form cement structures such as cement foundations. The apparatuses and methods of the present disclosure are particularly useful for forming monolithic foundations in which the footings and floor are poured as a single, monolithic structure. The apparatuses and methods of the present disclosure are also particularly useful for forming The disclosed cement forms, cement form assemblies, methods of making cement forms/cement form components, and methods of forming cement structures using the disclosed cement forms may be used in place of traditional wood/metal cement forms that are labor intensive to set up and must be removed after pouring the cement, and foam insulation sheets that are required in cold climates to be buried adjacent to the cement structure (e.g., cement foundation) to limit frost damage to the cement structure.

One aspect of the present disclosure relates to a cement form that is comprised substantially of a foam material such as, for example, expanded polyethylene or high density foam (e.g., known as Blue Board). The foam cement form may be used to form a cement structure by containing the cement while being poured and cured. The cement form remains in contact with the cement structure to later provide an insulating function to insulate the cured cement. The foam cement form may be at least partially buried prior to pouring the cement. The backfill material used to at least partially bury the foam cement form may help hold the form in place while the cement is being poured and cured.

Another aspect of the present disclosure relates to cement forms formed from a polymer material such as, for example, polyethylene or other polymer. Various molding processes may be used to form the polymer cement form including, for example, blow molding, drape forming, injection molding, and the like. A polymer cement form may include additional intricate features such as support ribs, pass-through bores, grooves, internal cavities, and the like which may be more difficult to form in a foam cement form. Further, a polymer cement form in accordance with the present disclosure may be reusable for forming a plurality of cement structures, wherein the polymer cement form is removed from the cement structure after curing of the cement.

Another aspect of the present disclosure relates to methods of forming a cement structure such as a monolithic foundation. Such methods may include use of a foam cement form or a polymer cement form in accordance with the present disclosure. Such methods may also include the use of an internal insert that is positioned under or internal the cement structure. The internal insert may comprise a foam material, a polymer material, or the like. Typically, the internal insert is provided to help minimize the amount of cement that is needed to create the cement structure. The cost and labor associated with using an internal insert is usually less than the extra amount of cement that may otherwise be required to create the cement structure. In at least some examples, the internal insert may provide an additional insulating property that increases the R value associated with protecting the cement structure from fluctuations in temperature.

A further aspect of the present disclosure relates to methods of forming foam cement forms and polymer cement forms. Such methods may be implemented to provide cost-effective, efficient production of cement forms. The cement forms may be structured as part of such manufacturing methods to facilitate assembly, storage, and shipping that is more efficient and cost-effective than those available for existing cement forms.

Another aspect of the present disclosure relates to a cement form that includes a breakaway portion. The breakaway portion may be defined in part by one or more relief cuts formed in the cement form. The breakaway portion may include a pointed tip portion of the cement form. In at least one example, the detachable portion may be positioned adjacent to a connector groove of the cement form, wherein the connector groove is receptive of a connector that spans between adjacent positioned cement forms. The detachable portion may support the connector prior to and during formation of a cement structure that is formed using the cement form. After the cement structure has been formed, the detachable portion may be removed from the cement form, such as after removing the connector. Once the detachable portion is removed, the backfill dirt that at least partially covers the cement form may be further positioned to cover additional portions of the cement form.

Since the cement forms disclosed herein may have many different shapes and sizes, the detachable portion may itself have various shapes and sizes. Furthermore, one or a plurality of relief cuts may be provided in the cement form to assist in disconnecting the detachable portion. The shape, size and orientation of the relief cut may help facilitate disconnecting the detachable portion with relative low amounts of force and/or effort.

A yet further aspect of the present disclosure relates to an angled end face or portion of the cement form and/or inner insert. In one example, one or more ends of the cement form and/or inner insert are cut at a 45° angle. As such, a pair of cement forms and/or a pair of inner inserts may be arranged at 90° relative to each other with the 45° angled portions mating to provide a relatively continuous structure. In other examples, one or more ends of the cement form and/or inner insert may be cut at a different angle orientation, such as an angle in the range of about 30° to about 60° or other ranges of angles to permit mating of adjacent positioned cement forms and/or inserts at particular angles that are less than or greater than 90°.

Another aspect of the present disclosure relates to a foam cement form that includes an extension member. The extension member may extend from the cement form to a position underneath the cement structure to provide a thermal barrier between the cement structure and the supporting ground surface. The extension member may extend from the cement form in a direction away from the cement structure to provide a thermal barrier. The extension member may extend vertically from the cement form to extend a height of the cement form for purposes of creating a cement structure with increased thickness in a vertical direction. In one example, the cement form includes a notch formed therein to promote a positive connection between the extension member and the cement form. The cement form may include a single piece, unitary body member having a solid, continuous construction and a wedge-shaped cross-section. The body member includes a first surface arranged vertically and configured to support a volume of cement, a second surface arranged horizontally and configured to contact a ground support surface, a foam material, an elongate construction with a greater length dimension in a horizontal direction than a height dimension in a vertical direction, and a notch formed at an intersection of the first and second surfaces, the notch being receptive of a portion of an extension member, such as a foam sheet.

Referring to FIGS. 1-5, an example cement form assembly 10 is shown and described. The cement form assembly 10 includes a cement form 12 and an inner insert 14 (see FIG. 1). The cement form 12 and inner insert 14 are particularly useful for forming a building foundation, such as a monolithic foundation. The cement form 12 is used to support an exterior wall of the foundation. The inner insert 14 is positioned spaced inward from the cement form 12 and at a location that defines an inner and bottom surface of the foundation. Each of cement form 12 and inner insert 14 have a wedge shaped cross-sectional shape in the embodiment shown in FIG. 105. A vertical surface of the wedge shape defines a supporting surface that contains cement that is poured to form the foundation. A bottom, downward facing surface of each of the wedge shaped structures rests against a ground support and has sufficient width to maintain the cement form 12 and inner insert 14 in an upright position without the use of stakes, kickers, or other structures typically used in known cement form assemblies. The cement form 12 and inner insert 14 may be held in a specific position along the ground support using stakes that are driven through the cement form 12 and inner insert 14 and into the ground support, or driven into the ground support at a position directly adjacent to the cement form 12 and inner insert 14. The support stakes are typically not needed to hold the cement form 12 and inner insert 14 in an upright position.

Figure 37A:
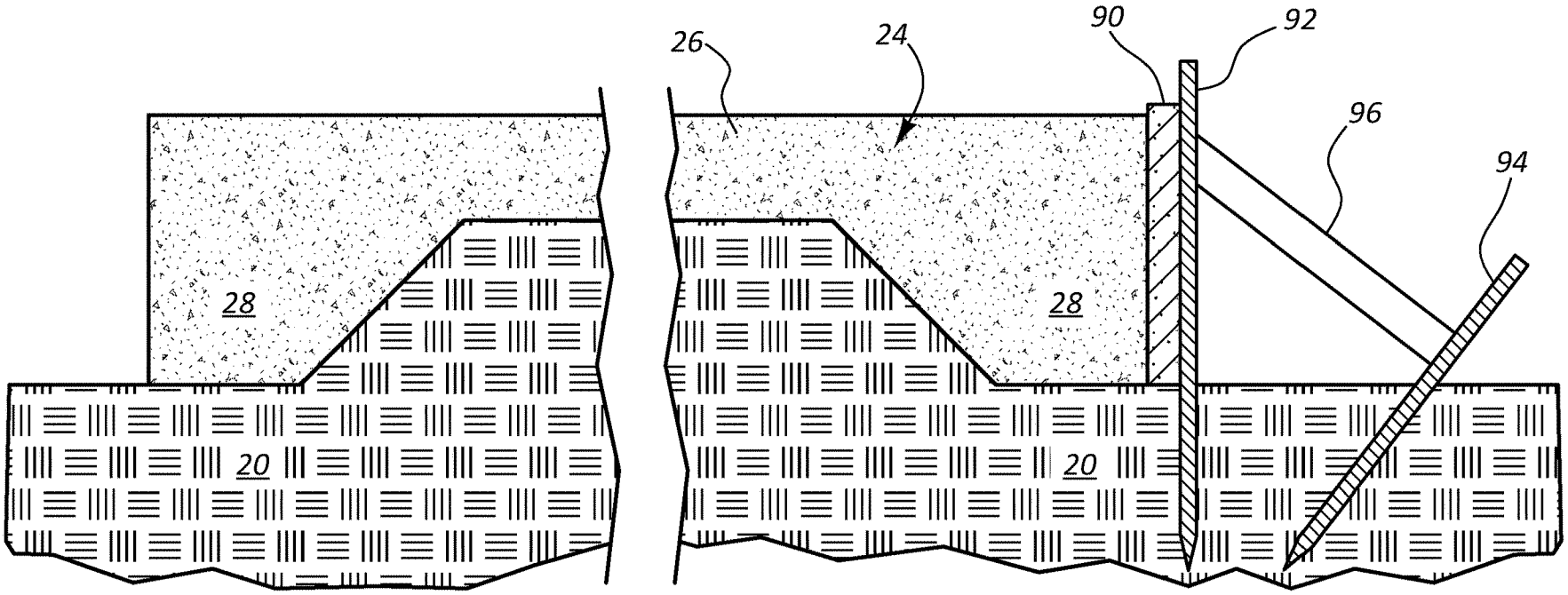
FIG. 37A (Prior Art)
FIGS. 37A and 37B show a prior art cement form assembly.
Figure 37B:
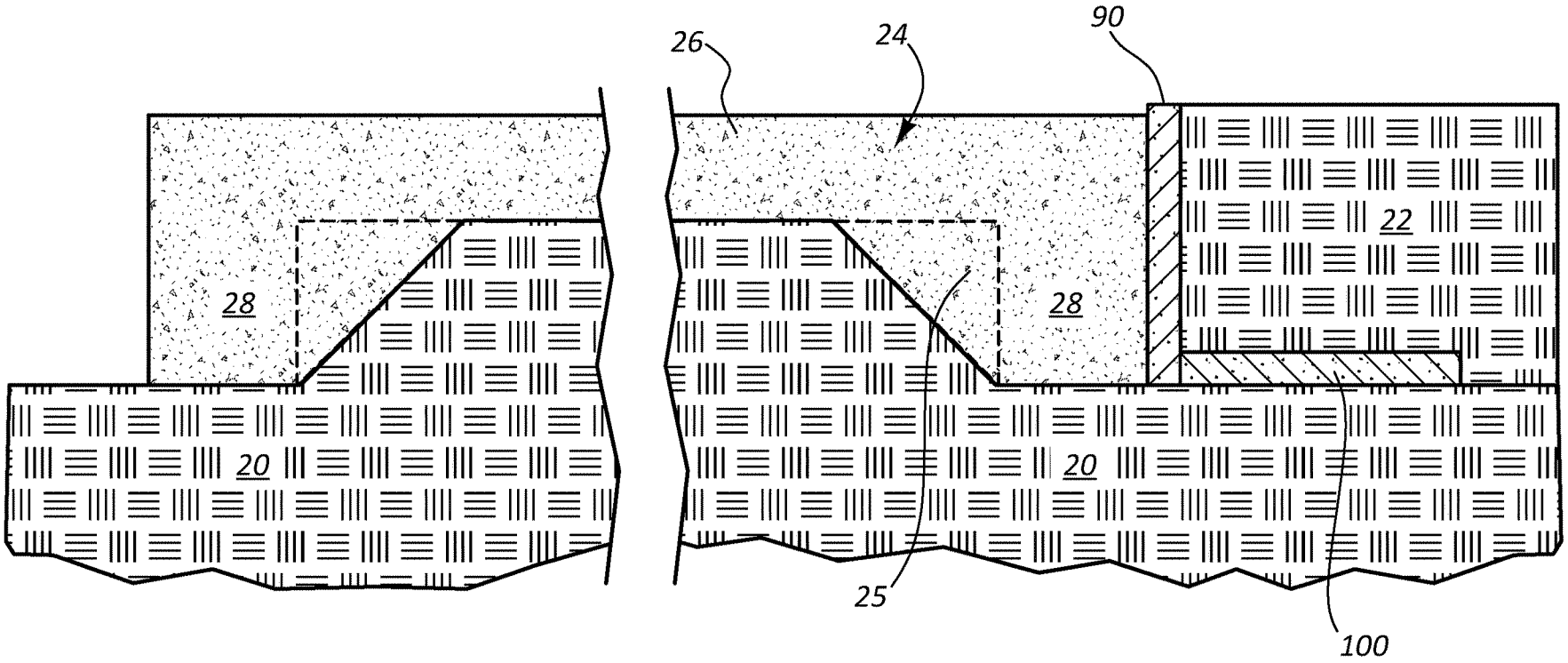
FIG. 37B (Prior Art)

Referring to FIGS. 37A and 37B, a traditional cement form assembly is shown. The traditional assembly includes a cement form 90 that is held in place along a ground support 20 with a plurality of form stakes 92. A plurality of kickers 96 extend diagonally from the cement form 90 to hold the cement form 90 in a vertical, upright position. The kickers 96 are held in place with a plurality of kicker stakes 94. The process of setting up the form assembly shown in FIG. 37A is extremely labor intensive because not only does the cement form 90 need to be held in an upright position, but also needs to be held in a fixed lateral and axial position along the ground support 20.

The ground support 20 is pre-shaped to match the desired dimensions for a slab 26 and footings 28 of a foundation 24. The increased depth required for the footings 28 requires a tapering of the ground support 20 from the area of the slab 26 to the area of the footings 28. Because the ground support 20 comprises dirt, gravel, or other fill material that is generally loose, it is difficult to form the transition between the slab support area and foundation support area of the ground support 20 in a square shape represented by feature 25 in FIG. 37B. The feature 25 shown in FIG. 37B represents the additional cement that is required to fill the transition space between the slab support portion and foundation support portions of the ground support 20. This additional cement can be significant, particularly when forming large foundations. This additional cement is unnecessary from a structural perspective for the foundation, but is a required additional cost when using traditional methods to form monolithic foundations.

Referring to FIG. 37B, after the foundation 24 is poured and cured, the cement form 90, stakes 92, 94 and kicker 96 are removed, and a pair of foam sheets 98, 100 are positioned resting against the exterior, lateral surface of the foundation 24 and against the ground support 20 adjacent to foundation 24. The foam sheets 98, 100 provide insulation for foundation 24 and provide a certain R value. In at least some cases, the foam sheets 98, 100 help retain heat within the foundation 24 so that the heat does not immediately dissipate into backfill 22 that is later used to cover the foam sheets 98, 100 and grade the ground surface adjacent to foundation 24. The backfill 22 may be in the form of dirt, gravel, or other fill material. The backfill 22 holds the foam sheets 98, 100 in their respective positions in contact with the lateral outside surface of foundation 24 and along the ground support 20 extending laterally outward from foundation 24.

The traditional structures and methods of forming monolithic foundations and other cement structures as represented in FIGS. 37A and 37B have many disadvantages, inefficiencies, and unnecessary costs. The apparatuses and methods disclosed herein, particularly with reference to FIGS. 1-38 address many of the drawbacks associated with the traditional apparatuses and methods described with reference to FIGS. 37A and 37B.

Referring again to FIG. 1, the cement form 12 includes first and second ends 30, 32, a first surface 34, a second surface 36, and a weight-bearing surface 38. Cement form 12 may also include a top surface 40 and a connector groove 42. Cement form 12 may optionally include a plurality of stake openings or apertures 44 positioned along a length $L_1$. The stake openings 44 may be provided as pass-through bores that extend from the weight-bearing surface 38 or top surface 40, through the body of cement form 12 and out through second surface 36. The cement form 12 may be referred to as an elongate body, a unitary body or unitary cement form, or a body portion.

The first surface 34 may be arranged generally vertical or aligned parallel with a vertical plane. First surface 34 may support a volume of concrete that is poured into a space between cement form 12 and inner insert 14. First surface 34 may have any desired shape, size and orientation to provide the desired shape, size and orientation of a resulting surface of a cement structure supported by cement form 12. First surface 34 is shown having a height $H_1$. The height $H_1$ may be in the range of, for example, about 4 inches to about 60 inches, and more preferably in the range of about 12 inches to about 24 inches, which is common for standard monolithic foundations. First surface 34 may include a decorative pattern that results in a decorative pattern formed on the side surface of the cement structure (e.g., foundation). Such a decorative pattern may be visible in the event that cement form 12 is removed and the side surface of the cement structure is exposed for viewing.

Second surface 36 typically is oriented generally horizontally or aligned parallel with a horizontal plane. Second surface 36 rests upon a ground support 20. Typically, the ground support 20 is generally planer or arranged in a horizontal plane at least in the area where the cement form 12 is positioned. Second surface 36 may have a width $W_1$ that is in the range of, for example, about 6 inches to about 48 inches, and more particularly in the range of about 12 inches to about 24 inches. In at least some embodiments, the width $W_1$ is substantially equal to the height $H_1$ of first surface 34. The width $W_1$ is typically equal to or greater than the height $H_1$ to provide balance and support for the cement structure being formed. However, the ratio between weight $W_1$ and height $H_1$ may vary based upon a variety of factors including, for example, materials used for cement form 12, the amount of cement supported by cement form 12 and other structural features of cement form 12 such as, for example, the size and shape of connector groove 42, an angle θ that defines an orientation of weight-bearing surface 38, the amount of backfill that is possible to cover weight-bearing surface 38 prior to pouring the cement structure, and the like.

The weight-bearing surface 38 is substantially planer and extends from an outermost edge of second surface 36 toward the first surface 34. A plurality of stake openings 44 may be formed in the weight-bearing surface 38. In at least some examples, cement form 12 comprises a material that permits driving a stake through the cement form 12 without preforming a stake opening 44. Driving a stake through the cement form 12 may concurrently form a stake opening. Such materials are commonly foam materials as described above, but may include other materials that can be punctured without cracking or otherwise failing structurally. The use of certain foam materials permits driving stakes through cement form 12 at any desired location along the weight-bearing surface 38, within connector groove 42, or through top surface 40. In some embodiments, stakes may be driven into ground support 20 at an outer edge of cement form 12 at the interface between second surface 36 and weight-bearing surface 38 to prevent sliding of the cement form 12 in at least one direction along ground support 20. Stakes may be temporarily driven into ground support 20 along an opposite edge of cement form 12 at the interface between first and second surfaces 34, 36 prior to pouring the cement structure. Such temporarily position stakes may remain in place while taking other steps related to setting up the cement form assembly 10 such as, for example, inserting connecting members into connector groove 42, driving stakes through stake openings 44 or along the outer edge of cement form 12, and/or at least partially covering weight-bearing surface 38 with a backfill dirt or gravel material.

The connector groove 42 may be positioned along the weight-bearing surface 38. Connector groove 42 may be accessible along a top side of cement form 12. Connector groove 42 may be open facing in a generally vertical or upward direction. In at least some examples, connector groove 42 is formed in top surface 40 rather than in weight-bearing surface 38, or a combination of the two. Connector groove 42 is shown having a maximum height $H_3$ and a width $W_3$. In at least some examples, connector groove 42 is dimensioned to receive a standard board size such as a 2"×4", 2"×6" or 2"×8" board. Such a board may be referred to as a connecting member 16 (see FIGS. 2-3). The boards or connecting member 16 may be positioned within connector groove 42 and spanned between adjacent positioned cement forms 12 to provide an interconnection of adjacent position cement forms 12. Connector groove 42 is sized, shaped and oriented on cement form 12 to provide easy insertion and removal of such connecting members at various stages of setting up cement form assembly 10 and creating a cement structure, such as a monolithic foundation.

Typically, connectors are inserted into connector groove 42 prior to pouring cement to form a cement structure, and are later removed after the cement cures so that the connecting members may be reused for other cement form assemblies. The connector groove 42 may have any desired shape and size to accommodate connecting members of different shapes and sizes. In one example, the connecting members are in the form of a sheet of material, a clip structure, a bracket, or the like. Connector groove 42 may be customized in its shape, size and orientation to accommodate such connecting members. In some embodiments, connector groove 42 may extend along the entire length $L_1$. In other examples, the connector groove 42 extends along only a portion of the length $L_1$ such as, for example, along portions directly adjacent to the first and second ends 30, 32.

The material of cement form 12 that is removed in order to form connector groove 42 may be saved and then reinserted in connector groove 42 after removal of the connecting members. This inserted material may help fill connector groove 42 to prevent backfill dirt or other objects from collecting in connector groove 42, which may otherwise reduce the R value of cement form 12 when cement form 12 is left in the ground and used to insulate the cement structure.

The cement form 12 may be used alone or in combination with inner insert 14. Inner insert 14 may eliminate the need for the extra cement 25 shown in FIG. 22B and discussed above. Inner insert 14 may be positioned along the ground support 20 in the area of the footing portion 28 of foundation 24 (see FIG. 22A). Inner insert 14 may be positioned adjacent to that portion of ground support 20 that supports the slab portion 26 of the foundation 24 (see FIG. 22A). Backfill material may be used to cover at least portions of the inner insert 14 on top of or adjacent to the portion of ground support 20 that supports the slab 26 thereby reducing the extra cement 25 that is otherwise needed.

Inner insert 14 includes a cement surface 60, a ground support surface 62, and a backfill support surface 64. Cement surface 60 has a height H2 and is arranged generally vertically and/or in parallel with a vertical plane. Ground support surface 62 has a width $W_2$ and is arranged horizontally and/or parallel with a horizontal plane. Backfill support surface 64 extends from the ground support surface 62 to the cement surface 60 and may be arranged at an angle $\alpha$ is directly dependent on the height H2 and width $W_2$. Inner insert 14 also has a length $L_2$ (see FIG. 1A). Inner insert 14 is typically spaced apart from cement form 12 a distance $X_1$. The distance $X_1$ is typically in a range of about six inches to about 36 inches, and more particularly in the range of about 12 inches to about 24 inches, which is typical for monolithic foundations.

Figure 1A:
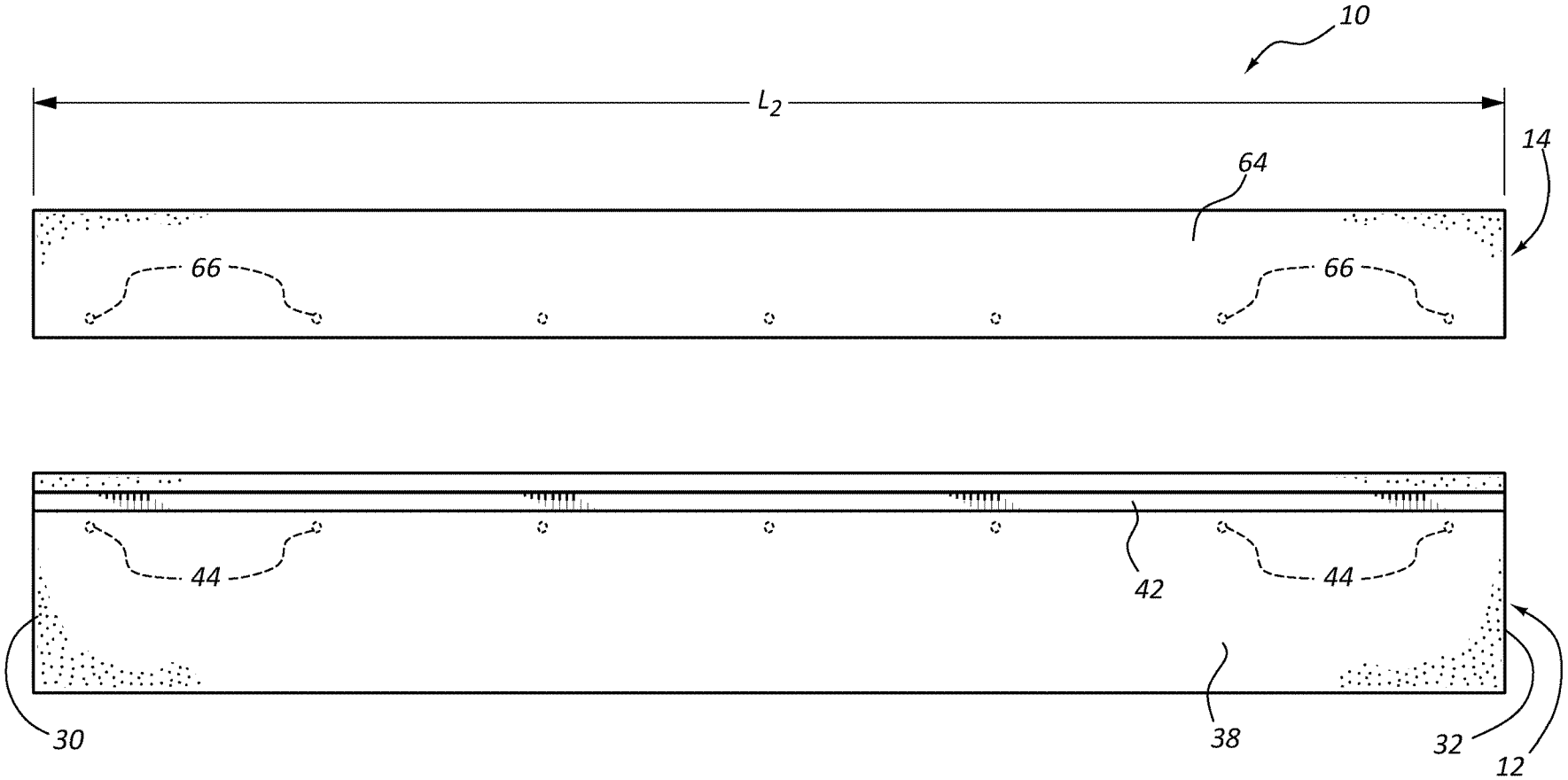
FIG. 1A is a top view of the cement form assembly shown in FIG. 1.

Inner insert 14 may include a plurality of stake openings 66 positioned along the length $L_2$ (see FIG. 1A). Inner insert 14 may comprise a foam material such as polyethylene foam or a high density foam. In some examples, inner insert 14 comprises a polymer material such as, for example, a polyethylene or other molded material. The materials used for inner insert 14 may be the same as those used to form cement form 12. Certain materials used for inner insert 14 may permit forming of the stake opening 66 as stakes are driven through inner insert 14 and into ground support 20. In other examples, the stake opening 66 are pre-formed as, for example, pass-through bores that extend from backfill support surface 64 through ground support surface 62. The stake opening 66 may be formed at any location along the backfill support surface 64. In at least some examples, stakes are driven into ground support 20 adjacent to inner insert 14 but not extending through any portion of inner insert 14 to hold inner insert 14 in position during various steps leading up to pouring the cement structure. For example, stakes may be positioned along the cement surface 60 to hold inner insert 14 in position while backfill material is placed on the backfill support surface 64, and those stakes are removed prior to pouring the cement structure.

Figure 2:
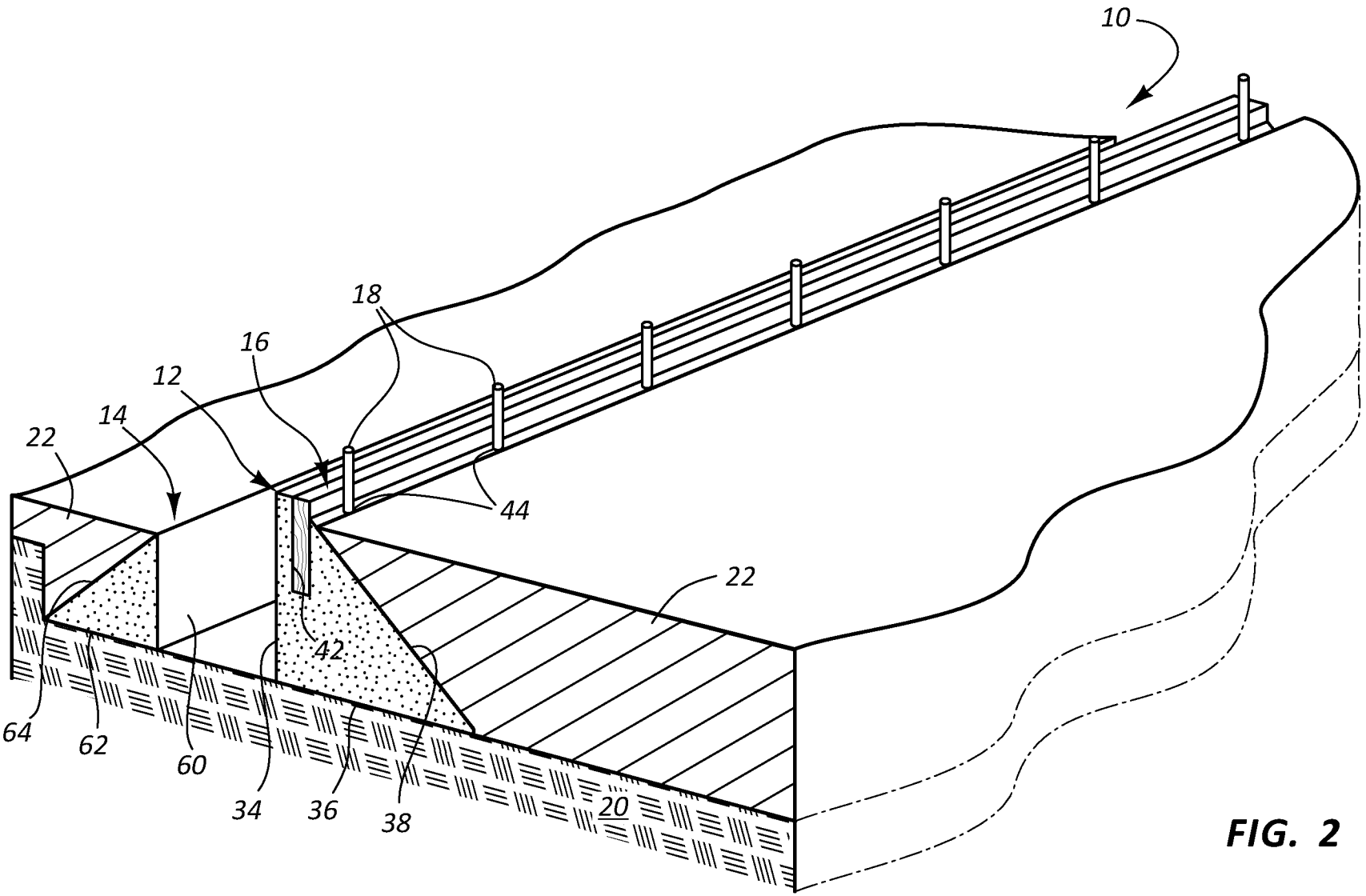
FIG. 2 is a perspective view of the cement form assembly shown in FIG. 1 with connecting members.

Referring to FIG. 2, the cement form assembly 10 is shown with connecting member 16 positioned in connector groove 42, stakes 18 driven through cement form 12 and into ground support 20, and backfill 22 positioned covering at least portions of the weight-bearing surface 38 of cement form 12 and substantially all of the backfill support surface 64 of inner insert 14. The cement form assembly 10 is shown prepared for pouring cement to create a cement structure (e.g., monolithic foundation). Typically, the backfill 22 is filled up to the connector groove 42 but typically not covering the connecting members 16. The backfill 22 can be filled to any desired height, but is typically always vertically lower than the connector groove 42 and/or the top surface 40. The stakes 18 may have ends that protrude through backfill 22 or may be positioned on cement form 12 in a way that they are completely buried by backfill 22. The stakes 18 may extend above the cement form 12, particularly above the weight-bearing surface 38 or top surface 40 into which the stakes are driven. The stakes 18 may be later removed. In at least some examples, the stakes 18 are left positioned in cement form 12 even after the cement structures is cured.

The stakes 18 may be in the form of, for example, wood or other insulating material that does not significantly reduce the R value of the cement form 12. Further, stakes 18 may comprise a relatively low cost material that makes it possible from a cost perspective to leave the stakes 18 positioned in cement form 12 permanently. In some examples, stakes 18 may be driven into ground support 20 a distance that buries then within the cement form 12 or at least flush with the weight-bearing surface 38 and/or top surface 40 so that they are no longer exposed outside of backfill 22.

The backfill 22 is typically grated to the top edge of inner insert 14 as shown in FIG. 2. In at least some examples, the top edge of inner insert 14 includes a flat surface, round surface, or the like to help reduce or otherwise minimize stress concentrations at an internal corner feature formed in the cement structure. Some additional inner insert embodiments are shown and described below with reference to FIGS. 12A-12E.

Figure 3:
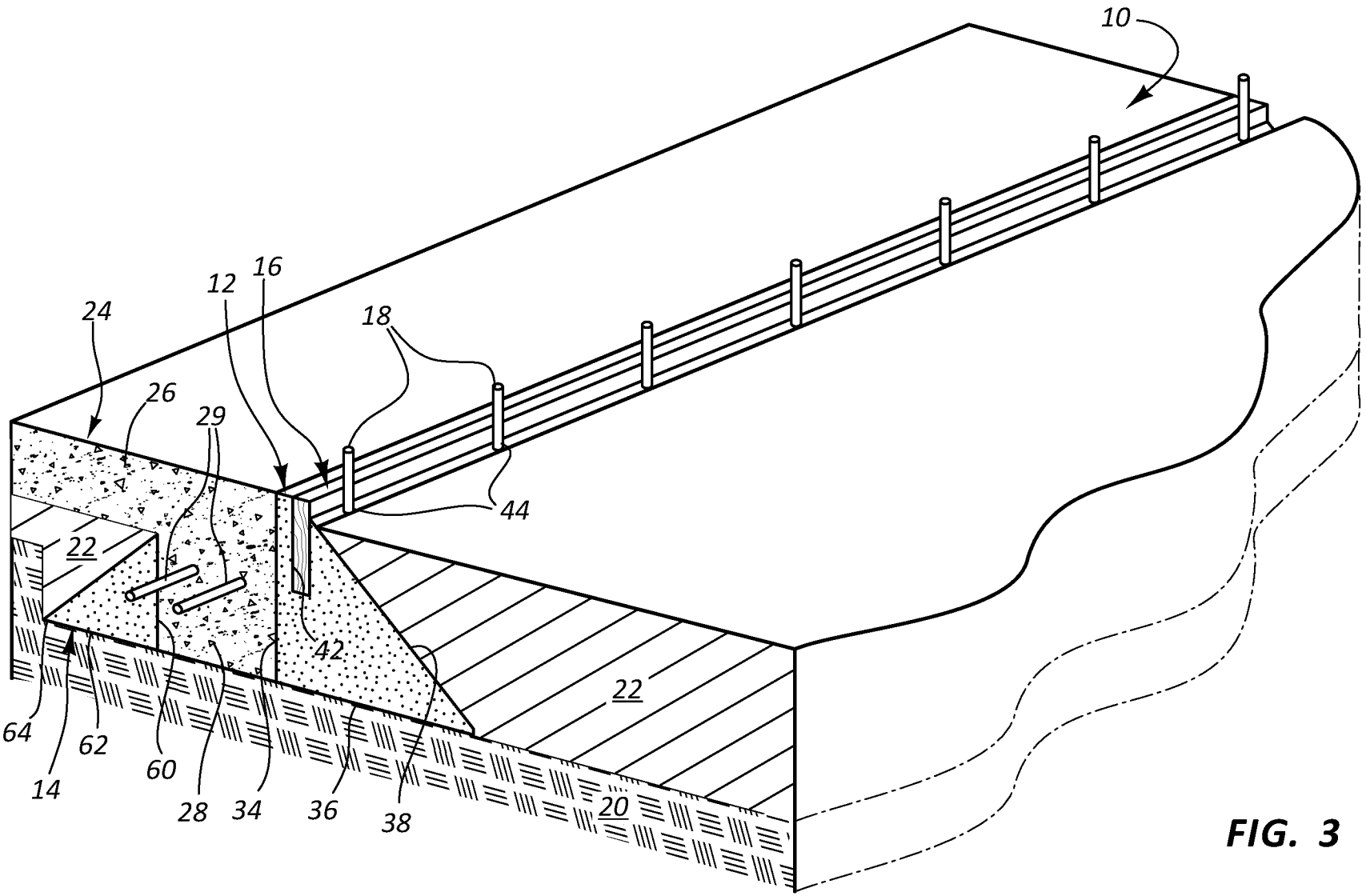
FIG. 3 is a perspective view of the cement form assembly of FIG. 2 used to form a monolithic foundation.

Referring to FIG. 3, a cement structure in the form of a monolithic foundation 24 is shown poured into the space between cement form 12 and inner insert 14 and covering inner insert 14. Foundation 24 includes a slab portion 26 and a footing portion 28. Foundation 24 may also include a plurality of rebar members 29 positioned internally. The cement form 12 is held in place laterally by stakes 18 and backfill 22. Cement forms 12 are also held in alignment relative to each other (e.g., relative to an adjacent cement form 12 that is positioned end-to-end therewith) with connecting members 16. Inner insert 14 may be held in place laterally and vertically using a plurality of stakes (not shown) and backfill 22. In at least some examples, the inner inserts 14 may also be interconnected with adjacent position inner inserts using connecting members such as connecting members 16. The connecting members may be positioned within connector grooves or other features formed in inner inserts 14 to promote interconnection of the adjacent position inner inserts 14.

In at least some examples, the cement structure (e.g., foundation 24) may be poured without first covering at least a portion of cement form 12 with backfill 22. For example, the connecting member 16 and stakes 18 may provide sufficient support and connection between cement form 12 and ground support 20 that no backfill 22 is needed. However, in at least some examples, backfill 22 is used to cover at least portions of cement form 12 to provide additional support for cement form 12 during pouring of the cement. Applying backfill 22 may also make it easier for a cement truck to move close to cement form 12 for purposes of delivering the cement as part of the cement pouring process. An additional benefit of pre-filling the backfill 22 before pouring the cement is that most, if not all of the grading associated with the cement structure (e.g., foundation 24) may be completed prior to pouring the cement without requiring a further follow-up grading step.

Figure 4:
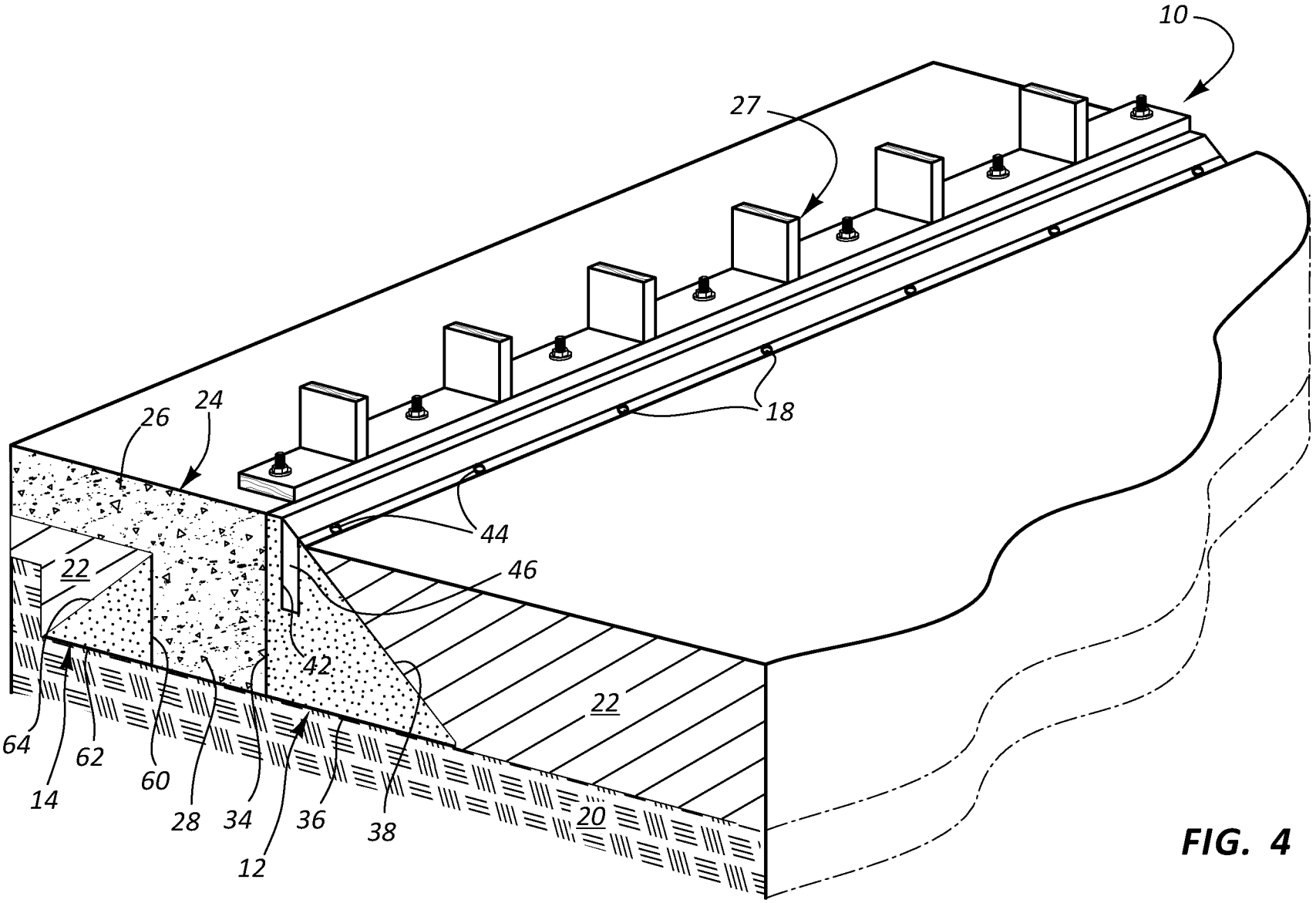
FIG. 4 is a perspective view of the cement form assembly shown in FIG. 3 with connecting members removed and a structure supported on the foundation.

Referring now to FIG. 4, the foundation 24 is shown with a building structure (e.g., wall 27) including a plurality of boards positioned along a top surface of the foundation 24. The connecting members 16 may be removed from connector groove 42 and reused in another cement form assembly. The stakes may be removed from stake openings 44, or may be driven further into stake openings 44 to be flush with weight-bearing surface 38 or at least the top surface of backfill 22. In at least some examples, the connector groove 42 may be filled with a strip 46 (also referred to as insert 46). The strip 46 may comprise the same material as the rest of the cement form 12. In at least some examples, the strip may be the material that was removed from cement form 12 as part of forming connector groove 42. Strip 46 may fill connector groove 42 to limit the amount of material or other objects that may otherwise fill connector groove 42. Using the strip 46 within connector groove 42 may improve the aesthetics of the exposed portion of cement form 12. In other embodiments, connector groove 42 may be filled with other materials such as, for example, an expandable foam or other insulating material that is different that the material of cement form 12.

Figure 5:
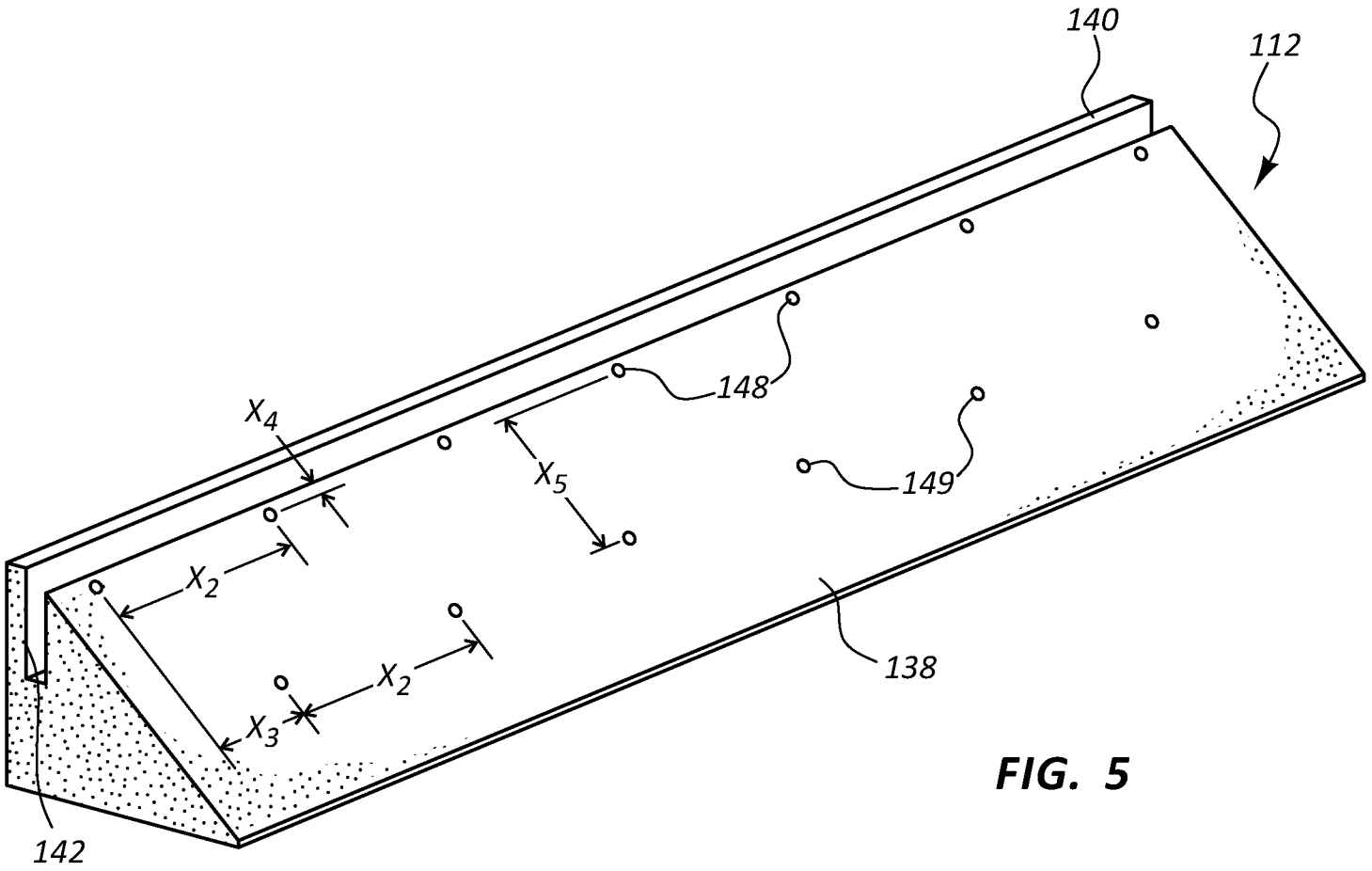
FIG. 5 is a perspective view of another cement form in accordance with the present disclosure.

FIG. 5 shows another example cement form 112 that includes a plurality of stake openings 148, 149. The stake openings 148, 149 are shown arranged in two rows along the length of the cement form 112. The stake openings 148, 149 are spaced apart a distance $X_2$ within each given row. The stake openings 148 may be offset from the stake openings 149 in the other row by a distance $X_3$. The stake openings 148 may be spaced from connector groove 142 a distance $X_4$. The rows of stake openings 148, 149 may be spaced apart a distance $X_5$. Each of the distances $X_2$, $X_3$, $X_4$, $X_5$ may be individually modified to provide a pattern or arrangement of stake openings 148, 149 on the cement form 112. Stake openings 148, 149 may also be positioned along a top surface 140 of the cement form 112. In other examples, additional or fewer rows and numbers of stake openings 148, 149 may be used.

The cement form 112 may be formed from any desired material. In at least some examples, the stake openings 144 are formed concurrently with forming the cement form 112 via, for example, a molding/forming process. In other examples, the stake openings 144 are formed in a separate step after the cement form 112 has been formed (e.g., using a drilling, cutting, stamping or other method for removing material to create the stake openings 144).

Figure 6:
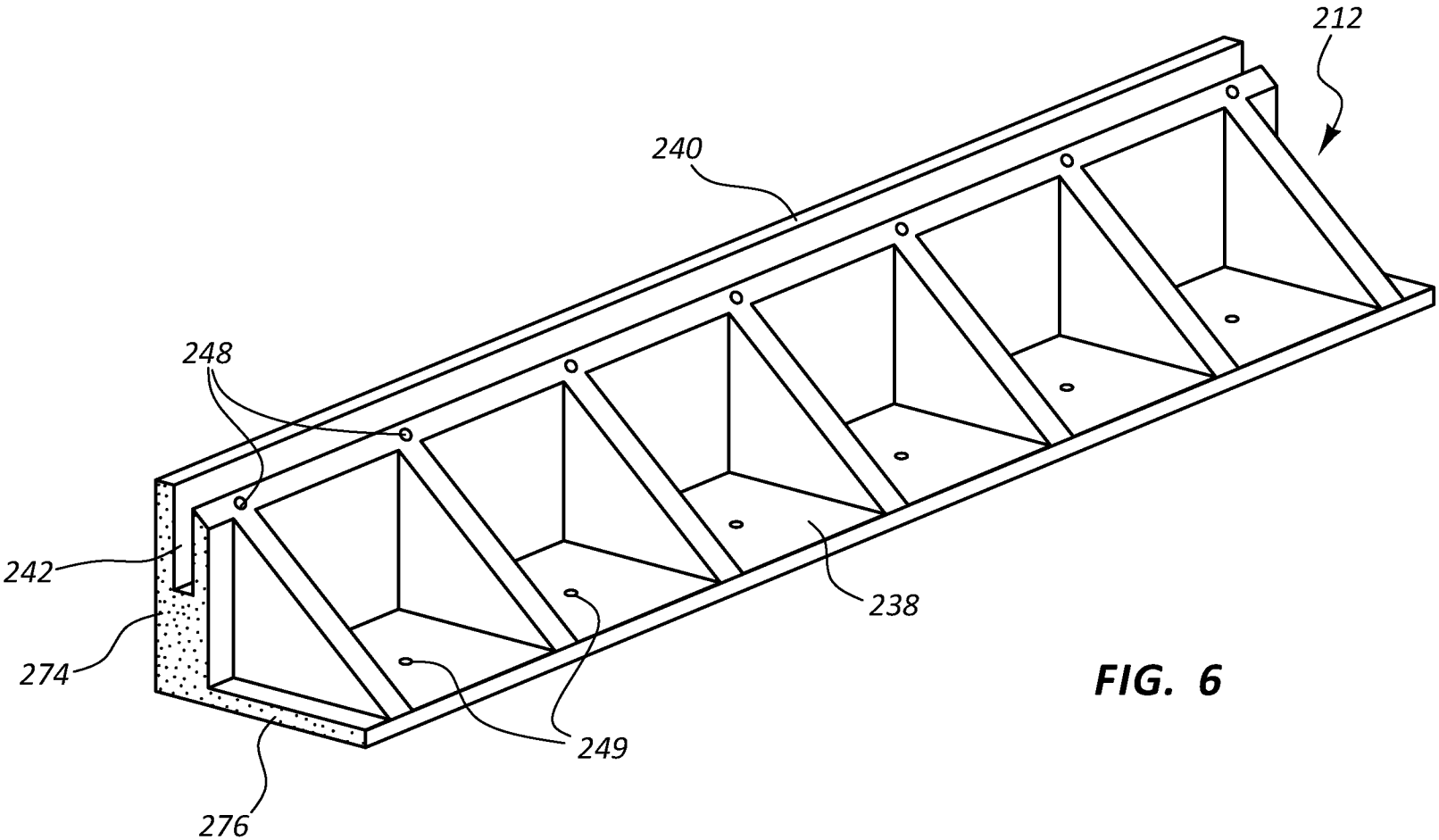
FIG. 6 is a perspective view of another cement form in accordance with the present disclosure.

FIG. 6 shows the cement form 212 embodiment that includes a plurality of support rib 250. The support ribs 250 may extend between a vertical portion 274 and a bottom or horizontal portion 276. A plurality of upper stake openings 248 may be included along an upper portion of the rib 250 or along a top surface 240 or other portion of the vertical portion 274. A plurality of lower stake openings 249 may be positioned along a weight-bearing surface 238 and/or other portion of the horizontal portion 276. Other stake openings 244 may be positioned along other portions of ribs 250 or at other locations on cement form 212. The cement form 212 may include any desired number, arrangement, size, orientation and the like associated with the stake openings 248, 249. Furthermore, a cement form 212 may include any desired number, shape, size and orientation for the ribs 250. In at least some embodiments, cement form 212 may be void of the connector groove 242 and the ribs 250 may extend to top surface 240.

Figure 7:
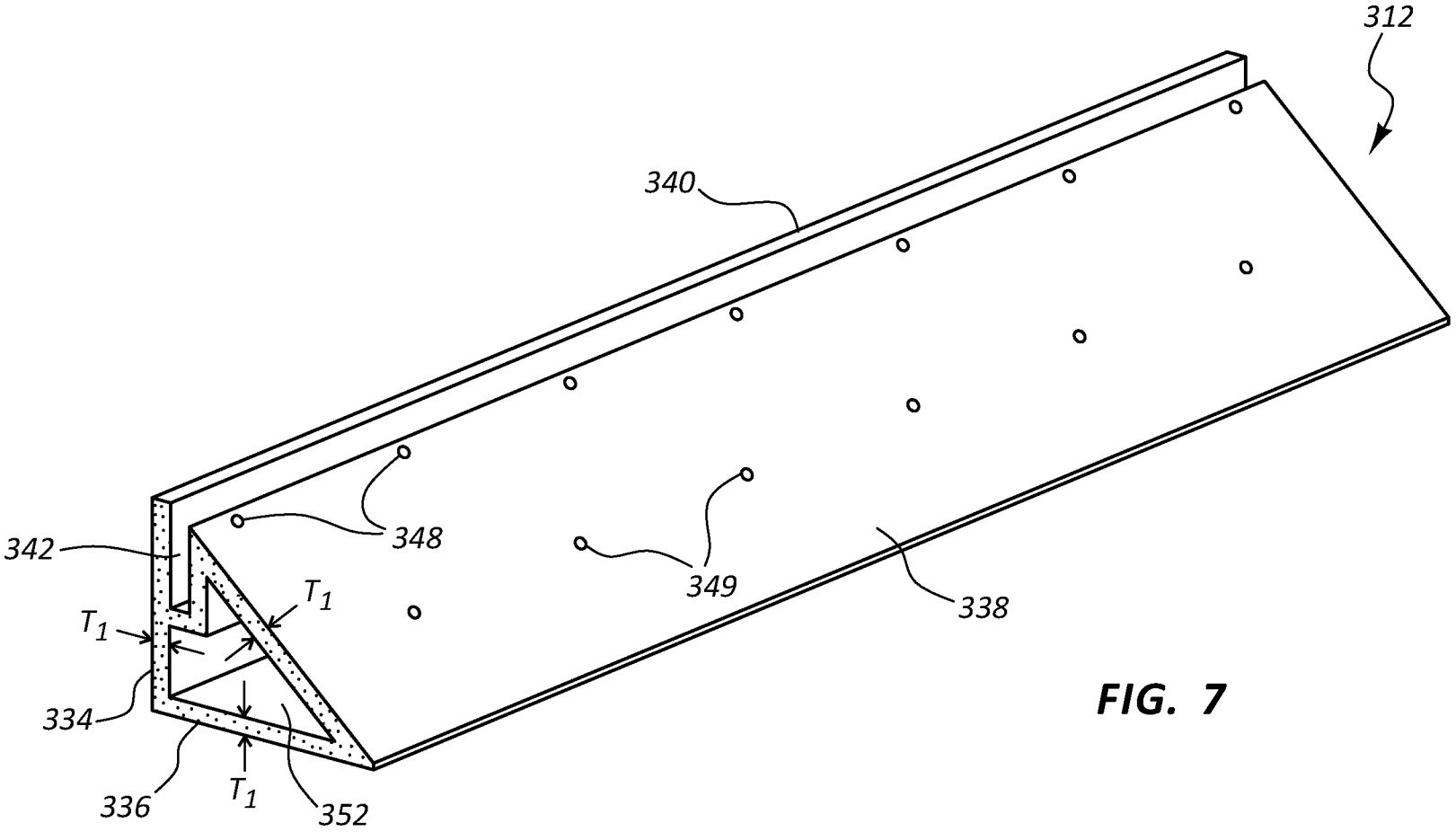
FIG. 7 is a perspective view of another cement form in accordance with the present disclosure.

FIG. 7 illustrates another example cement form 312 having a hollow interior 352. The hollow interior 352 may be formed during formation of the cement form 312 such as, for example, during a molding process. Alternatively, hollow interior 352 may be formed after the cement form 312 has been formed using, for example, a coring, cutting, stamping, drilling, or other material removing process. Cement form 312 may include a plurality of upper and lower stake openings 348, 349. The stake openings 348, 349 may extend through the weight-bearing surface 338 and the second surface 336.

Cement form 312 may also include a connector groove 342 and a first face 334. The hollow interior 352 may provide for a relatively constant wall thickness $T_1$ that define each of the first and second surfaces 334, 336 and the weight-bearing surface 338.

Cement form 312 is shown as a integrally formed, single piece. In other embodiments, cement form 312, along with other cement form embodiments disclosed herein, may comprise a plurality of parts that are separately formed and then later assembled together. In other embodiments, the cement form 312 may be formed as a wedge-shaped structure having a solid construction. In a later manufacturing step, portions of the wedge-shaped structure may be removed to form at least some of the features shown in FIG. 7. For example, the top surface 340 may be formed by cutting off a pointed edge of the wedge-shaped structure, the connector groove 342 may be formed by cutting out a portion of the solid structure, and the hollow interior 352 may be formed by removing an interior portion of the wedge-shaped structure. Many types of manufacturing processes and/or steps may be possible to form any one of the cement forms and associated cement form features disclosed herein.

Figure 8:
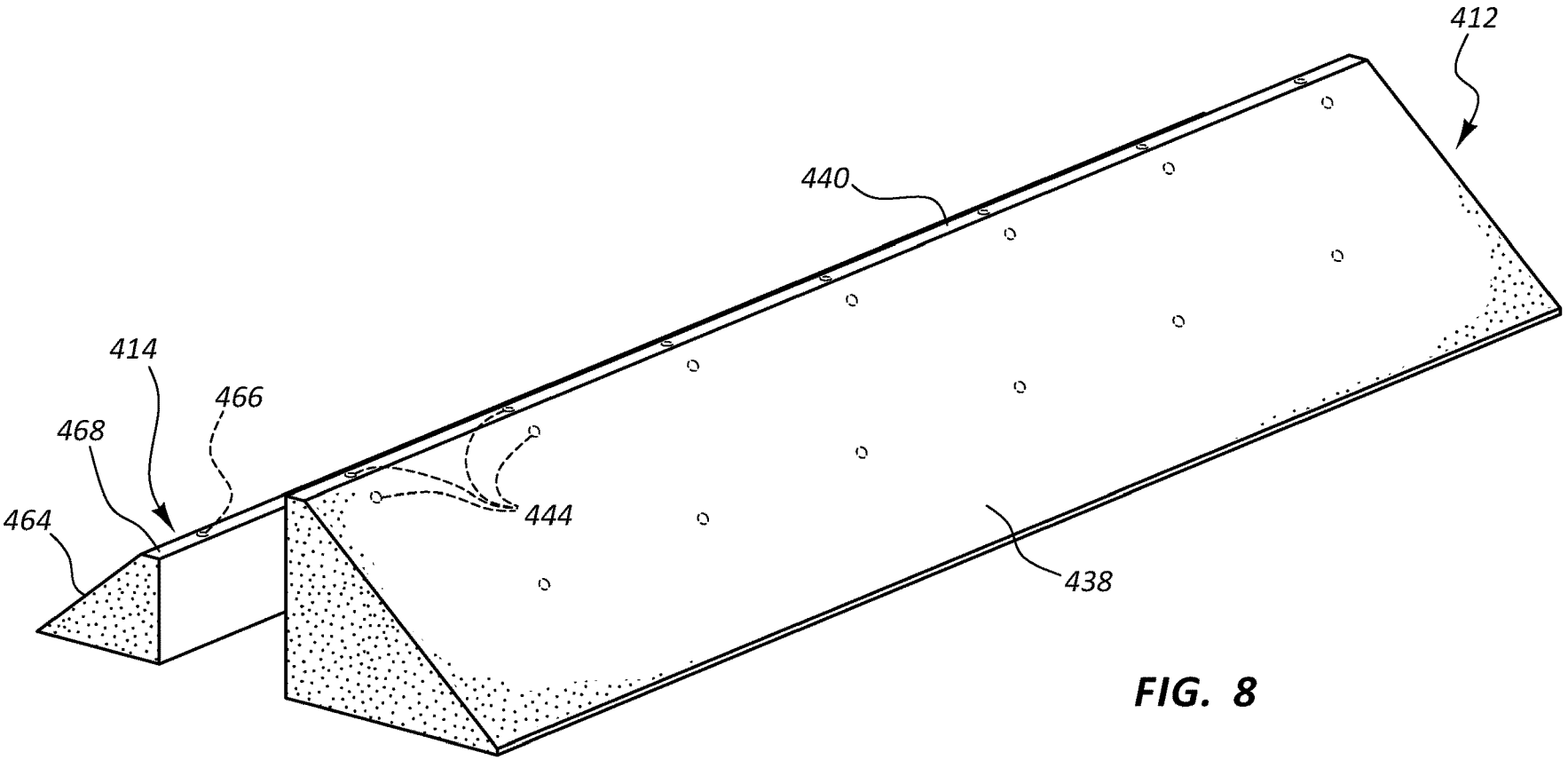
FIG. 8 is a perspective view of a cement form and inner insert in accordance with the present disclosure.

Referring to FIG. 8, another example cement form 412 and inner insert 414 are shown and described. The cement form 412 does not include a connector groove as shown in the embodiments of FIGS. 1-7. The cement forms 412 may be interconnected with adjacent cement forms using other structures and/or devices as opposed to the connecting members 16 described above with reference to FIGS. 1-4. For example, adjacent cement forms 412 may be connected to each other with clips or brackets that attach to the weight-bearing surfaces 438.

The cement form 412 and inner insert 414 may include a plurality of stake openings 444, 466, respectively. The cement form 412 may include a top surface 440, and the inner insert 414 may include a top surface 468. The stake openings may be formed in the top surfaces 440, 468. Alternatively, the stake openings 444, 466 may be formed on other surfaces such as, for example, the weight-bearing surface 438 and backfill support surface 464, respectively. The stake openings may be pre-formed or formed concurrently as stakes are driven through the cement form 412 and inner inserts 414 and into a ground support. The cement form 412 and inner insert 414 may comprise materials that permit such forming of the stake openings as the stakes are driven through the structure of the cement form 412 and inner insert 414.

The top surface 440 may provide a planer surface that provides an improved transition between cement form 412 and a top surface of a cement structure that is formed using the cement form 412. In at least some examples, the cement structure is created to be flush with the top surface 440. The inner insert 414 may include a top surface 468 to provide improved support of the resulting cement structure at the inner insert 414 as used to form and later support an underside surface of the cement structure. The top surface 468 may also provide improved ease of grading the backfill to the top edge of inner insert 414. Providing the top surface 468 as at least a partial planer surface may reduce the chance of damaging the top edge of the inner insert 414 during the grading process.

Figure 9A:
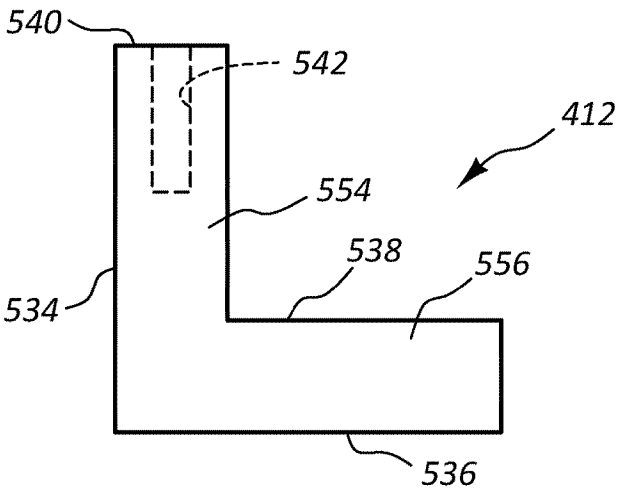
FIGS. 9A-9D are end views of further cement form embodiments in accordance with present disclosure.

FIGS. 9A-9D show alternative cross-sectional shapes for the cement forms disclosed herein. For example, FIG. 9A shows an L-shape having a vertical leg 554 and a horizontal leg 556. The vertical leg 554 defines a first surface 534 that supports the cement structure during pouring of the cement, and a top surface 540. A connector groove 542 may be formed in the top surface 540. The horizontal leg 556 may define the second surface 536 as well as a weight-bearing surface 538. The vertical and horizontal legs 554, 556 may have a substantially similar thickness, which may provide a constant R rating. The thicknesses of the vertical and horizontal legs 554, 556 may provide sufficient structural rigidity to support the poured concrete. The cement form 512 may include a plurality of stake openings that are formed in, for example, the top surface 540 or the weight-bearing surface 538.

Figure 9B:
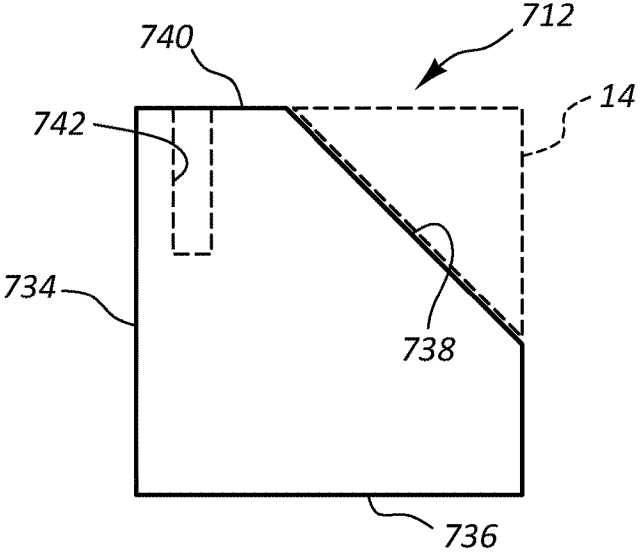

FIG. 9B shows a cement form 612 having a vertical leg 654 and a horizontal leg 656. A brace portion 658 may extend between the legs 554, 556 to provide additional support therebetween. The use of brace portion 658 may make it possible to have a reduced thickness for the vertical and horizontal legs 654, 656 because the brace portion 658 provides additional support and structural rigidity. The vertical leg 654 may define the first surface 634 and a top surface 640. A connector groove 642 may be formed along the top surface 640 or along any other desired portion of the cement form 612. The horizontal leg 656 may define the second surface 636 and the weight-bearing surface 638. A plurality of stake openings may be formed in, for example, the weight-bearing surface 638 and/or the top surface 640.

The brace portion 658 may extend in equal parts to the vertical leg 654 and the horizontal leg 656. In other examples, the brace portion 658 may have a non-uniform, non-symmetrical construction. The brace portion 658 may extend along an entire length of the cement form 612. In other embodiments, the brace portion 658 may be provided as rib features that extend along only portions of the length of the cement form 612.

Figure 9C:
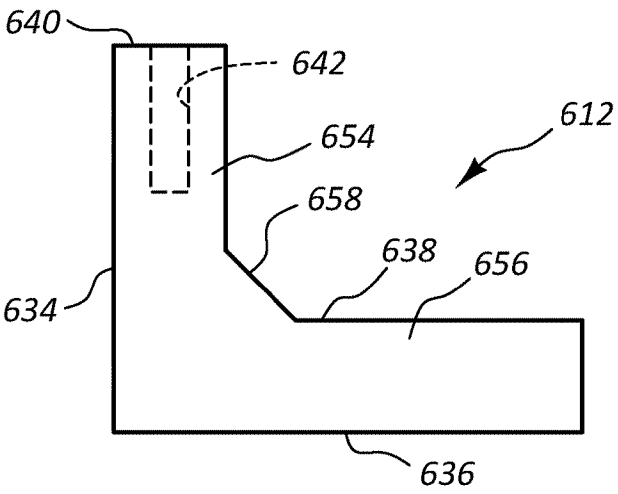

FIG. 9C illustrates a cement form embodiment 712 having a semi-wedge shaped construction and a semi-block shaped construction. In one example, the cement form 712 is formed from a block of material (e.g., foam material) that has a generally square shaped cross-section. A portion of the square shaped cross-section is removed. The removed portion may be the desired size for the inner insert 14.

Figure 9D:
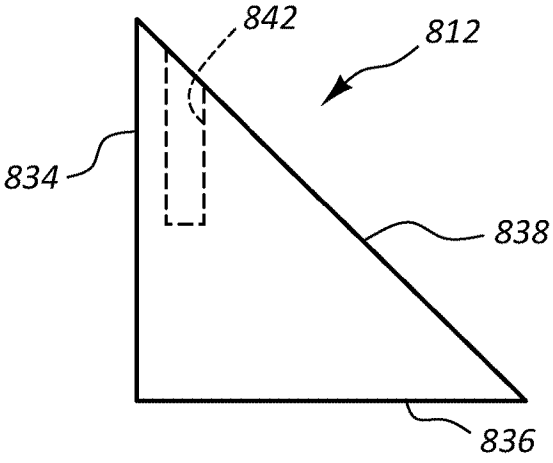

The cement form 712 has a greater thickness throughout that provides an improved R rating as compared to other embodiments such as the embodiments of FIGS. 9A, 9B and 9D. The construction of cement form 712 may provide for an improved structural rigidity, stability while pouring the cement, and the like. The increased thickness may make it possible to use less dense and/or less rigid materials for the cement form 712 while still achieving the desired function of serving as a cement form and an insulting material.

Cement form 712 may include first and second surfaces 734, 736 and a weight-bearing surface 738. A top surface 740 may extend along a top edge thereof. A connector groove 742 may be formed, for example, the top surface 740 and/or the weight-bearing surface 738. Cement form 712 may include a plurality of stake openings pre-formed therein. In at least some examples, cement form 712 may comprise of materials that permit concurrent forming of a stake opening as the stake is driven through the material of the cement form 712.

FIG. 9D illustrates another example cement form 812 that has a right angle, triangular shape with two legs having equal lengths. The generally symmetrical shape of cement form 812 may make it possible to form two cement forms 812 from a single block of material having a square cross-sectional shape, while maintaining equal lengths for each of the first and second surfaces 834, 836. A connector groove 842 may be formed in a weight-bearing surface 838. The cement form 812 may be void of a generally planer top surface as is included in other embodiments disclosed herein. Cement form 812 may include a plurality of pre-formed stake openings formed therein, or may comprise materials that permit concurrent formation of stake openings as stakes are driven through the material of cement form 812.

Many other triangular shapes are possible for the cement form 812 by modifying the relative lengths between surfaces 834 and 836. Maintaining a right angle relationship between surfaces 834, 836 may be a constant feature among all of the various triangular shapes that are possible. The triangular shape of the cement form 812 may provide improved stacking of cement forms for purposes of storage, shipping, etc. Providing cement forms 812 having mirrored shapes maximizes storage space and may provide compact, efficient storage and/or shipping. Other designs disclosed herein provide similar benefits including, for example, the cement form 712 and inner insert 14 shown in FIG. 9C.

Figure 10B:
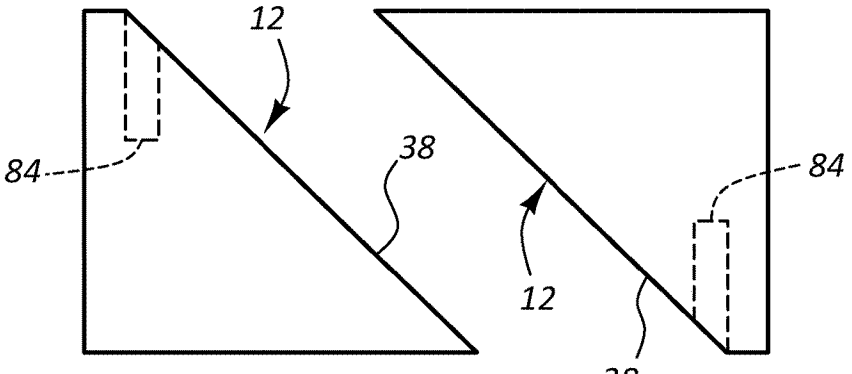
FIGS. 10A-10C show steps of forming a cement form in accordance with the present disclosure.
Figure 10C:
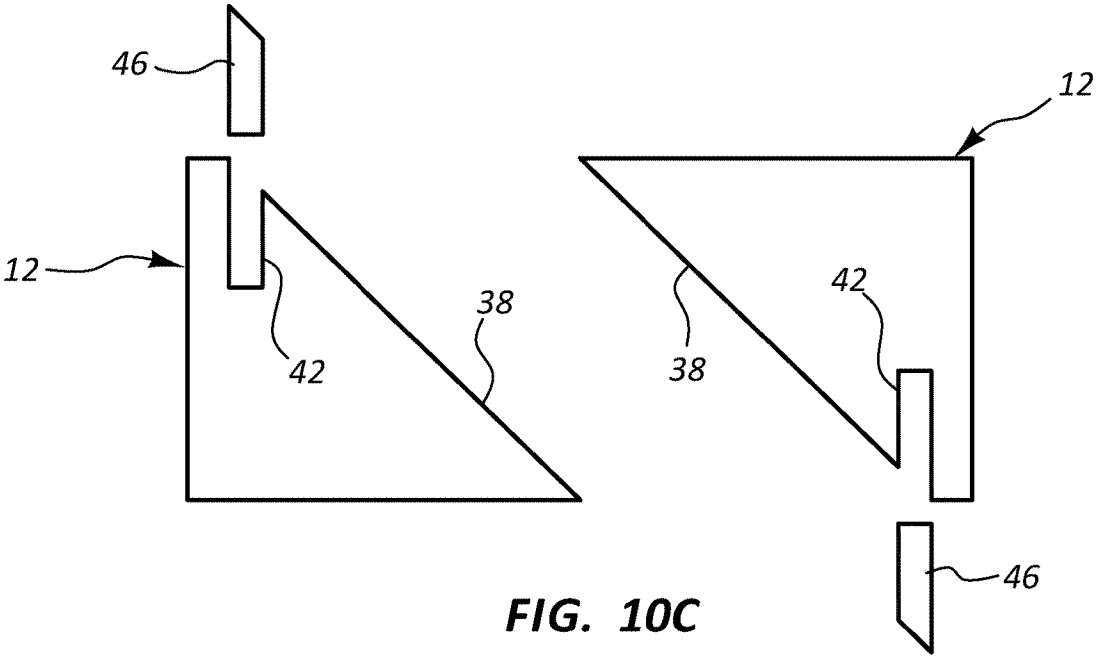
Figure 10A:
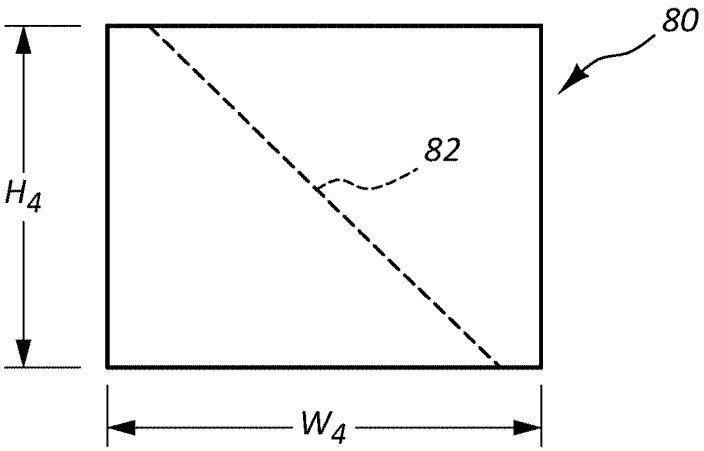

FIGS. 10A-10C show steps of manufacturing a pair of cement forms 12 in accordance with the present disclosure. FIG. 10A shows a block of material 80 having a rectangular cross-sectional shape. The rectangular shape having a slightly greater width W4 than height $H_4$ makes it possible to maintain equal dimensions for the resulting first and second surfaces 34, 36 of each cement form 12 while also providing a flat top surface 40 for each of the cement forms 12. Other embodiments may include use of a block of material 80 having a square shaped cross-section and provide the same or similar benefits.

FIG. 10A shows a cut line 82 that is used to cut the block in half to create two separate cement forms 12 as shown in FIG. 10B. After the cement forms 12 are separated, connector grooves 42 may be formed with cuts 84. FIG. 10C shows removable strips 46 taken from connector groove 42 as a result of cuts 84. The strip 46 may be removed to make room for a connecting member such as connecting member 16 described with reference to FIGS. 1-4. The strip 46 may be replaced in connector groove 42 after removing connecting member 16 (e.g., after the cement structure has been formed) so that the connecting members can be used with a different cement form assembly. The connecting members can be reused for different cement pouring projects and the strips 46 may be used to fill connector groove 42 to prevent unwanted objects from entering connector groove 42 and to help maintain a desired R value for cement form 12.

The forming method described with reference to FIGS. 10A-10C is particularly useful when the material of block 80 comprise a foam material such as those foam materials described herein. However, other materials may be used such as, for example, polymer materials or other insulating materials. Using just three cuts (cuts 82 and two cuts of 84), two separate cement forms may be formed from a single block of material and at relatively low manufacturing and material cost. In embodiments in which the cement forms 12 do not require a connector groove, a single cut 82 through block 80 may result in two completed cement forms 12 that are ready for use.

Figure 11:
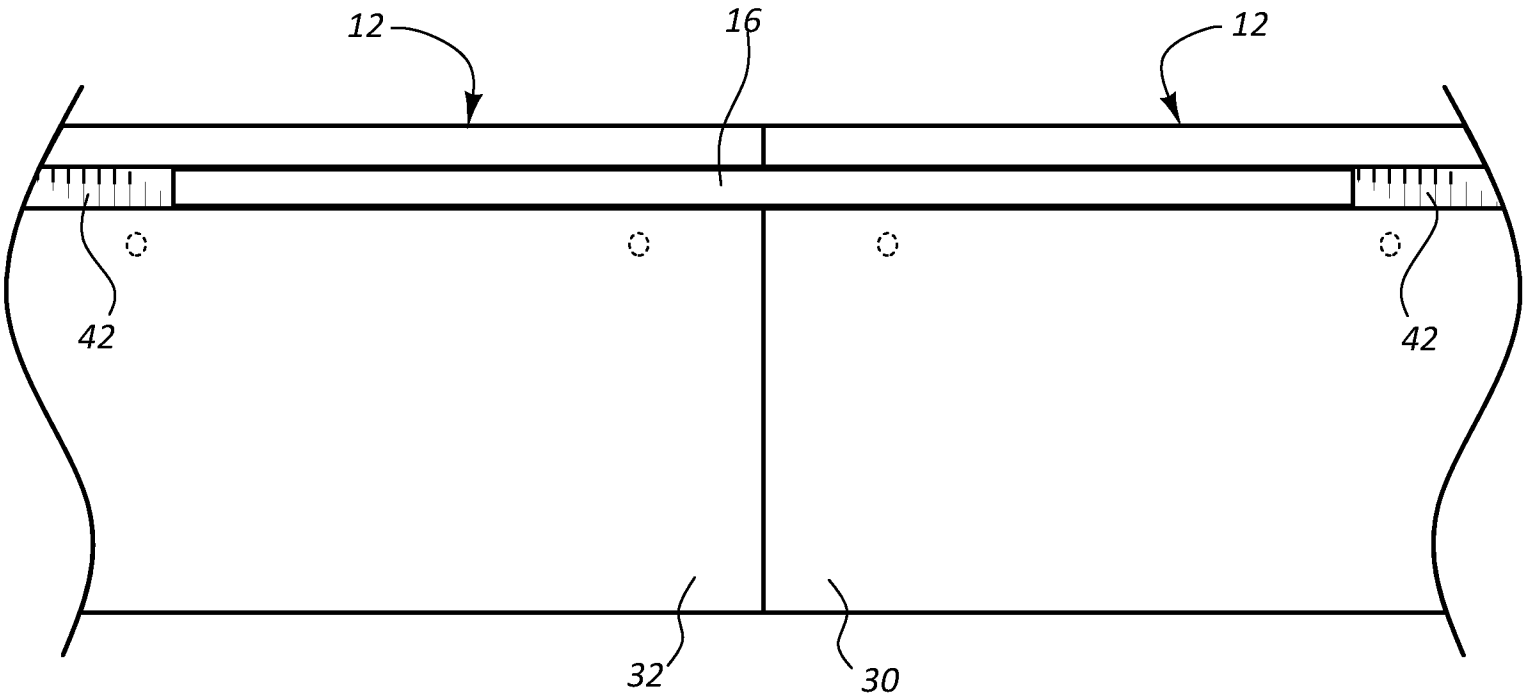
FIG. 11 is a top view of a pair of cement forms interconnected in accordance with the present disclosure.

FIG. 11 shows two cement forms 12 positioned end-to-end in a top view. A connecting member 16 is positioned within connector grooves 42 of the adjacent cement forms 12. The connecting member 16 spans the two cement forms 12. Typically, the cement forms 12 are positioned end-to-end in alignment with each other such that the connector grooves 42 are in alignment with each other. The connecting member 16 is then positioned within the connector groove 42.

A single connecting member 16 may span multiple cement forms 12 such as three or more cement forms. In some arrangements, the connecting member 16 has a length that is substantially the same as the length $L_1$ of cement form 12. Positioning a plurality of connecting members 16 end-to-end within the connector grooves of a plurality of aligned cement forms 12 may completely fill the connector grooves of all of the cement forms. In other examples, a relatively short cement form may be used within the connector groove 42 at or adjacent at the mating first and second ends 30, 32 of adjacent positioned cement forms 12 as shown in FIG. 11. The connector groove 42 may have a length that is customized for a particular length connecting member 16.

In other embodiments, the adjacent position cement forms 12 may be interconnected with different structured connecting members providing different functions. For example, the connecting members may include claws or barb features that grasp the material of the cement forms 12 without the need for a pre-forming groove or other apertures sized to receive the claw/barb features.

Figure 12A:
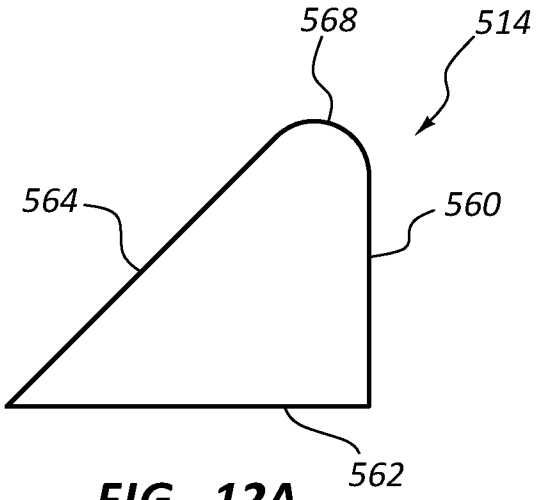
FIGS. 12A-12E are end views of inner insert embodiments in accordance with the present disclosure.

FIGS. 12A-12E illustrate alternative embodiments for inner inserts used with the cement form assemblies described herein. FIG. 12A shows an inner insert 514 having a wedge-shaped construction with a contoured top surface 568. The contoured upper edge (also referred to as a top surface 568) may provide a reduced stress point in the resultant cement structure that is supported by and/or formed around the inner insert 514. The top surface 568 may have any desired radius and may extend between the cement surface 560 and the backfill support surface 564. In some embodiments, other edges of the inner insert 514 may have curvature such as, for example, the edge formed at the intersection between ground support surface 562 and backfill support surface 564.

Figure 12B:
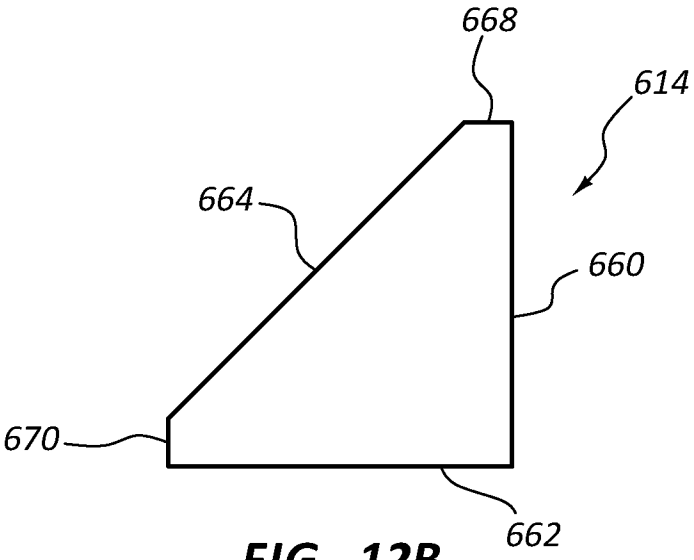

FIG. 12B shows an inner insert 614 having an upper surface 668 defined between the cement surface 660 and the backfill support surface 664, and a planer edge surface 670 defined between the ground support surface 662 and backfill support surface 664. Removing the pointed edges that are otherwise included in place of the surfaces 668, 670 may reduce the propensity of the sharp edges to break off or be deformed/damaged during manufacture, shipping, storage and installation of a cement form assembly at a construction site.

Figure 12C:
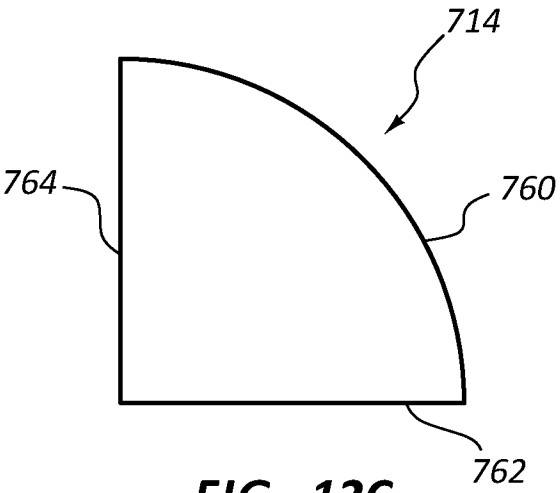

FIG. 12C shows an inner insert 714 having a contoured shape for the cement surface 760. The contoured shape of cement surface 760 may reduce the incidence of stress concentration points at the inner/lower surface of the cement structure (e.g., monolithic foundation). The inner insert 714 may have any desired shape and size for the cement surface 760, including a contoured portion, a combination of linear and contoured portions, and the like. In some embodiments, the backfill support surface 764 may be arranged at a non-vertical orientation thereby reducing the amount of material needed for the inner insert 714. Typically, the ground support surface 762 remains flat or planer to provide a desired interface with the ground support.

Figure 12D:
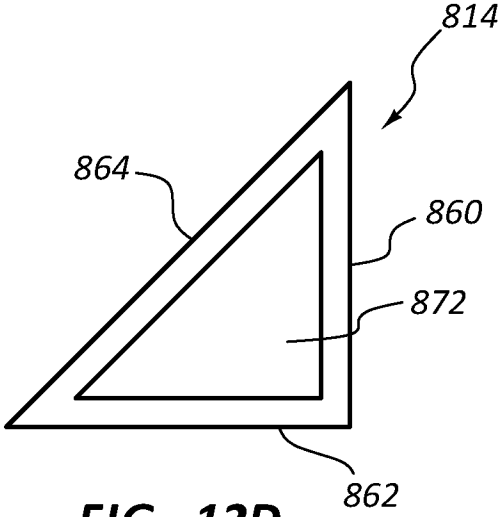

FIG. 12D shows an inner insert 814 having a hollow interior 872. The hollow interior may be formed concurrently with formation of the remaining portions of the inner insert 814. Alternatively, the hollow interior 872 may be formed after formation of the inner insert 814 structure. A boring, cutting, stamping, or other manufacturing step may be used to create the hollow interior 872.

The resulting sidewalls of the inner insert 814 may have a generally constant thickness associated with the cement surface 860, ground support surface 862 and backfill support surface 864. The hollow interior feature may be used in any of the inner insert embodiments shown with reference to FIGS. 12A-12E and other embodiments possible in accordance with the present disclosure. In some arrangements, the hollow interior 872 mirrors the outer peripheral shape cross-sectional shape of the inner insert 814. In other embodiments, the hollow interior may have a shape that is different from the perimeter shape such as, for example, a generally circular shape interior 872 used with the triangular shape outer periphery of inner insert 814.

Figure 12E:
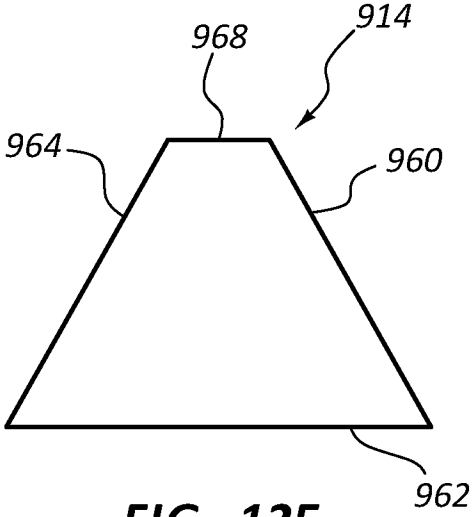

FIG. 12E shows an inner insert embodiment 914 having an equilateral triangular shape with a truncated upper corner of the triangle. The truncated upper portion defines a top surface 968. A top surface 968 may provide the desired improved grading to the top of the inner insert 914 with reduced chance of damaging the top surface 968. The tapered shape of cement surface 960 may provide improved strength and limited stress concentration along the inner, bottom surface of the cement structure (e.g., monolithic foundation). The ground support surface 962 has a generally planer construction. The backfill support surface 964 may mirror the tapered or angled orientation of the cement surface 960. Other variations of the wedge-shaped, triangular-shaped construction of the inner insert 914 are possible wherein different lengths, angled orientations, truncation locations, and the like are provided.

Figure 13:
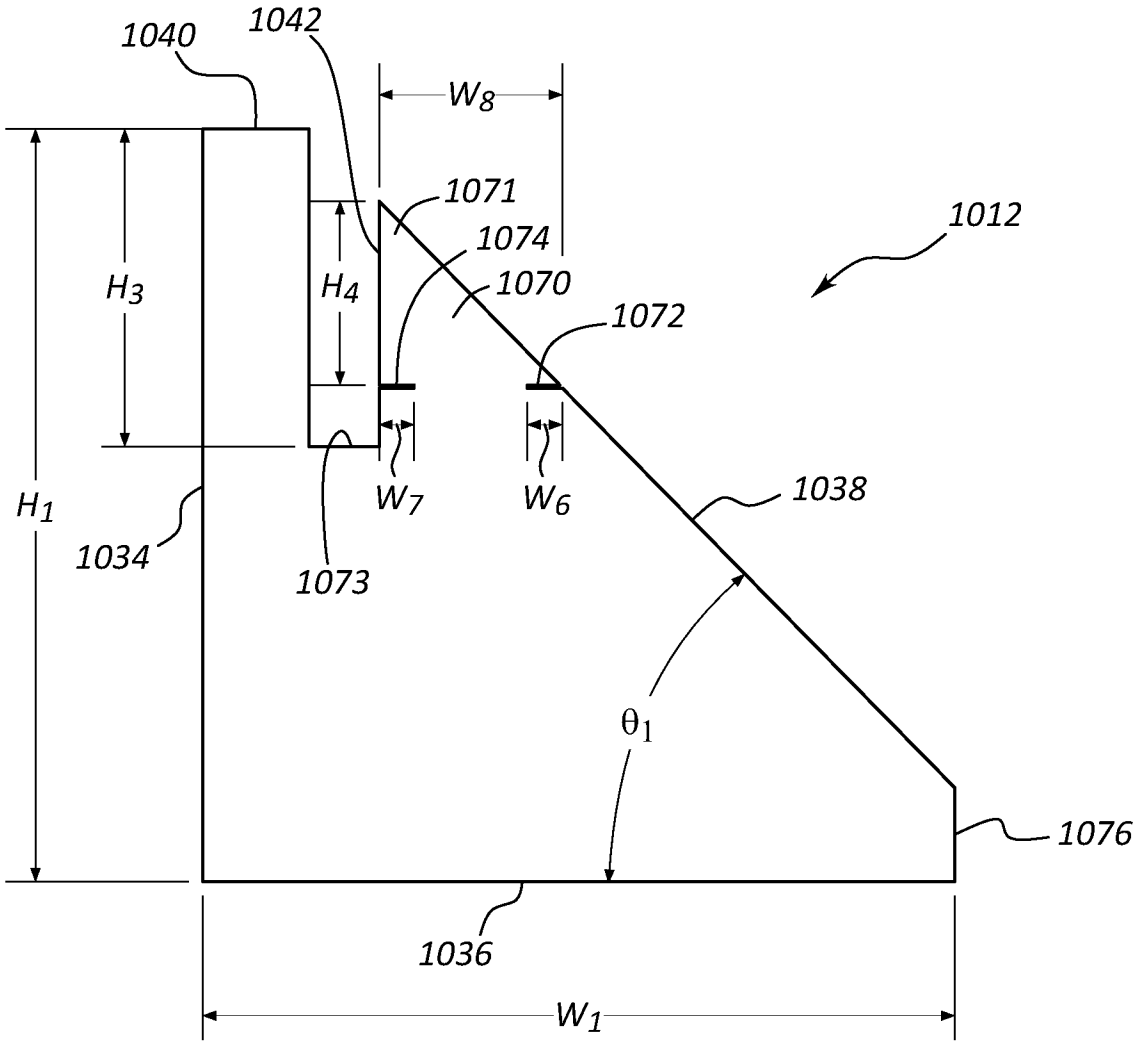
FIG. 13 is an end view of another cement form with a breakaway portion in accordance with the present disclosure.

FIG. 13 is an end view of another example cement form 1012. The cement form 1012 includes a first surface 1034, a second surface 1036, and a weight-bearing surface 1038. The cement form 1012 may also include a top surface 1040 and a connector groove 1042. The cement form 1012 may include a detachable portion 1070. A pair of relief cuts 1072, 1074 may define at least in part the detachable portion 1070. The detachable portion 1070 may also be referred to as a detachable tip portion 1070.

The detachable portion 1070 may have a height $H_4$ and a width $W_8$ as shown in FIG. 13. The relief cuts 1072, 1074 may have widths $W_6$, $W_7$, respectively. The detachable portion 1070 may extend along an entire length of the cement form 1012. In at least some examples, each of the relief cuts 1072, 1074 may also extend along an entire length of the cement form 1012, or at least along an entire length of the detachable portion 1070. The relief cuts 1072, 1074 may have different shapes, sizes, and orientations than those shown in FIG. 13. The widths $W_6$, $W_7$ may be increased to facilitate easier disconnection of detachable portion 1070. In some embodiments, only a single one of the relief cuts 1072, 1074 may be included. At least one of the relief cuts 1072, 1074 may be positioned and/or accessible within the connector groove 1042.

The detachable portion 1070 may be positioned adjacent to the connector groove 1042. The detachable portion 1070 may include a pointed structure or tip 1071. By removing the detachable portion 1070, more of the connector groove 1042 may be exposed. In at least some embodiments, once the detachable portion 1070 is removed, the connector groove 1042 may be less suitable for retaining the strip or insert 46 after removal of the connecting member 16 as described above with reference to FIGS. 1-4.

Removing the detachable portion 1070 may provide certain advantages when using the cement form 1012 as part of forming a cement structure, such as a monolithic building foundation. Maintaining connection of the detachable portion to the remainder of the cement form 1012 prior to and during formation of the cement structure may provide additional stability and connectivity between the plurality of cement forms used to form the cement structure. For example, the detachable portion 1070 may provide a more secure connection of a connecting member 16 that is inserted into the connector groove 1042 to provide improved interconnection of adjacent positioned cement forms. Once the cement structure is formed and the connector is removed from the connector groove 1042, the detachable portion 1070 may be removed. By removing the detachable portion 1070, backfill dirt may be filled along the weight-bearing surface 1038 at a lower height as compared to the embodiment of FIGS. 1-4 while still covering all of the cement form 1012 except that portion in contact with the cement structure. When the same amount of backfill is used to cover the cement form 1012 as in the embodiment shown in FIGS. 1-4, there is a greater depth of backfill all the way up to that portion of the cement form 1012 that is contacting the cement structure. This increased depth of backfill, particularly when the backfill is topsoil, may be advantageous for growing vegetation. When the cement form does not include a detachable portion adjacent to the connector groove 1042 or a similar location towards a top end of the cement form 1012, back fill dirt must be filled to a greater height in order to cover all of the weight-bearing surface 1038. Removing the detachable portion 1070 may result in little negative impact on the R value provided by the cement form.

The cement form 1012 may also include a truncated portion 1076 positioned at the intersection between surfaces 1036, 1038. The truncated portion 1076 may provide several advantages. For example, the truncated portion 1076 removes an otherwise pointed tip structure or portion of the cement form 1012. Pointed tip features, particularly those arranged along a bottom edge of the cement form, are easily damaged and/or broken off during manufacture, shipment, storage and use. By truncating the intersection between surfaces 1036, 1038, the chance of damage and/or breaking off of small portions of the cement form 1012 is reduced or eliminated. Further, removing the otherwise pointed tip along the bottom edge 1036 may reduce the amount of material needed for the cement form 1012. Reducing the amount of needed material can reduce the cost associated with manufacturing cement form 1012. Furthermore, removing the pointed tip and replacing it with the truncated portion 1076 may also reduce the total amount of space needed to ship and store the cement form 1012.

The cement form 1012 may include a weight-bearing surface 1038 that is arranged at an angle $\theta_1$ relative to the surface 1036. The angle $\theta_1$ may be in the range of, for example, about 20° to about 70°, and more particularly in a range of about 40° to about 50°. The smaller the angle $\theta_1$, the greater amount of downward applied force the backfill materials may apply to the weight-bearing surface 1038, which may otherwise assist in holding the cement form 1012 in place during setup of the cement form assembly and creating the cement structure. However, the greater the angle $\theta_1$, the less backfill required to cover the weight-bearing surface 1038.

The widths $W_6$ and $W_7$ of the relief cuts 1072, 1074 may be in the range of, for example, about 0.5 inch to about 3 inch, and more particularly in the range of about 0.5 inch to about 1 inch. The size of relief cuts 1072, 1074 may vary depending on, for example, the total width $W_1$ of the cement form 1012, the angle $\theta_1$ of the weight-bearing surface 1038, the height $H_1$ of the cement form 1012, and other features thereof. Similarly, the height $H_4$ of the detachable portion 1070 may be dependent on the same features, dimensions, etc. of the cement form 1012. Typically, the height $H_4$ is less than the height $H_3$ of the connector groove 1042. In at least some embodiments, the height $H_4$ is at least in the range of about 0.5" to about 3" less than the height $H_3$ such that the connector groove 1042 is capable of retaining the piece 46 even after removal of the detachable portion 1070. In other embodiments, the relief cut 1074 is positioned below the bottom surface of the connector groove 1042 such that the entirety of the connector groove 1042 is exposed after removal of the detachable portion 1070.

Figure 14:
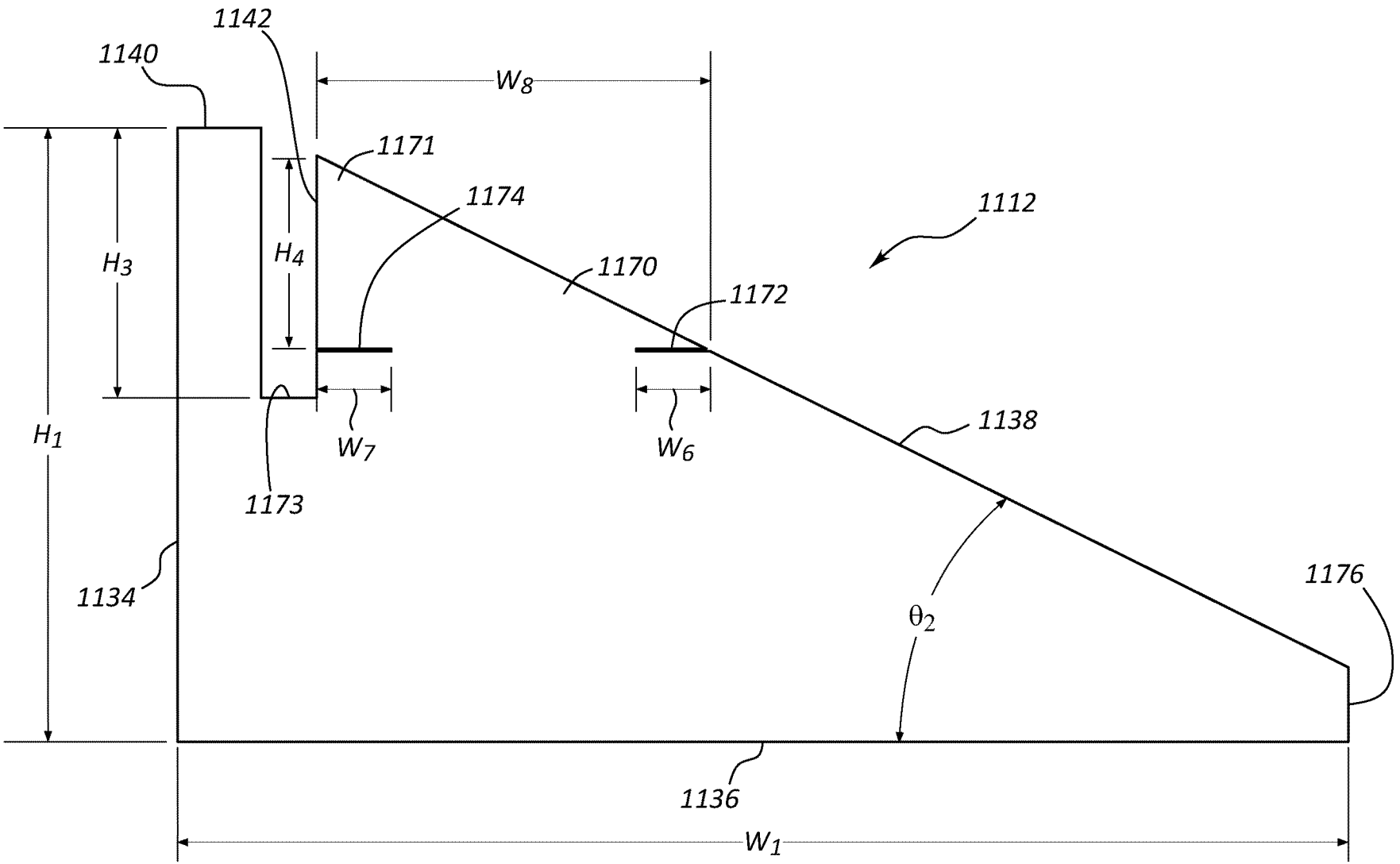
FIG. 14 is an end view of another cement form with a breakaway portion in accordance with the present disclosure.
Figure 15:
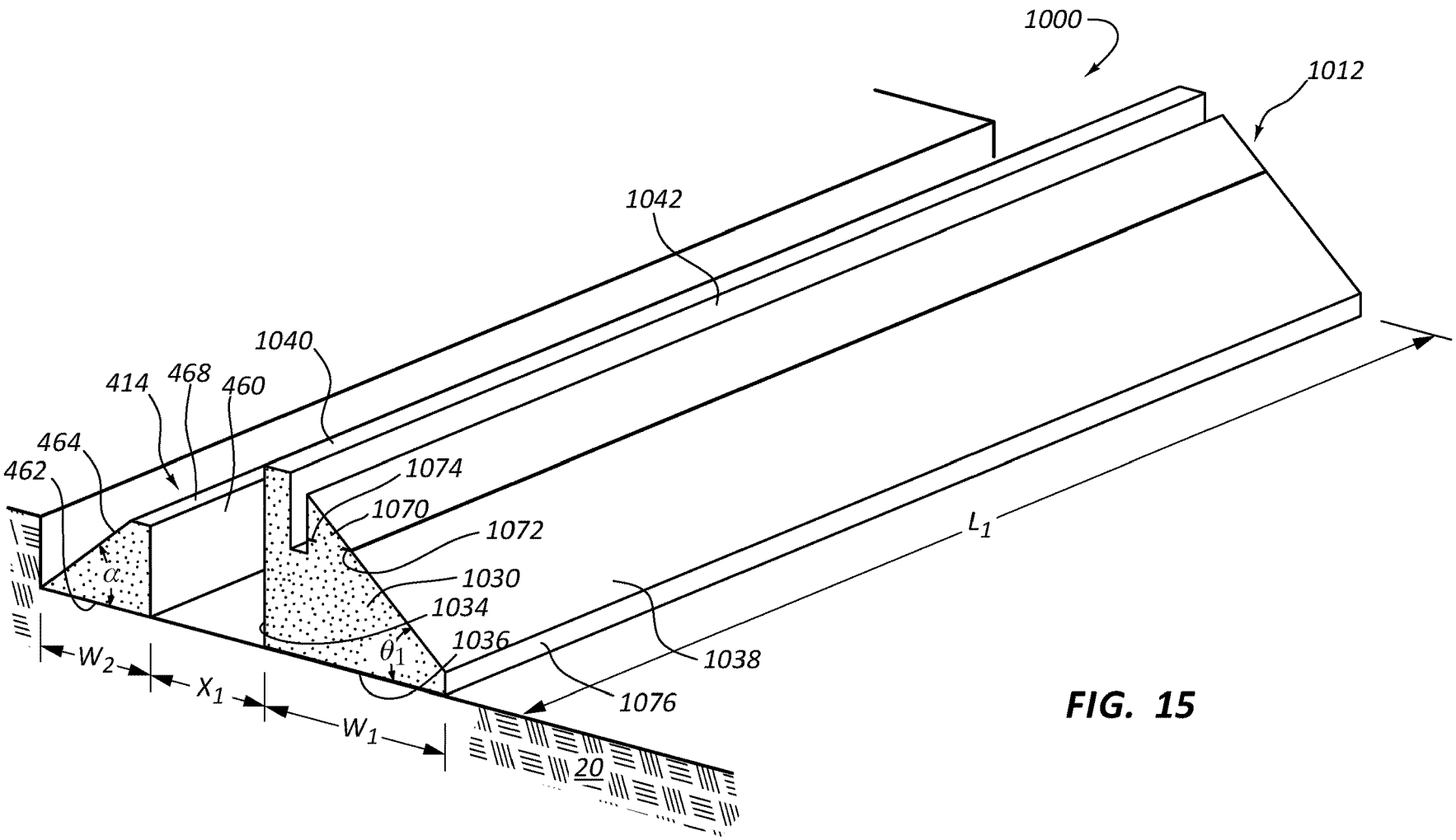
FIG. 15 is a perspective view of a cement form assembly that includes the cement form shown in FIG. 13 and the inner insert shown in FIG. 8 in accordance with the present disclosure.

Referring now to FIG. 14, another example cement form 1112 is shown and described. The cement form 1112 includes first and second surfaces 1134, 1136, a weight-bearing surface 1138, a top surface 1140, a connector groove 1142, and a detachable portion 1170. Cement form 1112 may also include relief cuts 1172, 1174 that define at least in part the detachable portion 1170. The relief cuts 1172, 1174 may have widths $W_6$ and $W_7$, respectively. The relief cut 1172 may be formed along the weight-bearing surface 1138. The relief cut 1174 may be formed along an inner surface of the connector groove 1142. The detachable portion 1170 and relief cuts 1172, 1174, may extend along an entire length of the cement form 1112 (e.g., length $L_1$ shown in FIG. 1).

The cement form 1112 may have a different cross-sectional shape and related dimensions as compared to the other cement forms disclosed herein. For example, the surface 1136 and surface 1138 may be arranged at an angle $\theta_2$ that has a lower value than the angle $\theta_1$ for the cement form 1012. The angle $\theta_2$ may be in the range of, for example, about 15° to about 40°, and more preferably in the range of about 20° to about 30°. The smaller angle $\theta_2$ for the arrangement between surfaces 1136, 1138 may result in a longer weight-bearing surface 1138 when the height $H_1$ remains the same. This longer weight-bearing surface 1138 may provide increased surface area for backfill to be positioned upon, thereby applying a greater downward force that may improve maintaining the cement form 1112 in a fixed position prior to and during formation of a cement structure. Further, the detachable portion 1170 may have a greater cross-sectional area because of the increased length of the weight-bearing surface 1138 when the height $H_4$ remains the same.

The cement form 1112 may also include a truncated portion 1176. The truncated portion 1176 may have the same or similar advantages as the truncated portion 1076 discussed above with referenced to FIG. 13.

The detachable portions 1070, 1170 shown in FIGS. 13 and 14 may be sized, shaped or otherwise formed as part of the respective cement forms 1012, 1112 to be removable with or without the relief cuts 1072, 1074 and 1172, 1174, respectively. In some examples, only a single relief cut is provided for each of the detachable portions 1070, 1170. In other examples, a single relief cut may extend a greater distance across a total width $W_8$ of the detachable portion. The relief cuts may be formed by cutting the material of the cement forms 1012, 1112. In other examples, the relief cuts or similar relief features may be formed in the cement form during formation of the cement forms (e.g., during a casting or molding process). The relief cuts may have a generally linear shape as shown in FIGS. 13 and 14. In other embodiments, the relief cuts may have a tapered or wedge-shaped cross-section that may help facilitate detachment of the detachable portions 1070, 1170. In still further embodiments, the relief cuts may be formed along only portions of the entire length of the cement form such as in 2 to 10 segments along the length. The distance $H_4$ from the relief cuts 1074, 1174 to the upper tip 1071, 1171 of the detachable portion 1170 may vary depending on a number of criteria. Typically, the relief cuts 1074, 1174 are position no further vertically from the upper tip 1071, 1171 than a base surface 1073, 1173 of the connector groove 1042, 1142. In some embodiments, the relief cuts 1074, 1174 be positioned downward beyond the base surfaces 1073, 1173. The cement forms 1012, 1112 may have a generally L-shaped cross-sectional shape after removal of the detachable portions 1070, 1170 depending on the shape and size of the detachable portions 1070, 1170.

Generally, the cement forms 1012, 1112 may be non-symmetrical or include cross-sectional shapes that are non-symmetrical. In particular, the cement form 1012 may have a greater height $H_1$ as compared to its width $W_1$. The cement form 1112 may have a greater width $W_1$ than its height $H_1$. In some embodiments, the truncated portions 1076, 1176 may be formed to make an otherwise relatively symmetrical cross-sectional shape for the cement form into a relatively non-symmetrical shape.

Referring now to FIGS. 15-19, the cement form 1012 is shown as part of a cement form assembly 1000. The cement form assembly 1000 may be used to form a cement structure, such as a monolithic building foundation. The cement form 1012 is shown in use with an inner insert 414, which is described in further detail above with reference to FIG. 8.

When preparing the cement form assembly 1000 for use in creating a monolithic building foundation, a ground support 20 is graded to a level surface. The inner insert 414 is positioned inward of the cement form 1012 a distance $X_1$.

Figure 16:
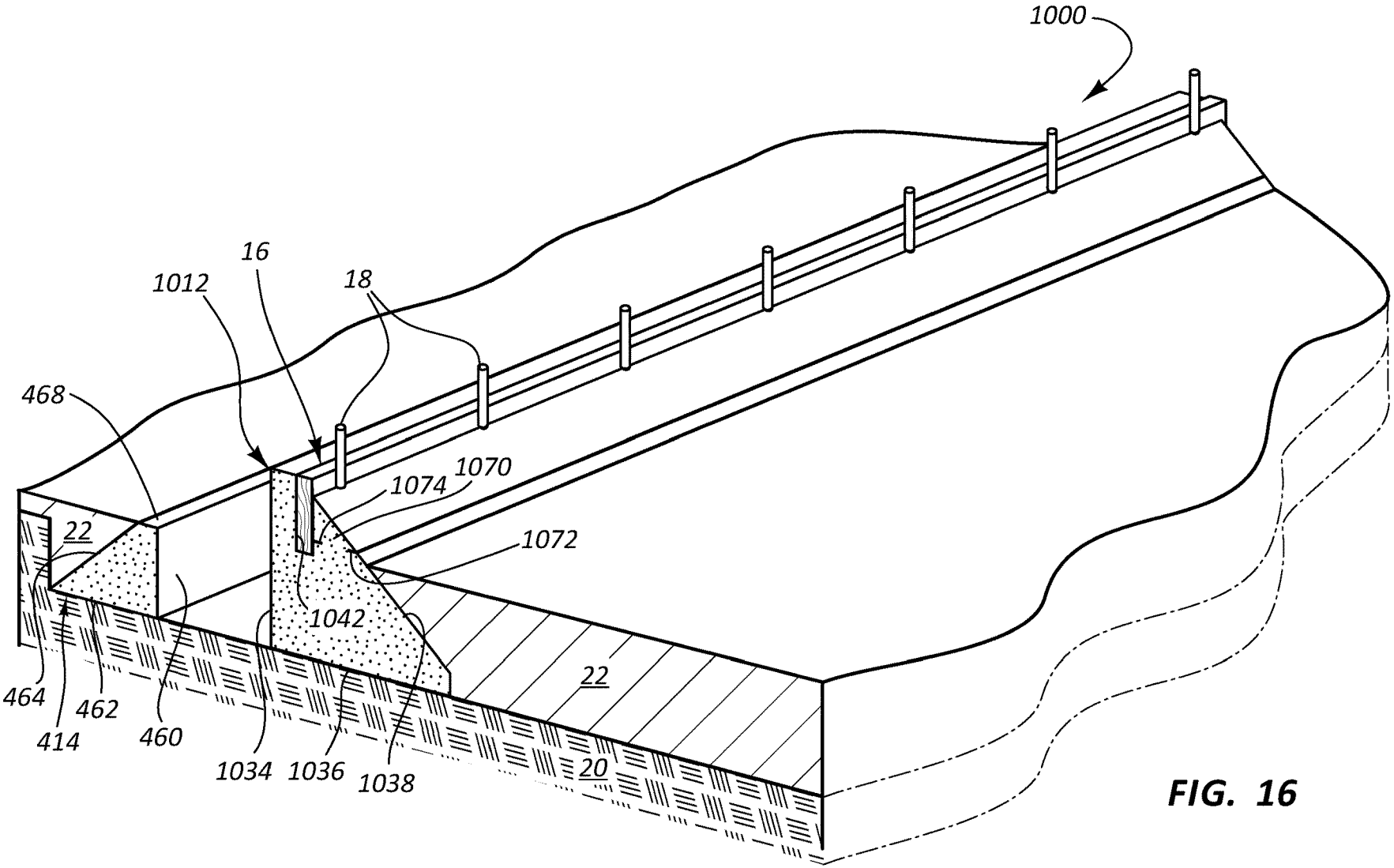
FIG. 16 is a perspective view of the cement form assembly shown in FIG. 15 with connecting members inserted.

FIG. 16 shows the cement form 1012 held in place with a plurality of stakes 18 that are driven through the material of the cement form 1012. In some embodiments, the cement form 1012 includes a plurality of pre-formed holes (not shown) that are receptive of the stakes In some embodiments, the stakes 18 may be driven through the detachable portion 1070. In other examples, the stakes 18 may be driven through other portions of the cement form 1012 instead of the detachable portion 1070. Backfill 22 may be positioned over portions of the weight-bearing surface 1038 and a backfill support surface 464 of the inner insert 414. Further, a plurality of connecting members 16 may be positioned in a connector groove 1042 of the cement form 1012 to align and connect together adjacent positioned cement forms 1012.

Figure 17:
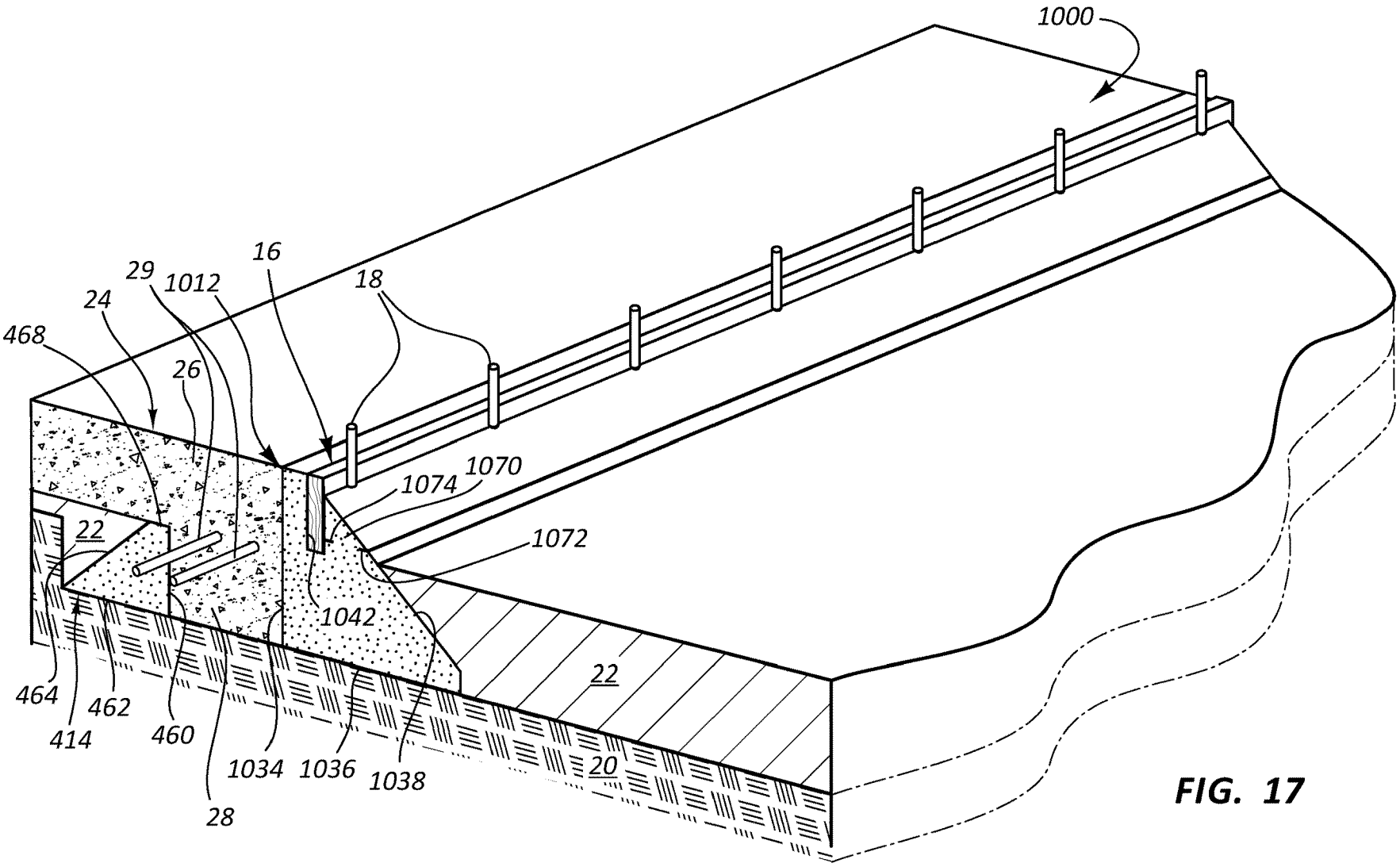
FIG. 17 is a perspective view of the cement form assembly of FIG. 16 in use to form a monolithic foundation.

FIG. 17 shows the cement structure 24 formed by pouring cement into the space between the inner insert 414 and the cement form 1012. Portions of the cement structure may extend across the top of the inner insert. Rebar members 29 may be positioned in the cement structure 24. The cement structure 24 may be referred to as a foundation that includes a slab portion 26 and a footing portion 28. The use of the inner insert 414 reduces the amount of cement that is required to form the foundation 24, particularly in the area where the slab portion 26 and footing portion 28 intersect.

Figure 18:
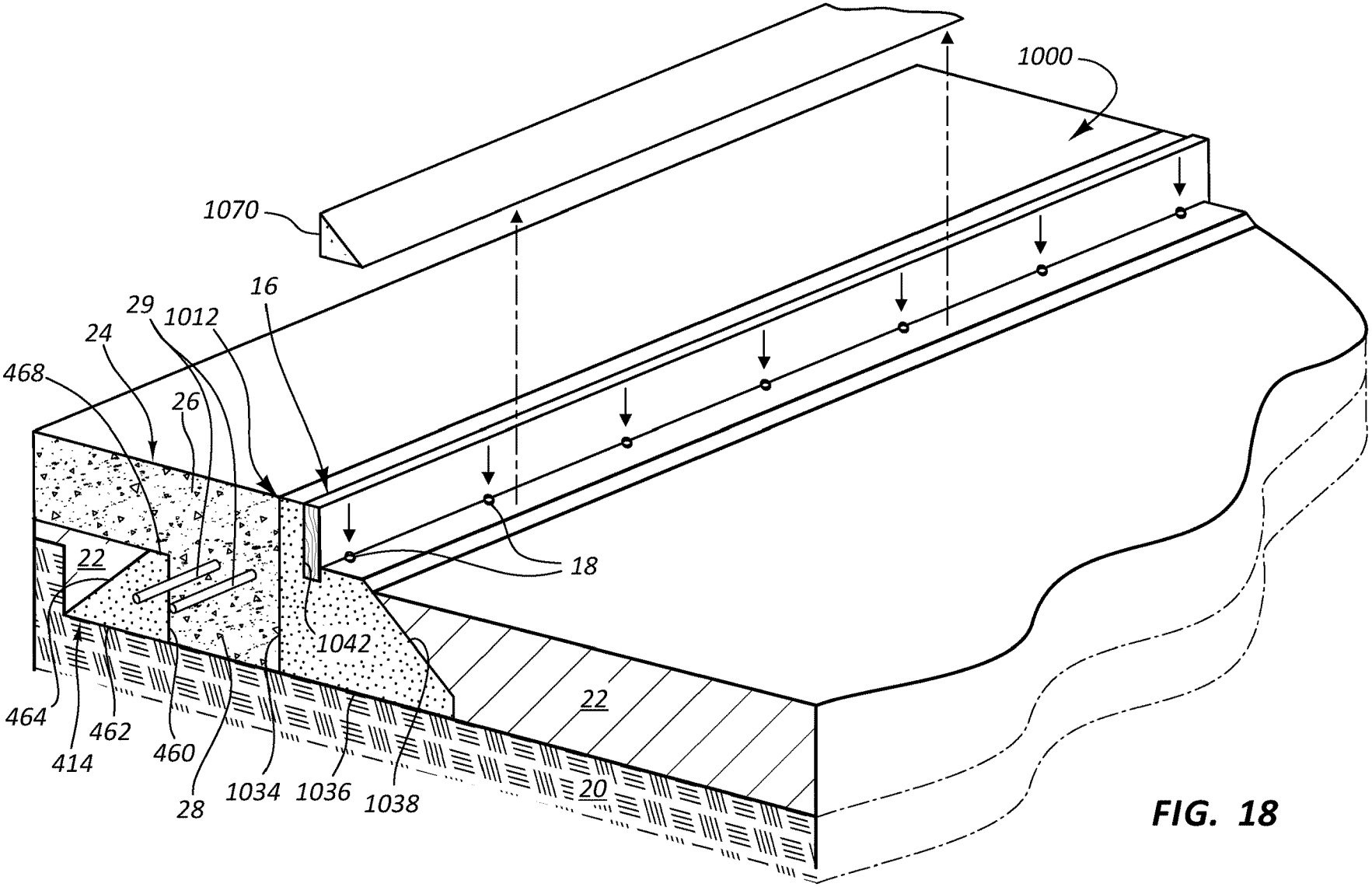
FIG. 18 is a perspective view of the cement form assembly shown in FIG. 17 with connecting members removed and the breakaway portion removed.
Figure 19:
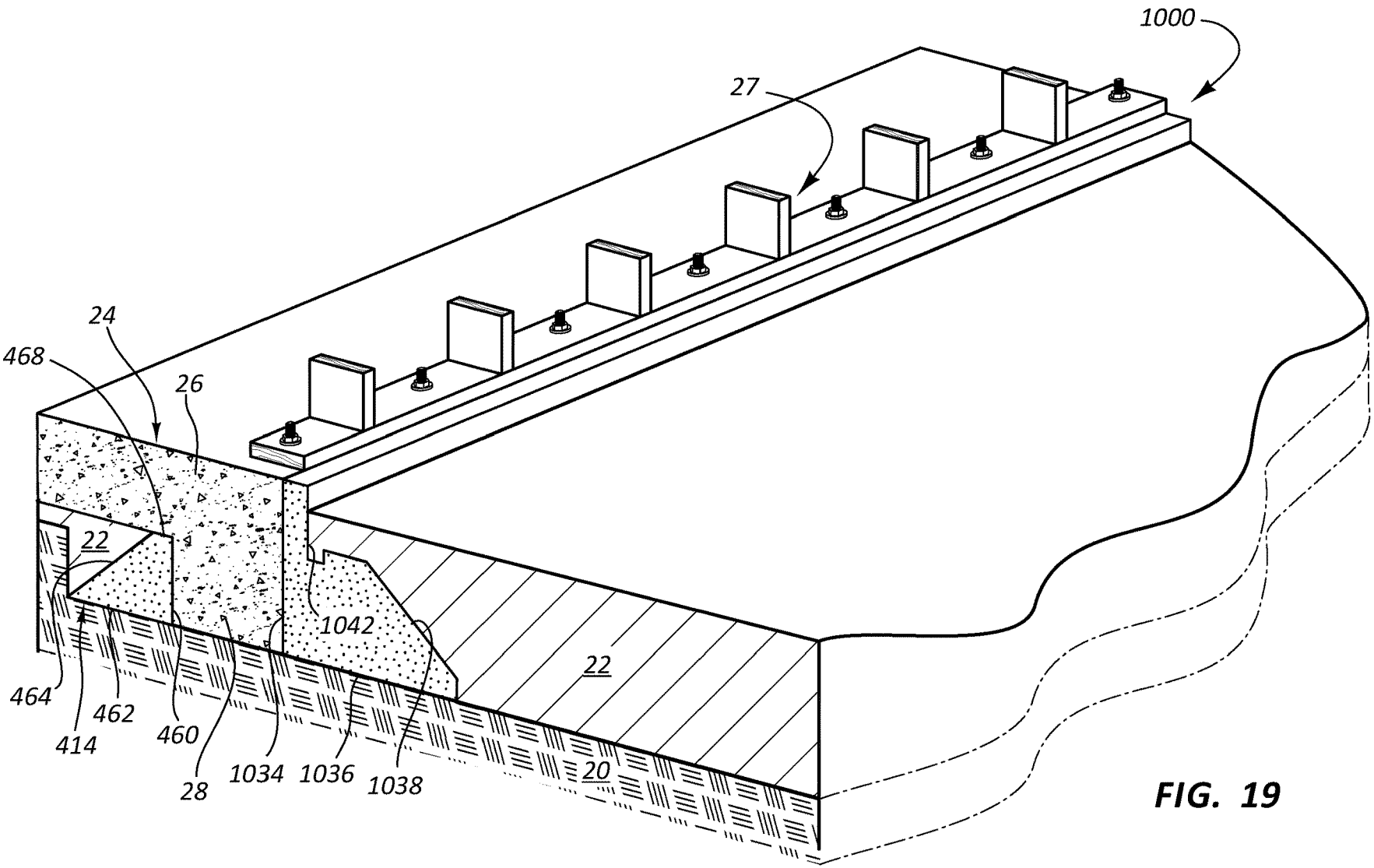
FIG. 19 is a perspective view of the cement form assembly shown in FIG. 18 with additional backfill covering the cement form a structure supported on the foundation.

After the foundation 24 has been poured, the connecting members 16 may be removed. The detachable portion 1070 may be detached from the cement form 1012, as shown in FIG. 18. The stakes 18 may be driven downward below the top surface 1040 and even as low as the location of the relief cuts 1072, 1074 after the detachable portion 1070 has been removed. The backfill 22 may be graded to a higher level to cover the stakes 18 and all of the cement form 1012 except for a portion 1075 that is in direct contact with the foundation 24. In some embodiments, the insert 46 (see FIG. 4) may be reinserted into the connector groove prior to increasing the height of the backfill 22. In other embodiments, the stakes 18 may be removed rather than driven further into the cement form 1012. FIG. 19 shows the backfill 22 increased in height and a building structure (e.g., wall 27) positioned on top of the foundation 24.

The method of forming a foundation 24 described with reference to FIGS. 15-19 may be performed without using backfill 22 along the weight-bearing surface 1038 prior to forming the foundation 24. The backfill 22 may be added after removing the detachable portion 1070 or at other stages in the process.

Figure 20:
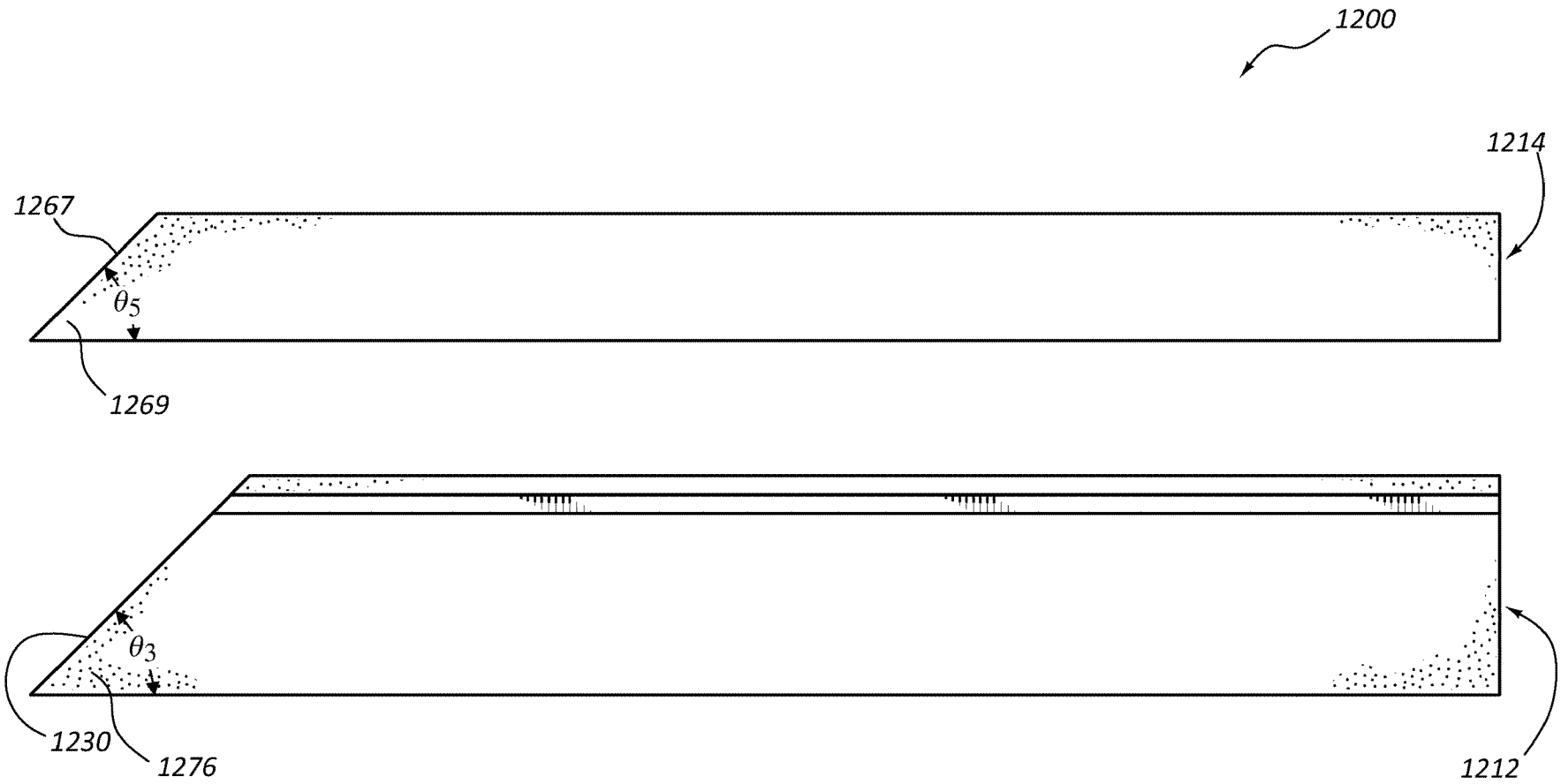
FIG. 20 is a top view of another cement form assembly with the cement form and inner insert have angled end portions in accordance with the present disclosure.
Figure 21:
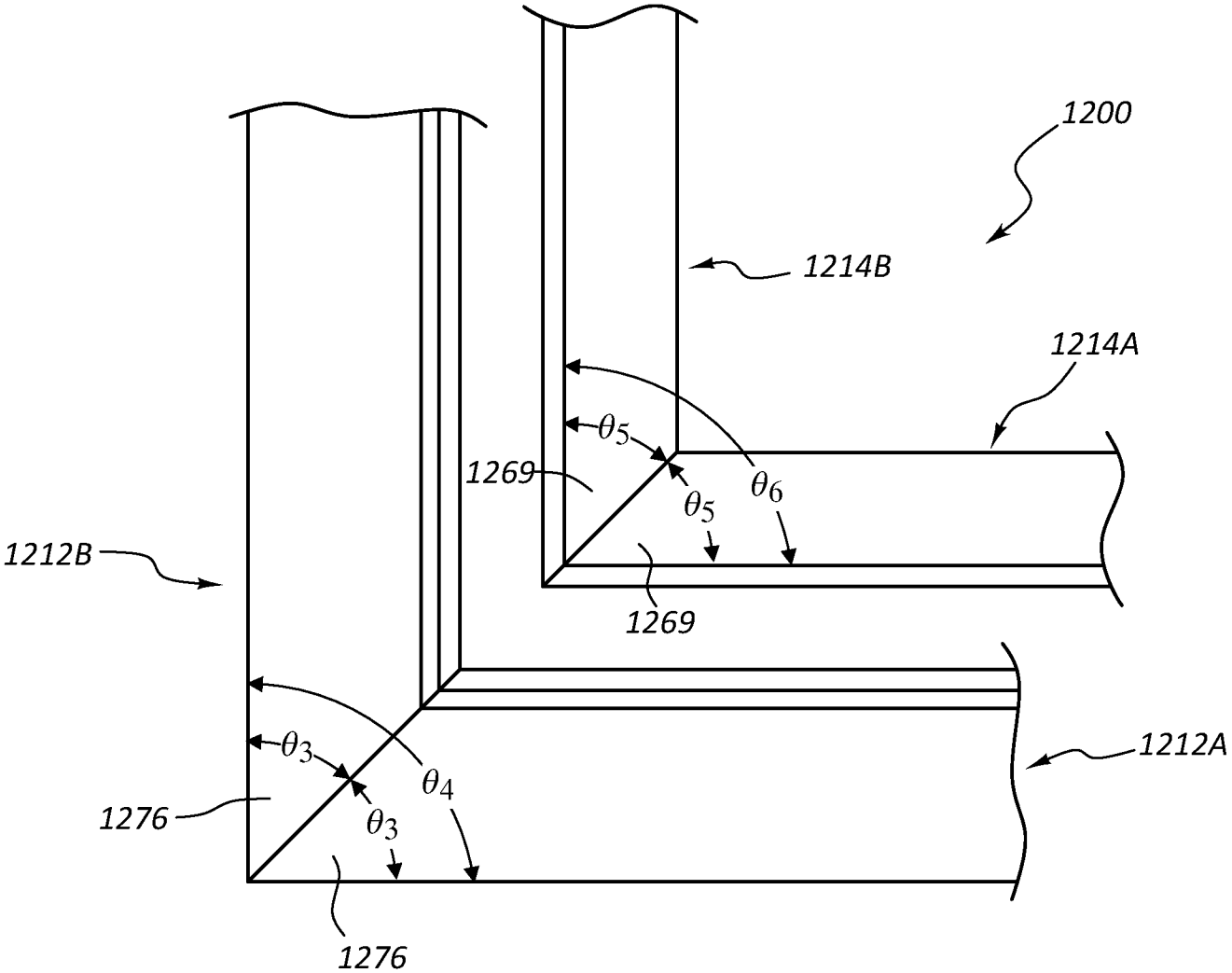
FIG. 21 is a top view of the cement form assembly shown in FIG. 20 with pairs of cement forms and inner inserts arranged at right angles relative to each other.

Referring to FIGS. 20 and 21, another example cement form 1212 and another example inner insert 1214 are shown and described. The cement form 1212 includes an angled end portion 1276 that defines an angled end surface 1230. The angled end portion 1276 is arranged at an angle $\theta_3$ relative to the length $L_1$ of the cement form 1212. Typically, the angle $\theta_3$ is about 45°. However, the angle $\theta_3$ may be modified depending on a desired angled arrangement between the cement form 1212 and an adjacent positioned cement form 1212.

FIG. 21 shows a pair of cement forms 1212A, 1212B that each include an angled end portion 1276 each having an angle $\theta_3$ of 45°. The angled end portions 1276 when mated together provide for a combined angle $\theta_4$ of 90° between the cement forms 1212A, 1212B. In another example (not shown) the angled end portion 1276 of cement form 1212A may have an angle $\theta_3$ of 60°, and the angled end portion 1276 of cement form 1212B has an angle $\theta_3$ of 60° so that the mated arrangement creates an angle $\theta_4$ of 120°.

FIG. 20 shows the inner insert 1214 having an angled end portion 1269 that forms an angled end surface 1267. The angled end portion 1269 is arranged at an angle $\theta_5$. FIG. 21 shows a pair of inner inserts 1214A, 1214B that are mated together at the angled end portions 1269, wherein each of the angles $\theta_5$ is about 45° and the combined angle of $\theta_6$ is about 90°. The angles $\theta_5$ may be varied to create a combined angle $\theta_6$ that is different from 90°.

The angled end portions 1276, 1269 shown in FIG. 20 may be included on a single end of the cement form 1212 and inner insert 1214, respectively, or may be included on each end of the cement form 1212 and inner insert 1214, respectively. The angled end portions 1276, 1269 may be referred to as angled ends, mitered ends, pre-cut angled ends, pre-cut surfaces, angled corner portions, and the like. The angled end portions 1276, 1269 may be created during manufacture of the respective cement form 1212 and inner insert 1214. In some arrangements, the angled end portions 1276, 1269 may be cut and/or formed prior to delivery of the cement form 1012 and inner insert 414 to a work site. A designer of a cement structure, such as a monolithic foundation, may determine in advance how many cement forms 1212 and inner inserts 1214 are needed to form the corners for the foundation. The designer can then order a certain number of cement forms 1212 and inner inserts 1214 to create the expected number of corners for the foundation. Further, the designer may order certain numbers of the cement forms without angled end portions (e.g., cement forms 12, 1012, 1112, etc.) and inner inserts (e.g., inner insert 14, 414, etc.) and the length of those cement forms and inner inserts to create a cement form assembly with as little waste material and the need for cutting the cement forms and inner inserts as possible.

Figure 22:
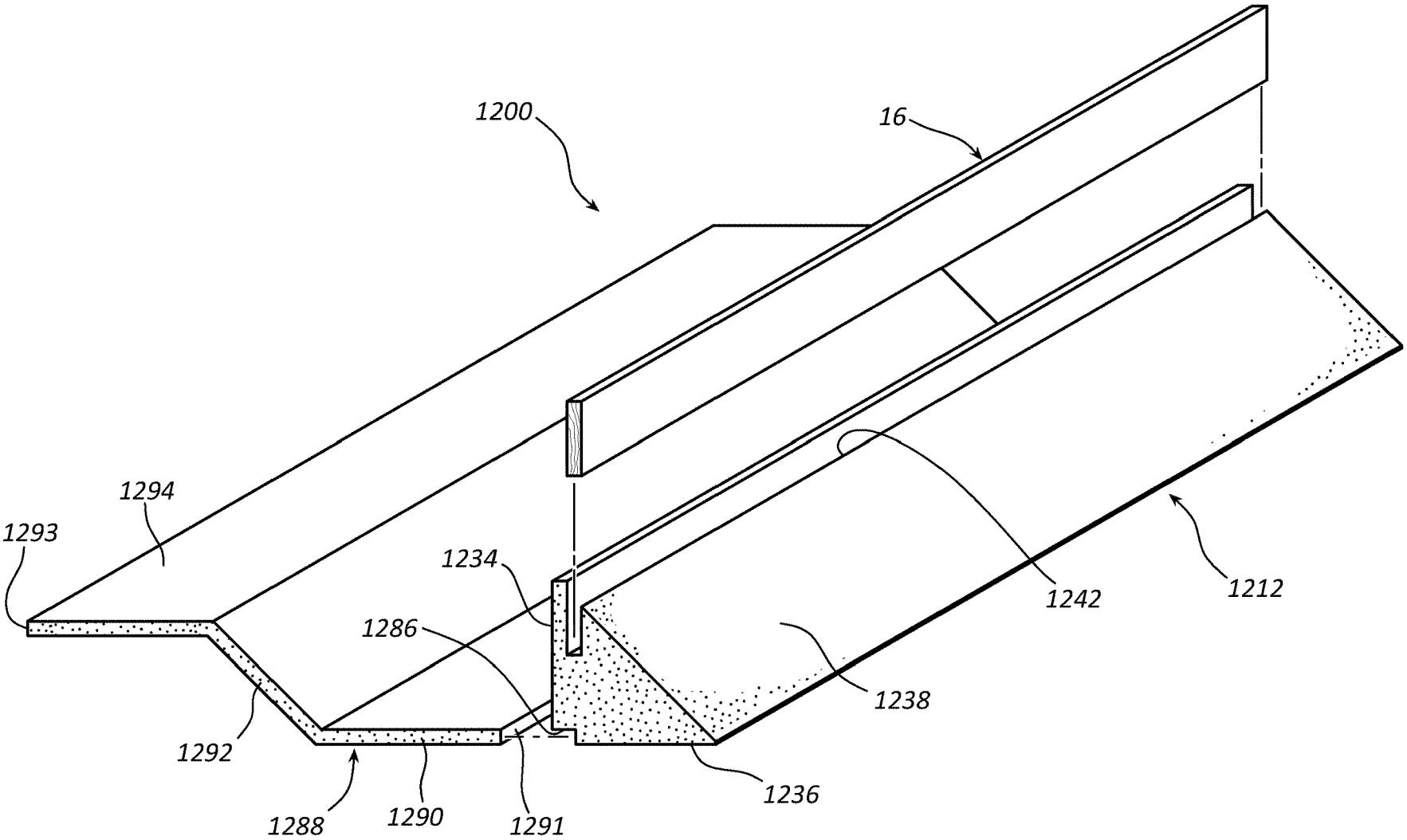
FIG. 22 is an exploded perspective view of another example cement form assembly in accordance with the present disclosure.
Figure 23:
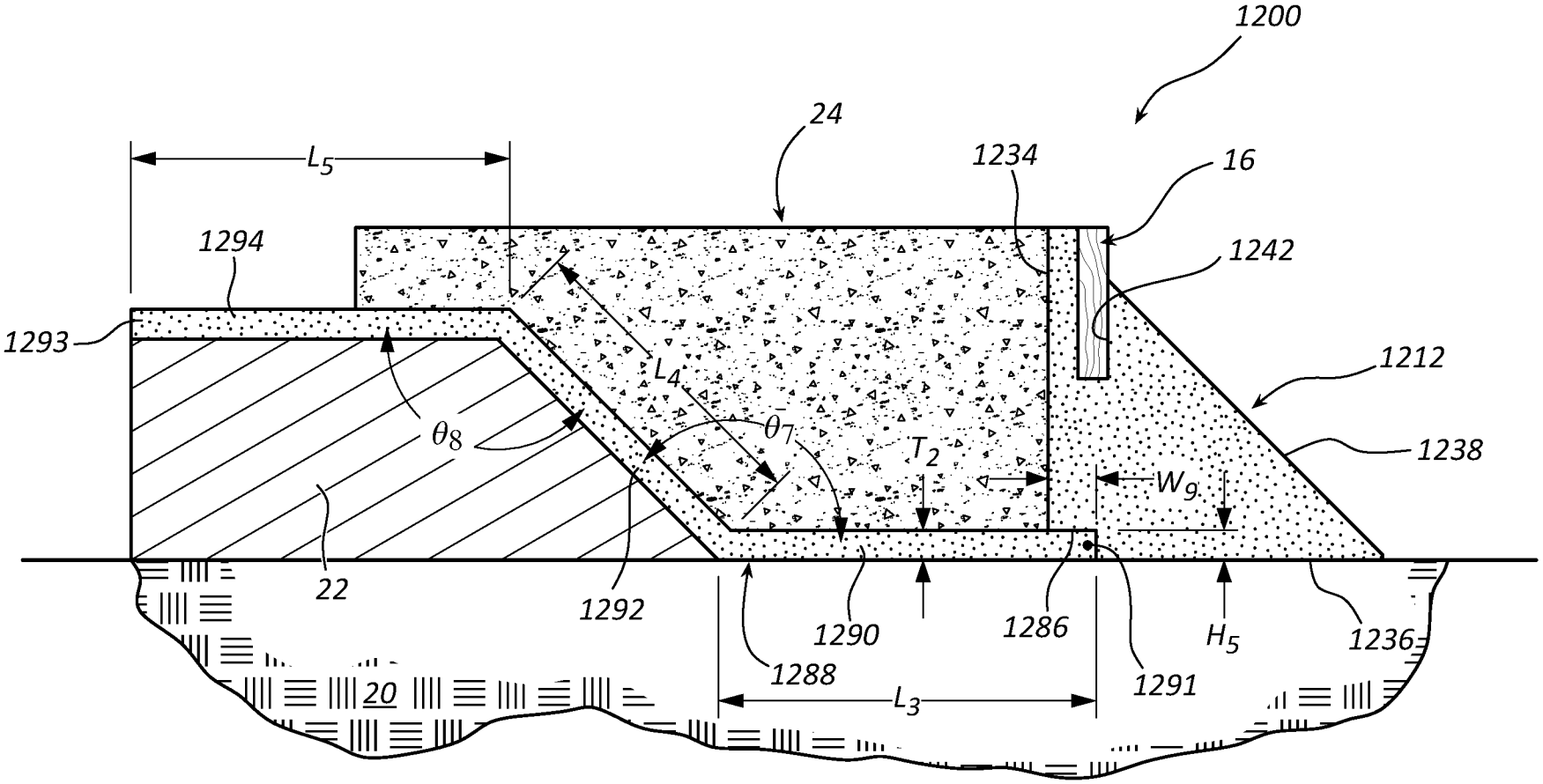
FIG. 23 is an end view of the cement form assembly shown in FIG. 22.
Figure 24:
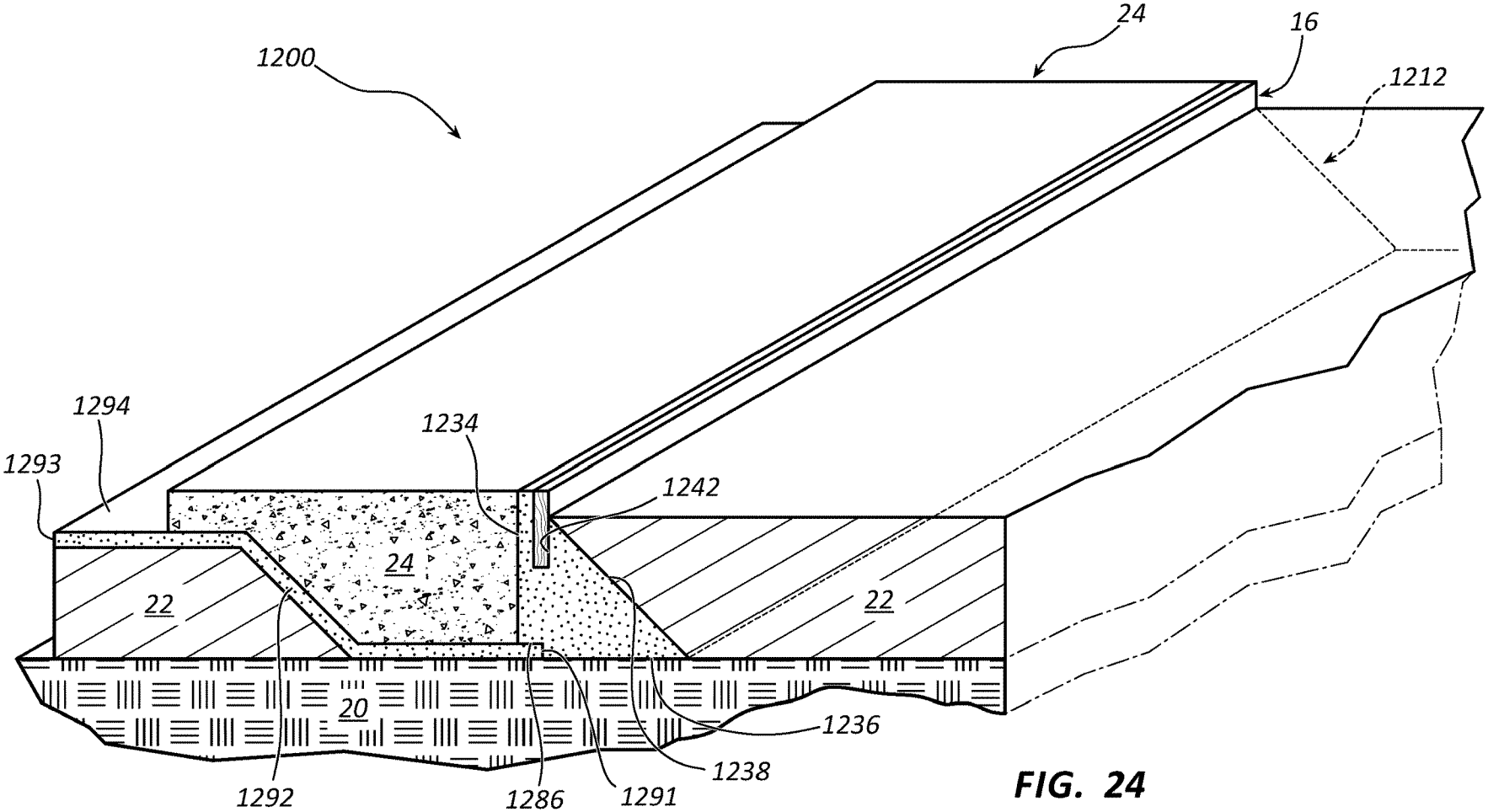
FIG. 24 is a perspective view of the cement form assembly shown in FIG. 22.

Referring now to FIGS. 22-24, another example cement form assembly 1200 is shown and described. The cement form assembly 1200 includes a cement form 1212 and an extension member 1288. The cement form 1212 may be one of a plurality of cement forms that are positioned end-to-end and interconnected with one or more connecting members 16.

The cement form 1212 may include first and second surfaces 1234, 1236, a weight-bearing surface 1238, a top surface 1240, a connector groove 1242, and a notch 1286. The first surface 1234 may be arranged generally vertically and define a surface that supports a volume of cement when using the cement form 1212 to form a cement structure such as a building foundation. The second surface 1236 may be arranged generally horizontally and face downward to contact a ground surface upon which the cement form 1212 is supported. The weight-bearing surface 1238 may be arranged diagonally (e.g., at a non-perpendicular angle) relative to the first and second surfaces 1234, 1236. The cement form 1212 may have a similar cross-sectional shape, size and other features as compared to other embodiments disclosed herein.

The addition of notch 1286 may facilitate interconnection and/or assembly of the cement form 1212 with the extension member 1288. The notch 1286 may have a width $W_9$ and a height $H_5$. The notch 1286 may be formed along the first surface 1234. The notch 1286 may be formed at least in part in the second surface 1236. In at least some arrangements, the notch 1286 may be formed in the bottom most surface of the cement form 1212 (e.g., the second surface 1236) an at interface with the surface that supports the volume of cement (e.g., the first surface 1234).

Typically, the width $W_9$ is in the range of about 1 inch to about 6 inches, and more particularly about 2 inches to about 4 inches. Typically, the width $W_9$ is at least 2 inches. The height $H_5$ is typically at least 2 inches, and more particularly in the range of about 2 inches to about 4 inches.

The notch 1286 is sized to receive a free end of the extension member 1288 in order to help stabilize and hold the extension member 1288 at a predetermined location relative to the cement form 1212. The notch 1286 or a similar notch feature may be formed in any of the cement forms disclosed herein. The notch 1286 preferably is sized to receive an extension member 1288 having a thickness $T_2$ that meets building code requirements for a thermal barrier between the building foundation and the ground surface upon which it is supported. This thermal barrier typically is required to be at least 2 inches, and in some embodiments is in the range of about 2 inches to about 4 inches, and more particularly about 2.25 inches.

The extension member 1288 may include first, second and third segments 1290, 1292, 1294, which are arranged end-to-end. The first, second and third segments 1290, 1292, 1294 may be formed as an integral, single-piece unit having a unitary, integrated construction. In other embodiments, the first, second and third segments may be separately formed and connected together in a separate assembly step using, for example, adhesives, welding, or the like. The first segment 1290 may have a length $L_3$. The second segment 1292 may have a length $L_4$. The third segment 1294 may have a length $L_5$. Each of the first, second and third segments may have the same thickness $T_2$, although in some embodiments each may have its own, unique thickness. The first and second segments 1290, 1292 may be arranged at an angle $\theta_7$ relative to each other. The second and third segments 1292, 1294 may be arranged at an angle $\theta_8$ relative to each other. Typically, the angles $\theta_7$, $\theta_8$ are each in the range of about 90 degrees to about 150 degrees, and more particularly in the range of about 100 degrees to about 130 degrees. The lengths $L_3$, $L_4$, $L_5$ typically are in the range of about 10 inches to about 48 inches, and more particularly in the range of about 24 inches to about 42 inches. In one arrangement, the length $L_3$ is about 30 inches to about 36 inches, the length $L_4$ is about 24 inches to about 30 inches, and the length $L_5$ is about 30 inches to about 36 inches.

When assembled, a first end 1291 of the extension member 1288 is positioned within the notch 1286 of the cement form 1212. An opposite end 1293 of the extension member 1288 is positioned inward from the cement form 1212 (i.e., toward the center of the cement foundation). FIG. 24 illustrates the cement form assembly 1200 in use with backfill 22 and a cement structure 24. The cement form 1212 and the first segment 1290 of the extension member 1288 are supported on a ground support 20. The second and third segments 1292, 1294 are supported on backfill 22. The shape of the extension member 1288 generally matches the intended shape for the bottom surface of the cement structure 24. Thus, when cement is poured in the space between the first surface 1234 of the cement form 1212 and the extension member 1288, the cement structure 24 may be formed in a desired shape and size as shown in FIG. 24.

The connection between the cement form 1212 and extension member 1288 provided by insertion of the first end 1291 within the notch 1286 may assist in holding the relative position the cement form 1212 and extension member 1288 when forming the cement structure 24. In other embodiments, the extension member 1288 may simply be abutted against the first surface 1234 rather than being inserted within a notch 1288 (i.e., if there is no notch 1286 provided, such as with the other embodiments described above with reference to FIGS. 1-21). The extension member 1288 may provide a thermal barrier between the cement structure 24 and the ground support 20 and backfill 22 regardless of the interface provided between the cement form 1212 and the extension member 1288. That is, the extension member 1288 may have utility that is independent of its use with cement form 1212. The extension member 1288 may be shaped and sized to accommodate different desired shapes and sizes for the cement structure 24, the contoured shape of the backfill 22, a desired amount of thermal barrier needed between the cement structure and the surrounding ground support 20 and backfill 22, and other considerations.

In other arrangements, the extension member 1288 may have a positive connection to the cement form 1212 prior to forming the cement structure 24. For example, the extension member 1288 may be secured to the cement form 1212 with a fastener, an adhesive or other bonding agent, or an interference fit connection. The positive connection therebetween may be facilitated by insertion of the extension member 1288 into the notch 1286. In some embodiments, the cement form 1212 is secured to the ground support 20 using a fastener such as a stake that extends through the weight-bearing surface 1238, and the extension member 1288 is separately secured in place relative to the ground support 20 and cement form 1212 using a fastener that extends into the ground support 20 and/or backfill 22 via any one of the first, second and third segments 1290, 1292, 1294.

Figure 26:
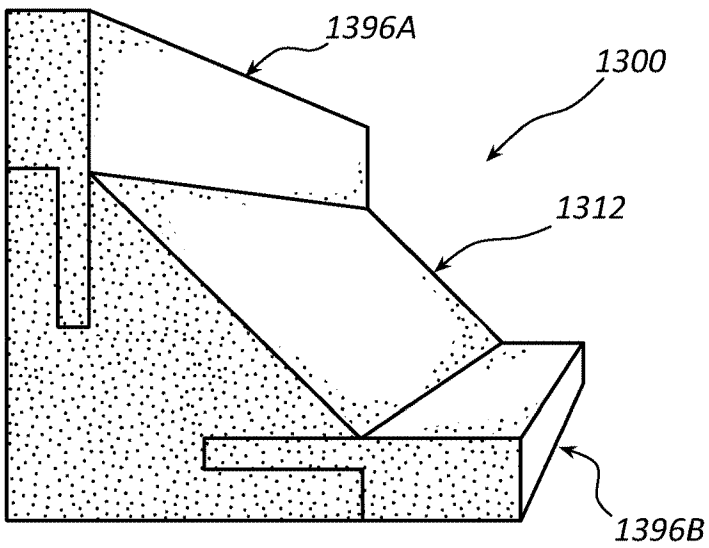
FIG. 26 is a perspective view of the cement form assembly shown in FIG. 25.
Figure 25:
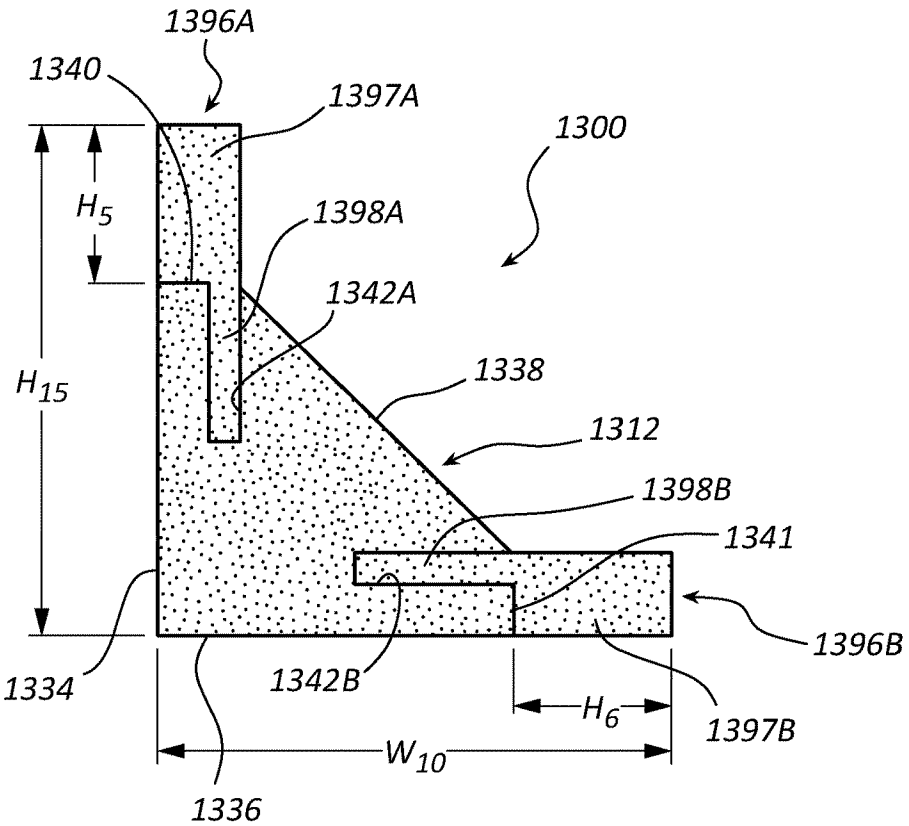
FIG. 25 is an end view of another example cement form assembly in accordance with the present disclosure.
Figure 27:
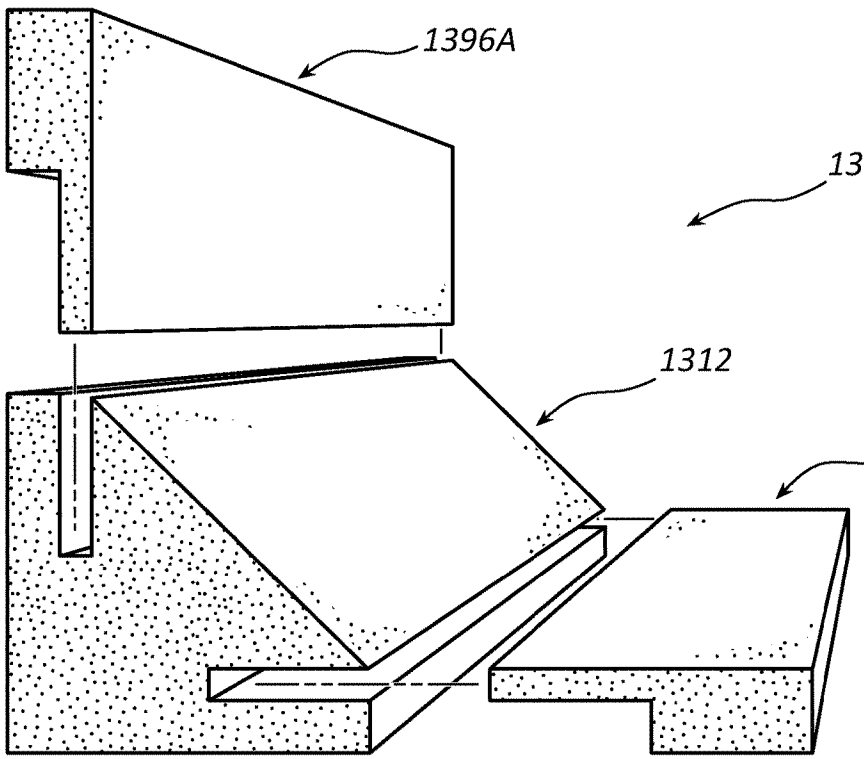
FIG. 27 is an exploded view of the cement form assembly shown in FIG. 25.
Figure 28:
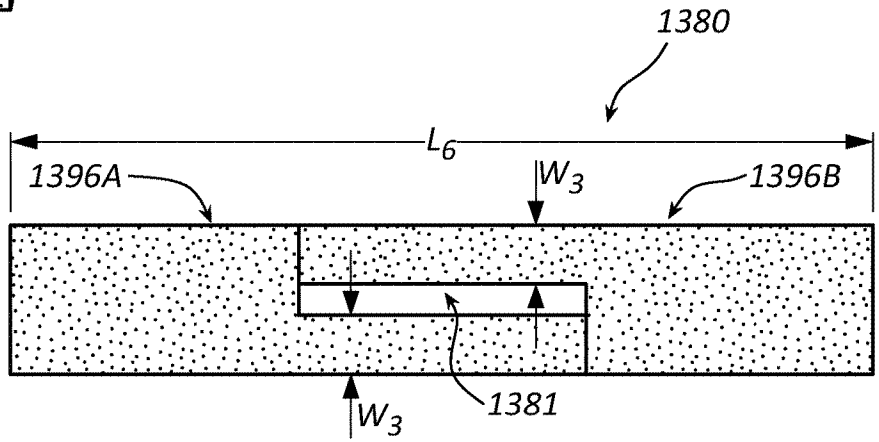
FIG. 28 is an end view of a block of foam material from which a pair of extensions are formed.

FIGS. 26-28 illustrate another example cement form assembly 1300. The cement form assembly 1300 includes a cement form 1312 and a pair of extensions 1396A, 1396B. The cement form 1312 may include first and second surfaces 1334, 1336 and a weight-bearing surface 1338. Connector grooves or recesses 1342A, 1342B are formed in the weight-bearing surface 1338 at locations spaced away from the first and second surfaces 1334, 1336, respectively. The cement form 1312 also includes end surfaces 1340, 1341 that extend perpendicular to the first and second surfaces 1334, 1336, respectively and terminate at the openings into the connector grooves 1342A, 1342B, respectively.

The cement form 1312 may have a generally symmetrical construction with the size and shape of the first surface 1334, connector groove 1342A, top surface 1340 being substantially equal to the size and shape of the second surface 1336, second connector groove 1342B, and second end surface 1341. The cement form 1312 may have a wedge cross-sectional shape, which may be described as a generally as a triangular cross-sectional shape or a truncated triangular shape. The symmetry of the construction for cement form 1312 may permit it to be used for forming a cement structure when the second surface 1336 is positioned facing and supported on a ground surface, or rotated 90 degrees such that the first surface 1334 is facing and supported against a ground surface.

The connector grooves 1342A, 1342B may be receptive of a portion of the extensions 1396A, 1396B. The extensions may each include a body portion 1397A, 1397B and a leg portion 1398A, 1398B. The leg 1398A, 1398B may have a size and shape that substantially matches the size and shape of the connector grooves 1342A, 1342B. The body 1397A, 1397B may have a height $H_5$, $H_6$, respectively. The heights $H_5$, $H_6$ may vary depending on, for example, the desired total height $H_{15}$ shown in FIG. 27 and the total width $W_{16}$. The desired total height $H_{15}$ and total width $W_{16}$ may vary depending on a variety of criteria such as, for example, the desired height of the cement structure supported by and/or insulated by the cement form 1312 and/or the amount of thermal protection and/or thermal barrier desirable along the ground surface extending away from the cement structure. In some embodiments, the dimensions $H_5$, $H_6$ are substantially equal and the extensions 1396A, 1396B are interchangeable with each other.

In one example, the total height $H_{15}$ is about 18 inches and the total width $W_{16}$ is about 18 inches. In another example, the height $H_{15}$ is about 24 inches and the total width $W_{16}$ is about 15 inches. In one example, the total height $H_{15}$ is about 18 inches and the height $H_5$ is about 6 inches (e.g., within the range of about 3 inches to about 12 inches), and the width $W_{16}$ is about 24 inches with the dimension $H_6$ is about 6 inches (e.g., within the range of about 3 inches to about 12 inches).

FIG. 28 illustrates an end view of a block 1380 from which the extensions 1396A, 1396B are formed. The block 1380 has a length $L_6$ and the two extensions 1396A, 1396B can be formed (e.g., cut) from that length $L_6$. The extensions 1396A, 1396B may be positioned within the block 1380 with a mirrored arrangement. A minimal amount of excess 1381 may be left over after cutting the two extensions 1396A, 1396B from the block 1380. The legs 1398A, 1398B may have a thickness that is substantially equal to a width $W_3$ of the connector grooves 1342A, 1342B. Typically, a length of the legs 1398A, 1398B is substantially equal to the height $H_3$ of the connector grooves 1342A, 1342B. The length $L_6$ is typically equal to the heights $H_5$, $H_6$ plus the length of the legs 1398A, 1398B, which is typically equal to height $H_3$.

The cement form assembly 1300 may be used with one or both of the extensions 1396A, 1396B, or with neither of the extensions 1396A, 1396B. In at least some examples, one of the connector grooves 1342A, 1342B is receptive of a connector that interconnects a plurality of cement forms 1312 that are arranged end-to-end. An example connecting member 16 is shown in other figures of the present application. In embodiments in which both of the extensions 1396A, 1396B are used with the cement form 1312, the cement form 1312 may be retained in place relative to a ground surface using stakes that are driven through, for example, the weight-bearing surface 1338 and/or the extension 1396B. The extensions 1396A, 1396B may be retained in place within the connector grooves 1342A, 1342B using, for example, an interference fit, a fastener, an adhesive or other bonding agent, or the like.

Figure 29:
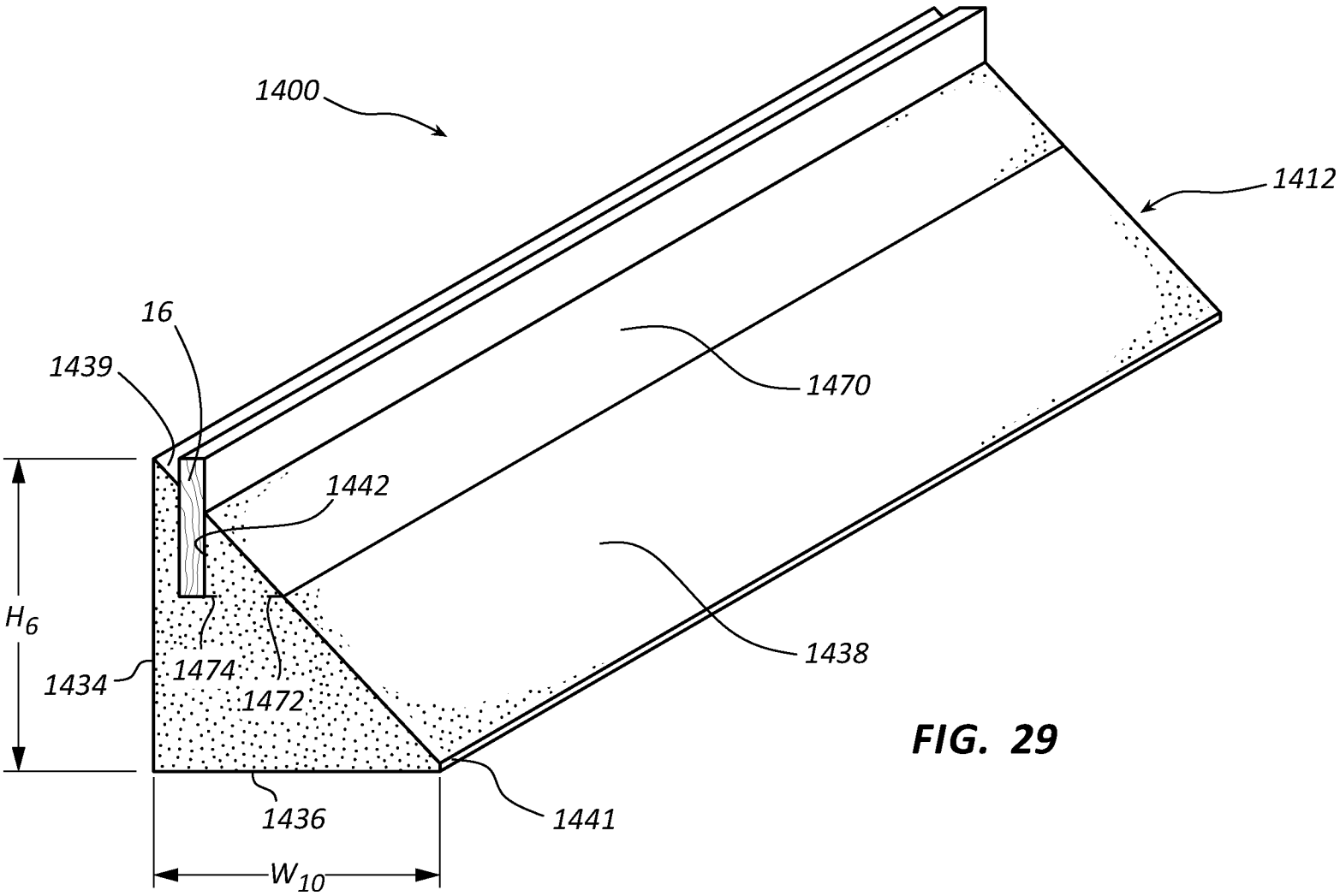
FIG. 29 is a perspective view of another example cement form assembly in accordance with the present disclosure.

FIG. 29 illustrates another example cement form assembly 1400 that includes a cement form 1412 that may be used with one or more connecting members 16. The cement form 1412 may include first and second surfaces 1434, 1436 that have a height $H_6$ and width $W_{10}$, respectively. A weight-bearing surface 1438 may be arranged at an angle relative to both of the first and second services 1434, 1436. A connector groove 1342 may be formed in the weight-bearing surface 1438 and may be spaced apart from the first and second surfaces 1434, 1436. A detachable portion 1470 may be positioned adjacent to the connector groove 1342. The cement form 1412 may include a plurality of relief cuts 1472, 1474 to assist with detaching the detachable member 1470 from the remaining portions of the cement form 1412.

The cement form 1412 may also include an uppermost portion defining a tip 1439. The tip 1439 may define an uppermost or top point for the cement form 1412 when arranged in the upright position shown in FIG. 29 with the first surface 1434 arranged generally vertically. The cement form 1412 may also include an end surface 1441 at the intersection between the weight-bearing surface 1438 and the second surface 1436. The end surface 1441 may define the furthermost point from the first surface 1434. In at least some arrangements, the end surface 1441 may have a height that is substantially equal to a height or thickness of an extension member that is also supported on a ground surface adjacent to the cement form 1440, such as the extension member 1502 shown and described with reference to FIG. 30. The extension member 1502 may be abutted against the end surface 1441. In other arrangements, a notch may be formed in the area of the end surface 1441 to provide an improved interface and/or connection between the cement form 1412 and the extension.

The tip 1439 may define a top surface as well as a top point for the cement form 1412. The intersection between the first surface 1434 and the weight-bearing surface 1438 at the tip 1439 may define an uppermost point or tip of the cement form 1440. The segment of the weight-bearing surface 1438 between the uppermost point and the connector groove 1442 may define a top surface for the cement form 1412. This top surface may be arranged at a non-perpendicular angle relative to the first and second surfaces 1434, 1436.

Figure 30:
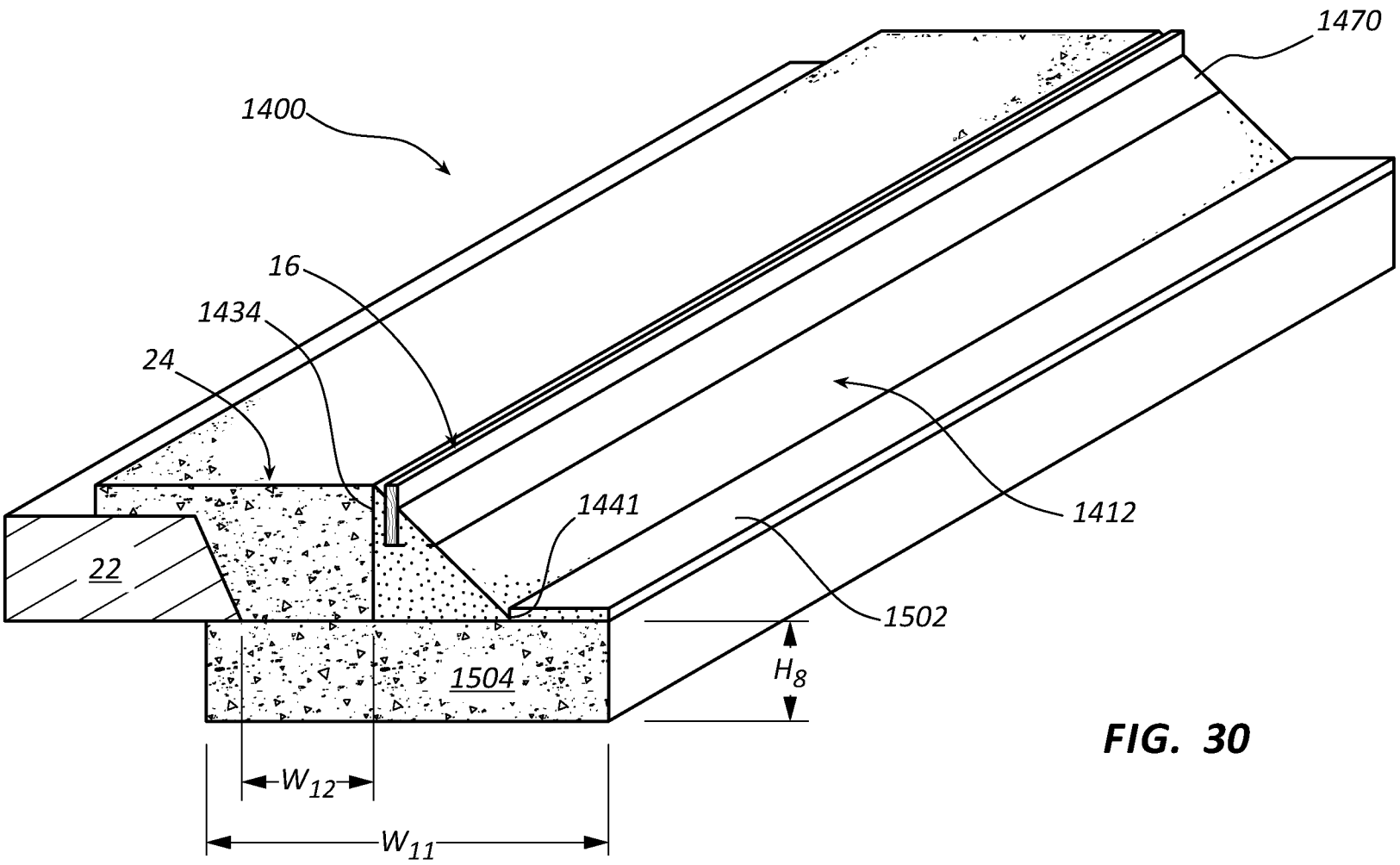
FIG. 30 is a perspective view of another example cement form assembly in accordance with the present disclosure.

FIG. 30 shows a cement form 1412 in use with a cement structure 24, backfill 22 and a spot footing 1504. The spot footing 1504 may be formed prior to formation of the cement structure 24. In some embodiments the spot fitting 1504 also comprises cement, rebar, and other features of a cement structure. The cement structure 24 may be formed by positioning the cement form 1412 on a top surface of the spot fitting 1504. This spot fitting 1504 may have a width $W_{11}$, and the cement form 1412 is positioned space between opposing ends of the spot footing 1504. Spot footing 1504 may also have a height $H_3$. The backfill 22 may overlap at least a portion of a top surface of the spot fitting 1504.

An extension member 1502 may be positioned along the top surface of the spot fitting 1504 adjacent to the cement form 1412. In at least some embodiments, the extension member 1502 may have sufficient length to substantially cover whatever portion of the spot fitting 1504 that is exposed beyond the end surface 1441 of the cement form 1412. The cement form 1412 may be interconnected with other end-to-end positioned cement forms 1412 using connecting member 16. The cement form 1412 may be secured in place relative to spot footing 1504 using, for example, a fastener, stake, bonding agent, or the like. Alternatively, additional backfill dirt is used to cover at least a portion of the weight-bearing surface 1438 and the extension member 1502, wherein the backfill provides sufficient weight and resistance that holds the cement form 1412 in position relative to the spot footing 1504 while cement is poured in a space between the backfill 22 and the first surface 1434 of the cement form 1412.

The cement structure 24 may be formed directly onto the top surface of the spot footing 1504 and have a width $W_{12}$ at the interface with the spot footing 1504. In one example, the width $W_{12}$ is about 12 to about 24 inches, and more particularly about 16 inches. The height $H_5$ may be in the range of about 6 to about 18 inches, and more particularly about 12 inches. The width $W_{11}$ may be in the range of about 1 foot to about 6 feet, and more particularly about 4 feet. The height $H_6$ may be in the range of about 12 inches to about 24 inches, and more particularly about 12 to about 16 inches. The width $W_{10}$ may be in the range of about 12 to about 24 inches, and more particularly about 12 inches to about 16 inches.

Figure 31:
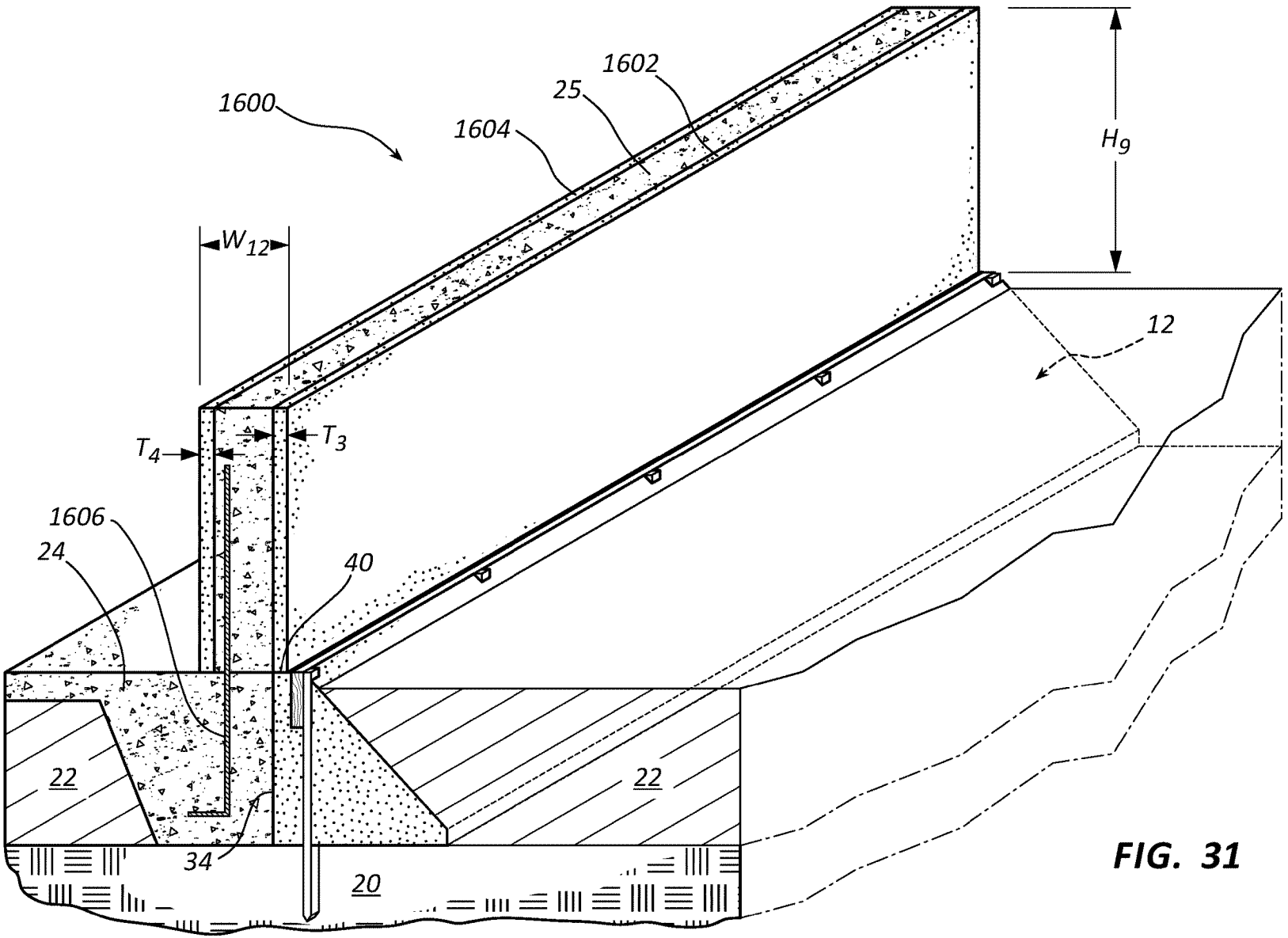
FIG. 31 is a perspective view of another example cement form assembly in accordance with the present disclosure.

FIG. 31 illustrates a cement form 12 used for forming a cement structure 24, such as a building foundation. A foundation extension or wall 25 may be supported on top of the cement structure 24. An outer surface of the wall 25 may be aligned with an outer surface of the cement structure 24 and the first surface 34 of the cement form 12. The wall 25 may have a width $W_{12}$ and a height $H_9$. The width $W_{12}$ may be in the range of about 4 to about 12 inches, and more particularly about 6 to about 10 inches. The height $H_9$ may be in the range of about 4 to about 18 inches, and more particularly in the range of about 12 to about 18 inches. A rebar member 1606 may extend from the cement structure 24 into the wall 25. In some arrangements, the wall 25 may be formed concurrently with formation of the cement structure 24 (e.g., as part of a continuous pour of cement).

The wall 25 may be encased within vertical extensions 1602, 1604. The vertical extensions 1602, 1604 may be positioned on outer and inner surfaces of wall 25, respectively. The extensions 1602, 1604 may comprise the same or similar material as the material of the cement form 12, extension member 1502, extensions 1396A, 1396B, extension 1288, and other insulated materials described herein (e.g., rigid foam materials). The extensions 1604, 1605 may each have a thickness $T_3$, $T_4$, respectively, and a height that is substantially equal to the height $H_9$ of the wall 25. The thicknesses $T_3$, $T_4$, typically in the range of about 1 inch to about 4 inches, and more particularly about 2 inches to about 2.5 inches. The extensions 1602, 1604 may provide a heat barrier, a thermal barrier, or the like for the wall 25 and/or cement structure 24. The extension 1602 may rest upon a top surface 40 of the cement form 12. The extension 1604 may rest upon a top surface of the cement structure 24. The connector or rebar member 1606 may be positioned internal and interconnect the wall 25 with the cement structure 24, and may be referred to as being embedded within one or both of the cement structure 24 and wall 25.

Figure 32:
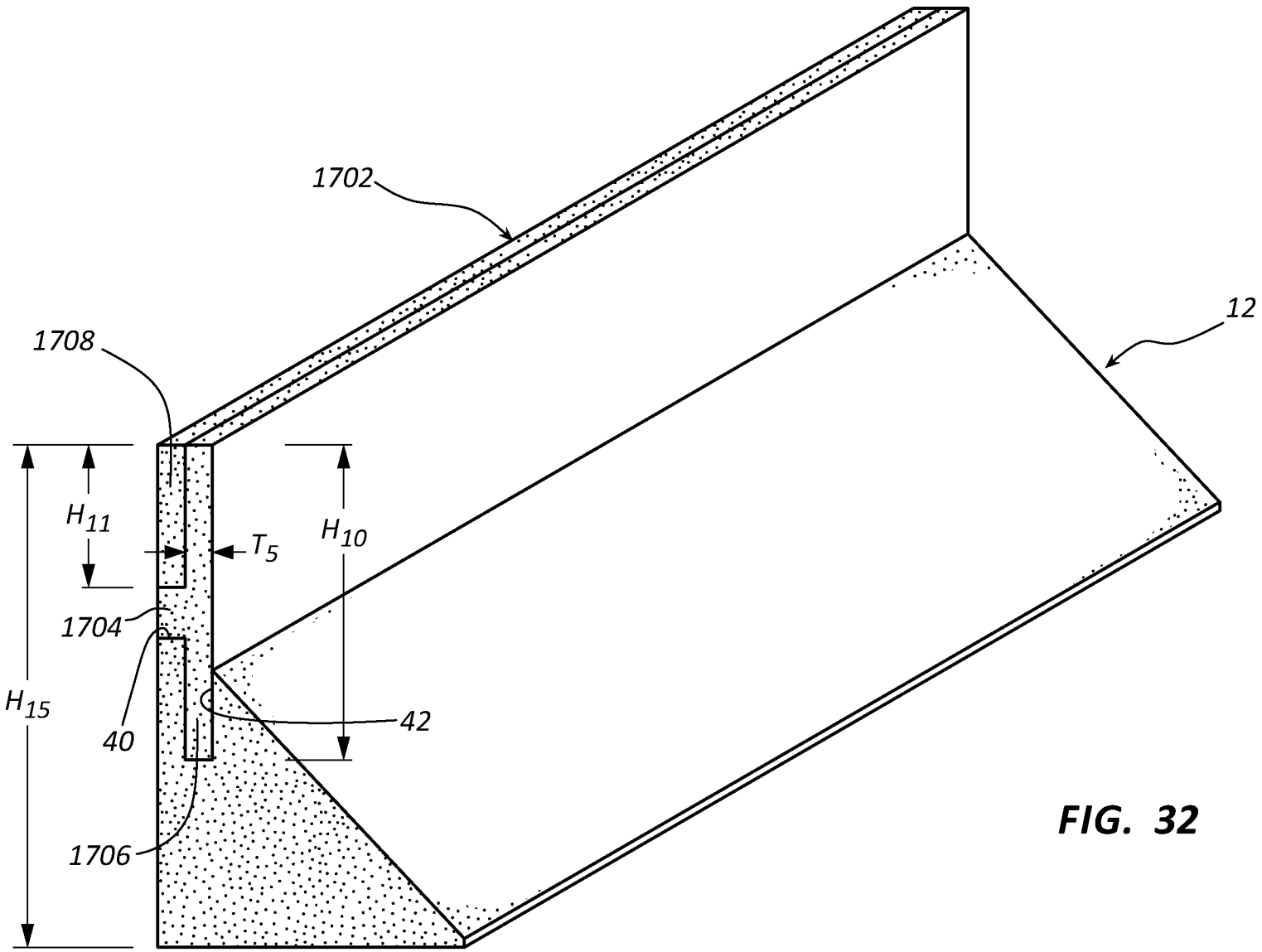
FIG. 32 is a perspective view of another example cement form assembly in accordance with the present disclosure.

FIG. 32 illustrates cement form 12 in use with a different vertical extension member 1702. The vertical extension 1702 may include a body 1704, a leg 1706, and have a total height $H_{10}$. The body 1704 may support a second extension 1708. The second extension 1708 may be similar to the extension 1985 described below with reference to FIGS. 35 and 36. The vertical extension 1702 may be used to elevate the second extension 1708 to an additional height relative to the top surface 40 of the cement form 12. The vertical extension 1702 may be referred to as a spacer or elevator member 1702 because of its function to further space apart the second extension from the cement form 12. The leg 1706 may be inserted into the connector groove 42 in place of the connector 16 described with reference to other embodiments disclosed herein. The leg 1706 may have an interference fit connection with the connector groove 42 to permit partial insertion of the leg 1706 into the connector groove 42 and maintain that position during pouring of the cement structure 24. Other features may be used to retain the leg 1706 in a desired partially or full inserted position relative to the connector groove 42. For example, an expansion foam, fastener, adhesive, or even cement material may be used to hold the leg 1706 in a desired partially or fully inserted position relative to the connector groove 42.

The vertical extension 1702 may comprise a material that is similar in density and material composition as the cement form 12 and second extension 1708. In other embodiments, the vertical extension 1702 may comprise a foam material with greater density in order to provide increased strength and rigidity for the purpose of securing two cement forms 12 together in an end-to-end arrangement. In some embodiments, the vertical extension may comprise a different type of insulative material beside the foam materials described herein.

In other embodiments, the feature labeled 1708 may be a removable portion having a height $H_{11}$ and thickness $T_5$. In some arrangements, the second extension 1708 may be formed from (e.g., removed or cut from) the cement form, similar to formation of the extension 1985 described with reference to FIGS. 35 and 36. The second extension 1708 may in some embodiments extend vertically above a top end of the vertical extension 1702. In one arrangement, the recess 1708 has a height $H_{11}$ and a range of about 4 inches to about 12 inches, and more particularly about 6 inches to about 8 inches. The thickness $T_5$ typically is in the range of about 1 inch to about 3 inches. The height $H_{10}$ typically is in the range of about 2 inches to about 24 inches. The leg 1706 typically has a size and shape that substantially matches the dimensions of connector groove 40 of the cement form 12. The height of the body portion 1704 may vary to position the second extension at different spaced apart heights relative to the top surface 40. The height of the body portion 1704 measured in a vertical direction typically is in the range of about 1 inch to about 12 inches, and more particularly about 2 inches to about 6 inches.

In some embodiments, the vertical extension 1702 is formed integral with the remaining portions of the cement form 12 rather than being a removable piece that is formed separately and inserted into the connector groove 40. A total height $H_{15}$ of the cement form 12 with the vertical extension 1702 typically is in the range of about 16 inches to about 36 inches, and more particularly about 20 inches to about 24 inches.

In some embodiments, the vertical extension 1702 may be reversibly mounted in the connector recess 42. That is, a portion of the body 1704 may be rotated such that the leg 1706 is extending vertically upward and an opposite leg portion from the leg 1706 (e.g., the portion adjacent to recessed 1708, which may have a different height compared to leg 1706) is inserted into the connector recess 42.

Figure 33:
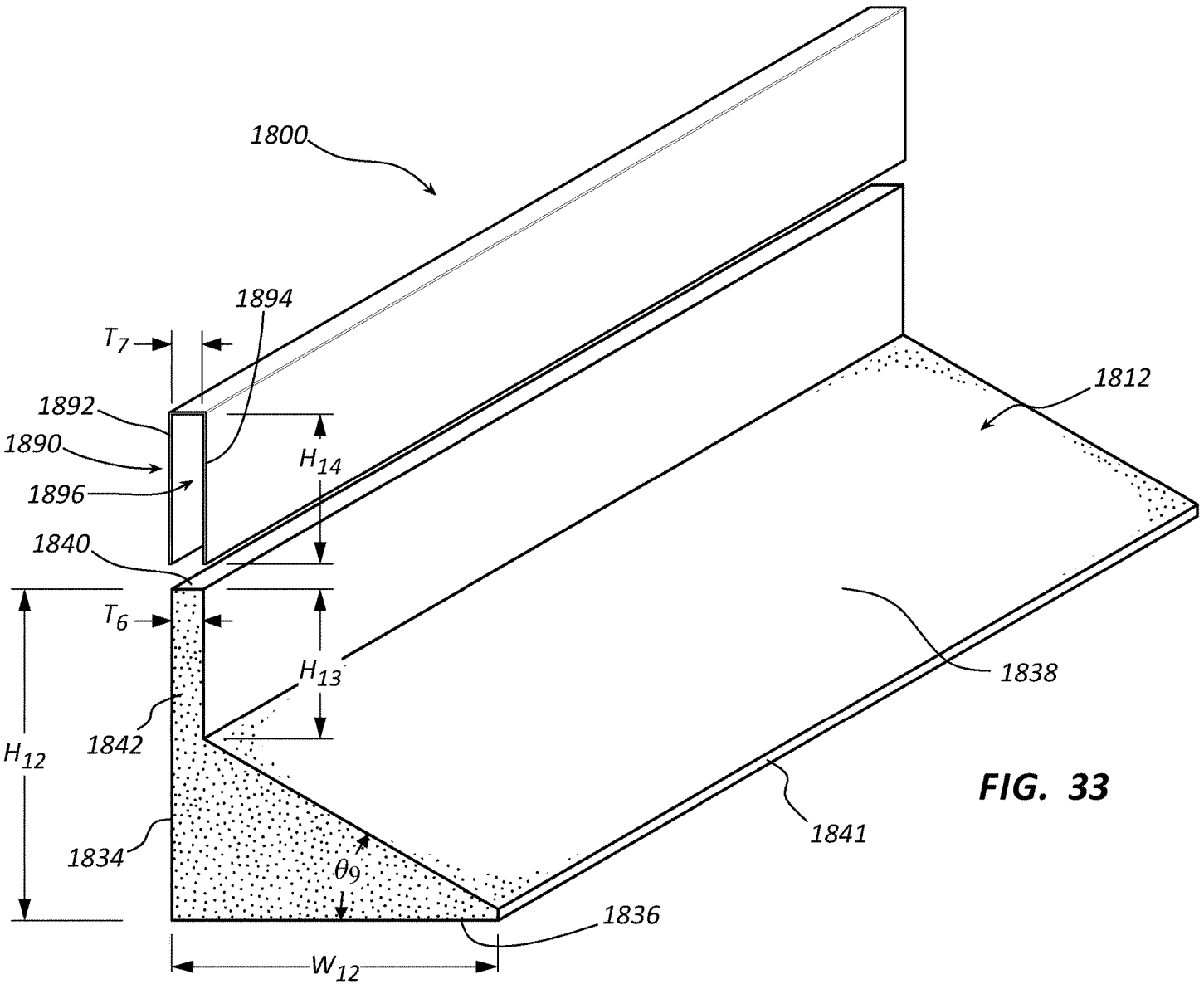
FIG. 33 is a perspective view of another example cement form assembly in accordance with the present disclosure.
Figure 34:
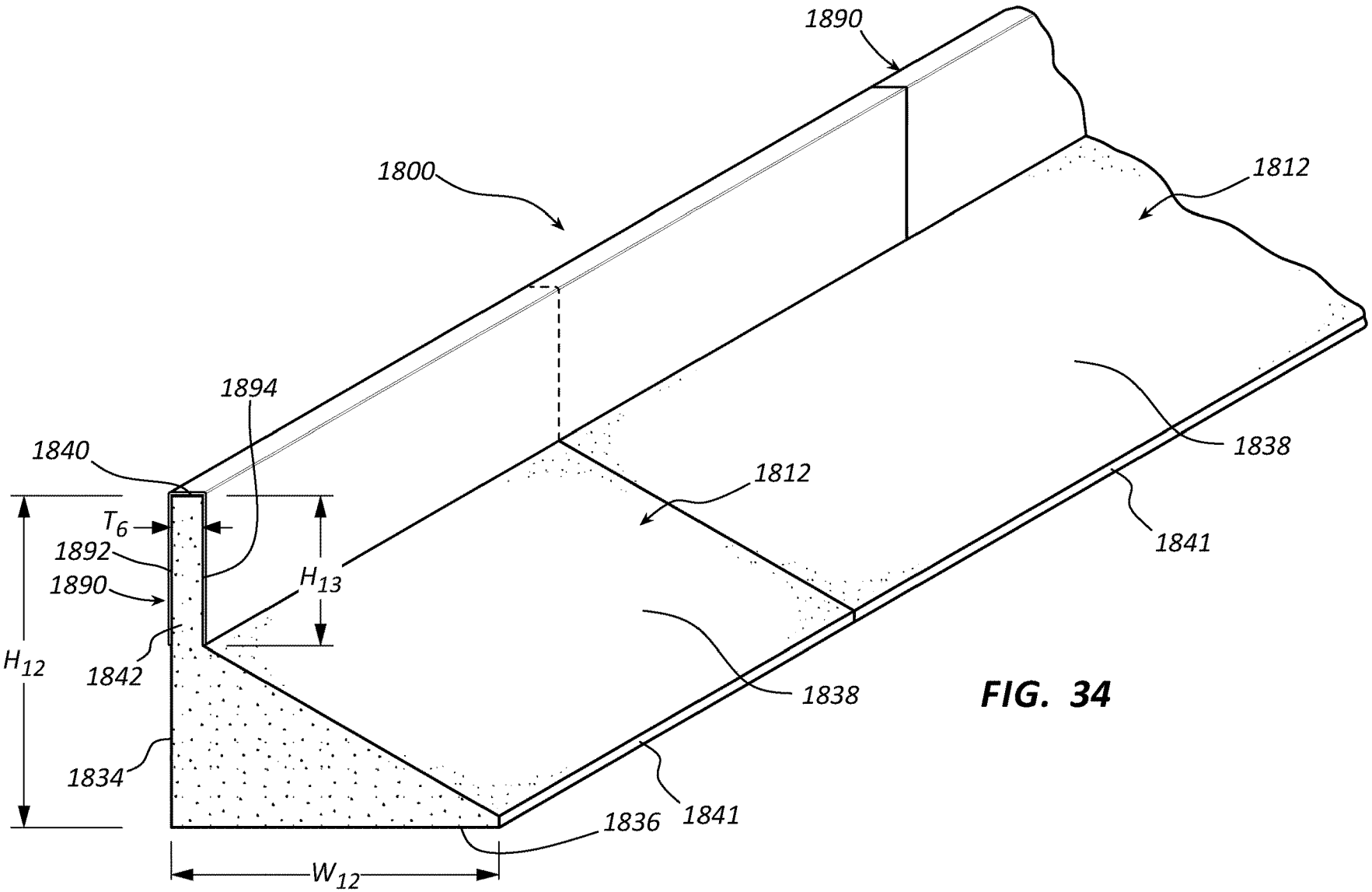
FIG. 34 is a perspective view of the cement form assembly shown in FIG. 33 connected to an adjacent positioned cement form.

FIGS. 33 and 34 illustrate another example cement form 1812 as part of a cement form assembly 1800. The cement form 1812 may be used with a clip or connecting member 1890 that may be used to secure the cement form 1812 to an adjacent positioned cement form 1812.

The cement form 1812 includes first and second surfaces 1834, 1836 and a weight-bearing surface 1838. The cement form 1812 may also include an extension 1842 that is formed integral with remaining portions of the cement form 1812. The extension 1842 may extend vertically upward and define a portion of the first surface 1834.

The first surface 1834 may have a height $H_{12}$ in the range of about 12 to about 24 inches, and more particularly about 12 to about 18 inches. The second surface 1836 may have a width $W_{12}$ in the range of about 12 to about 24 inches, and more particularly about 12 to about 18 inches. The extension 1842 may have a thickness $T_6$ in the range of about 1 inch to about 4 inches, and more particularly about 2 inches to about 3 inches. The extension 1842 may have a height $H_{13}$ in the range of about 2 inches to about 18 inches, and more particularly about 4 inches to about 8 inches. The weight-bearing surface 1838 may be arranged at an angle θ9 relative to the second surface 1836 in the range of about 20° to about 45°, and more particularly about 25° to about 35°. The cement form 1812 may also have an end surface 1841 at a furthermost location from the first surface 1834. A top surface 1840 may be defined by the extension 1842 and defined an uppermost surface or point for the cement form 1812.

The clip 1890 may have a height $H_{14}$, a thickness or width $T_7$, first and second legs 1892, 1894, and a cavity 1886 defined internally. The cavity 1896 may be sized to accommodate the extension 1842. The clip 1890 may be configured to extend over the top of extension 1842 such as with a sliding interface. Typically, the height $H_{14}$ is about the same as the height $H_{13}$ of extension 1842, and the thickness $T_7$ is about the same as the thickness $T_6$ of extension 1842. The clip 1890 may provide a protecting function for the extension 1842. The protecting function of the clip 1890 may help resist wear, damage, etc., and may provide additional strength for the extension 1842, particularly when the cement form 1812 is supporting a volume of cement during a formation of a cement structure. The clip 1890 may overlap with an adjacent positioned cement form 1812 to provide a connection between two end-to-end positioned cement forms 1812. The clip 1890 may replace the connecting member 16 used with other cement form embodiments disclosed herein. The size and shape of clip 1890 may be modified to be used with other cement forms and extension members disclosed herein.

The clip 1890 may comprise a relatively rigid material such as a metal material. The legs 1892, 1894 may have a relatively thin construction so as to have a minimal impact on the cement structure in the area of the extension 1842. In other embodiments, the clip 1890 may comprise a polymeric material, but could also comprise composite materials, natural materials such as wood or cardboard, or the like.

Figure 35:
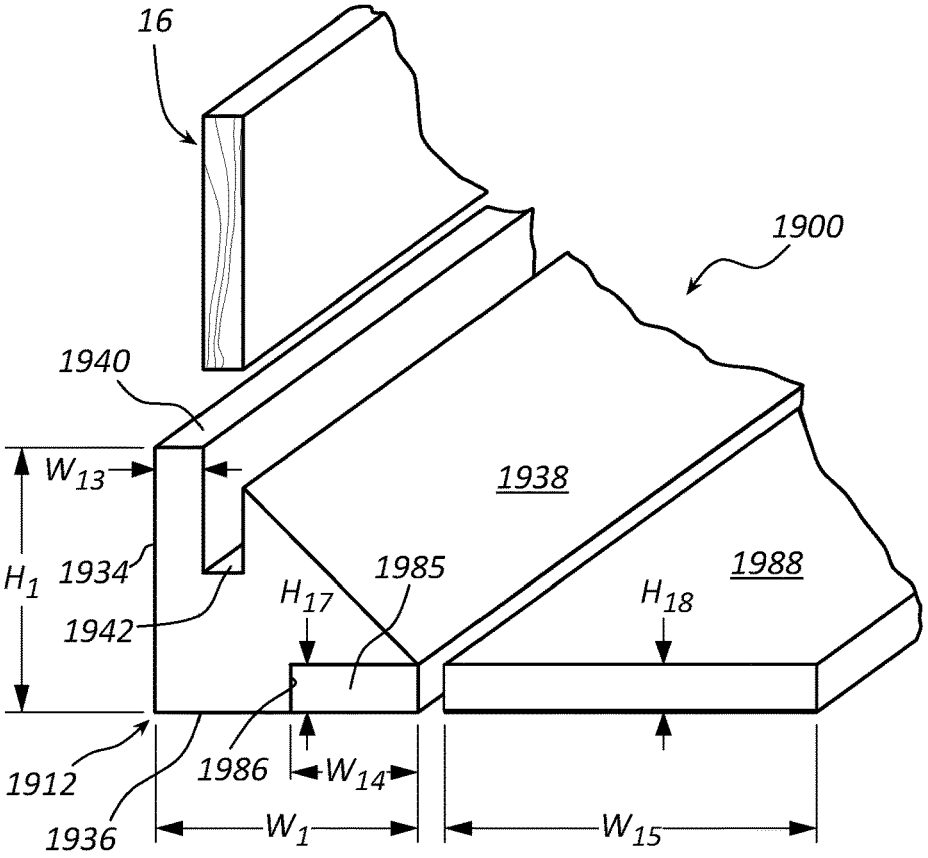
FIG. 35 is an exploded perspective view of another example cement form assembly in accordance with the present disclosure.
Figure 36:
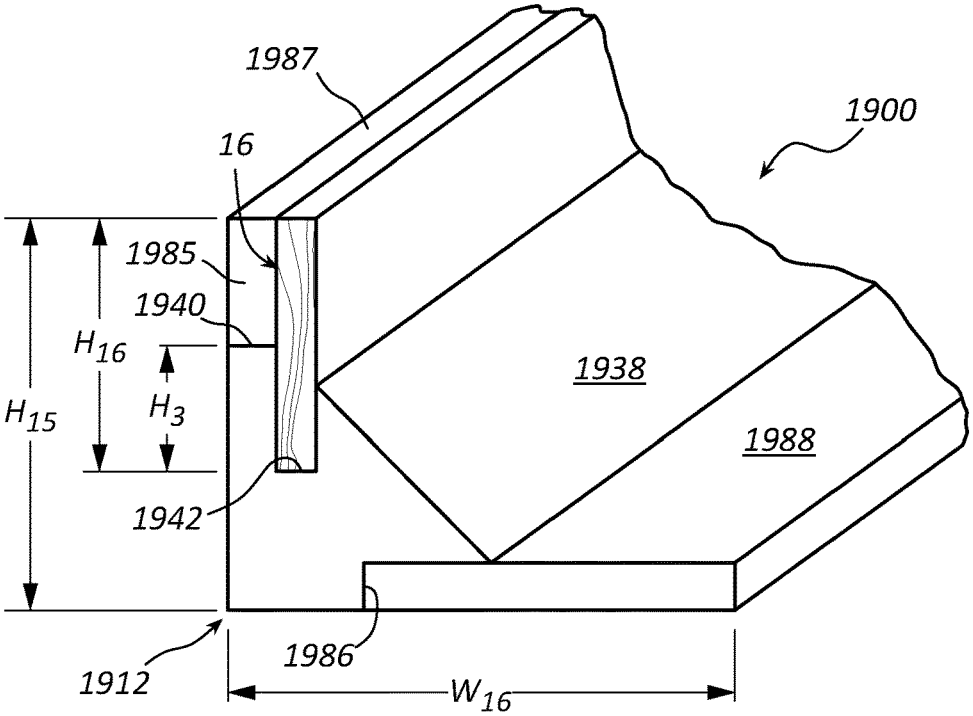
FIG. 36 is a perspective view of the cement form assembly shown in FIG. 35.

FIGS. 35 and 36 illustrate another example cement form assembly 1900 that includes a cement form 1912, a connecting member 16, a removable member 1985, and an extension 1988. The cement form 1912 may include first and second surfaces 1934, 1936, a weight-bearing surface 1938, a connector groove 1942, a top surface 1940 and end surface 1941. The connection member 16 may be inserted into the connector groove 1942 as shown in FIG. 36, for example, to interconnect the cement for 1912 with an adjacent positioned cement form. The extension 1988 may be abutted against the end surface 1941 and used to provide an additional thermal barrier between a cement structure supported by the first surface 1934 along a ground surface that supports the second surface 1936 and the extension 1988.

The height $H_1$ of the cement form 1912 may be extended by removing the removable member 1985 along the second surface 1936 as shown in FIG. 35 and repositioning the removable member 1985 along the top surface 1940. The removable member 1985 may also be supported against the connecting member 16 as shown in FIG. 36. The supplemented height $H_{15}$ for the cement form assembly 1900 is shown in FIG. 36. Typically, the total height $H_{15}$ is in the range of about 12 inches to about 36 inches, more particularly in the range of about 16 inches to about 30 inches, and in one example about 18 inches. The width $W_1$ of the cement form 1912 shown in FIG. 35 can be increased to a total width of $W_{16}$ by combining the extension 1988 with the cement form 1912. The extension 1988 may be inserted into a notch 1986 that is created in the cement form 1912 by removal of the removable member 1985. The removable member 1985 has width $W_{15}$ and height H17, and the extension 1988 has a width $W_{15}$ and height His. Positioning the extension 1988 within the notch 1986 may result in a width $W_{16}$ that is equal to the width $W_1$ minus the width $W_{14}$ plus the width $W_{15}$. A total width $W_{16}$ typically is in the range of about 12 inches to about 36 inches, and more particularly about 16 inches to about 30 inches, and in one example about 24 inches.

The size of the removable member 1985 and the size and location of connector groove 1942 may be coordinated to accommodate a connecting member 16 having a standard board size. In an example where the connecting member 16 is a standard 2×12 inch board, which has actual measurements of about 1.5 inches by about 11.25 inches, the width $W_{14}$ may be sized to make the top edge 1987 arrange flush with a top surface of the connecting member 16 when inserted into the connector groove 1942 as shown in FIG. 36. In one example, where a height $H_3$ of the connector groove 1942 is about 6 inches, the width $W_{14}$ is about 5.25 inches, and the connector 16 has a height H16 of about 11.25 inches to provide the flush top surface arrangement shown in FIG. 26. In other embodiments, the connector 16 may have a height H16 in the range of about 8 inches to about 18 inches, and assuming the height $H_3$ of the connector groove 1942 remains relatively constant, the width $W_{14}$ can be modified accordingly to create the flush mount arrangement shown in FIG. 36.

Typically, the notch 1986 has a minimum size to provide additional surface contact between the edge of the extension 1988 that is inserted therein as compared to an abutment of the extension 1988 directly against surface 1941 that would occur without the notch present. The increased surface contact between the cement form 1912 and the extension 1988 may provide an improved connection therebetween to assist in maintaining a position for the cement form assembly 1900 relative to a ground surface during setup of the cement form assembly 1900 and pouring of the cement used to create the cement structure that is supported by the cement form assembly. As with the other embodiments disclosed herein, the cement form 1912 may be retained in position relative to a ground surface using, for example, a stake that is driven through a cement form 1912 into the ground surface, a stake driven through the extension 1988, and/or backfill dirt that is positioned on top of the extension 1988 and/or weight-bearing surface 1938. The extension 1988 may be secured to the cement form 1912 with a positive connection such as using a fastener, adhesive, or the like, or using an interference fit connection. In one embodiment, a stake may be driven through the cement form 1912 and extension 1988 while the extension is positioned within notch 1986, thereby providing a positive connection therebetween as well as a connection to the ground surface upon which the cement form 1912 and extension 1988 are supported.

The removable member 1985 may be secured to the cement form 1912 in the position shown in FIG. 36 along the top surface 1940 using, for example, the connection to the top surface 1940 or a connection to the connecting member 16. A positive connection may be formed using, for example, a fastener, adhesive bond, or the like. Alternatively, the removable member 1985 may rest upon the top surface 1940 and held in place by the forces imposed by the cement during formation of the cement structure. In another arrangement, the clip 1890 or similar connecting member may be used to connect the removable member 1985 to the cement form 1912 or connecting member 16, and/or connecting the removable member 1985 to an adjacent positioned removable member. After formation of the cement structure, the connecting member 16 may be removed and the removable member 1985 may be held in place by, for example, backfill dirt that is positioned in place of the connecting member 16.

The removable member 1985 has a rectangular cross-sectional shape as shown in FIGS. 35 and 36 and may have an elongate structure. In other embodiments, the removable member 1985 may have a square or other cross-sectional shape.

In some embodiments, the connecting member 16 may comprise a wood, metal or polymeric material. In at least some embodiments, the connecting member 16 may remain in place after formation of the cement structure supported by the cement form assembly. In other embodiments, the connecting member 16 is intended to be removed and reused for other cement form assemblies. In at least some examples, the connector groove 1942 may be filled with expansion foam or other foam material after removal of the connecting member 16, or may be used in place of the connecting member 16 to provide the desired interconnection of adjacent position cement forms. Such expansion foam or other foam material may improve the R-value provided by the cement form for the cement structure while also providing the desired connectivity.

An example method related to the use of the cement form assemblies disclosed herein (e.g., the embodiment of FIGS. 35 and 36 may include providing a cement form having a wedge shaped cross section and an elongate structure. The cement form includes a first surface configured to support a volume of cement, a second surface arranged to face and contact a ground support surface, and a third or weight-bearing surface extending at an angle relative to both the first and second surfaces. The method includes removing a portion of the cement form along the first, second surface and/or third surface and repositioning that removed portion at a different location on the cement form to provide an extension of one of the cement form surfaces. The resulting notch in the cement form that exists after removal of the removed portion can be sized to receive a portion of a separate extension member.

The notch may be formed at an intersection between the first and second surfaces. Alternatively, the notch may be formed at an intersection between the second and third surfaces. The removed portion may be positioned along a top surface and used to extend a height of the cement form (e.g. to extend a height of the first surface). The removed portion may be inserted into a connector groove of the cement form after removal of the connecting member after formation of the cement structure using the cement form.

The apparatuses and methods disclosed herein provide numerous advantages as compared to the traditional cement form structures and related methods of forming cement structures such as monolithic cement foundations described above with reference to FIGS. 37A and 37B. For example, the apparatuses and methods disclosed herein provide a reduced cost solution for at least the reason that the required man hours is significantly reduced for setting up cement forms for pouring a cement structure, such as a monolithic cement foundation. Further, the apparatuses and methods disclosed herein provide for improved insulation of a cement structure such as the monolithic cement foundation. The man hours required to install the insulation material is possibly non-existent since the cement forms themselves may include insulating material and be left in the ground after pouring the cement structure and covered to provide the insulating function.

At least some of the methods of manufacturing disclosed herein may provide for improved ease in creating the cement forms. The structure of the cement forms may provide improved storing, shipping, and handling with increased efficiency. Still further, at least some of the materials possible for use in the cement forms (e.g., foam materials) are significantly lighter weight than traditional cement forms. As a result, the cost of shipping and the amount of effort and/or energy required in maneuvering these cement forms of the present disclosure is significantly reduced thereby increasing the overall efficiency for using the cement form assemblies disclosed herein. Further, the use of foam as a primary material for the cement forms provides for a lighter weight object to be manually maneuvered at a work site, which may provide reduced incidence of workplace injuries such as back strains, pulled muscles, foot or leg crushing/bruising, and the like due that may otherwise occur when using traditional material for the cement forms.

Another advantage related to using foam or polymer materials as the primary (if not exclusive) material for the cement form is that such materials typically do not absorb moisture from the cement as the cement cures. Avoiding moisture absorption leads to improved consistency in how the cement cures as compared to using other materials for the cement forms such as wood. Wood cement forms have a high rate of moisture absorption, and are typically sprayed with a petroleum product such as diesel fuel just prior to pouring the cement in an effort to limit the moisture absorption properties of the wood. An improved consistency in how the cement cures may lead to reduced incidence of later cracking in the cement structure.

A further advantage relates to the ability to backfill around and/or over the cement forms prior to pouring cement. The pre-backingfilling (i.e., prior to pouring cement) makes it possible to have excavation equipment on site just for digging and set up of the cement forms (i.e., the equipment does not have to return after pouring cement and removing the cement forms according to traditional methods), thereby decreasing costs and overall time for completing formation of a cement structure such as a monolithic foundation. Increasing the speed of forming a cement foundation typically results in an over decrease in the overall time for completion of a construction project, which leads to reduced costs and improved efficiencies. Providing a backfill prior to pouring also may involve grading the ground surface surrounding the cement forms. A graded surface may improve safety for workers during pouring of cement because the workers can work on a graded rather than having to work on uneven surface and/or working around kickers, stakes and brace boards as is required in traditional methods.

Additional advantages associated with the breakaway feature described herein is the ability to more easily modify the shape and/or size of portions of the cement form after forming the cement structure using the cement form. By pre-cutting or otherwise pre-forming one or more relief features in the cement form during manufacture, the breakaway portion may be removed using less force and/or may break off with a relatively clean break surface remaining on the cement form. By positioning the relief features at various locations on the cement form, it is possible to break off different sized and shaped portions. Some embodiments may include multiple pre-formed relief features that permit a user to selective choose the size and/or shape of the resulting portion that is broken off.

Further advantages are associated with an angled end of the cement form. The angled end portions permit assembly of multiple cement forms and inner inserts at predetermined orientations relative to each other (e.g., 90° or 60° angles). Providing pre-cut angles at the ends of the cement forms and inner inserts can also reduce the time required to assembly multiple cement forms and inner inserts together at a job site.

The multi-piece construction of the cement form and extension members described with reference to FIGS. 22-36 may provide a number of advantages. For example, providing the extension as a separate piece makes it possible to have a common or base size and/or shape for the cement form and then use different sized and/or shaped extensions to meet desired criteria (e.g., increased height, width, or thermal barrier properties) for the cement form assembly.

The notch features formed in the cement form may provide improved connection between the cement form and an extension member or connecting member. The material that is removed from the cement form as part of forming the notch feature can advantageously be used as an extension member for the cement form assembly rather than being discarded as waste material.

The extension features may be sized and shaped to be used with existing features of the cement form that may be used for other purposes. For example, the connector groove of the cement form may be used for either or both of receiving a connecting member and receiving one or more different extension members.

The extension members disclosed herein may provide either or both of structural support for the cement form related to supporting a volume of cement when forming a cement structure, and a thermal barrier for the resultant cement structure. The thermal barrier may be provided by the extension being positioned directly under the cement structure, along a vertical face of the cement structure, or laterally adjacent to the cement structure along the group surface that supports the cement structure depending on the position of the extension relative to the cement form.

Both the cement form and the extension may have an elongate construction with a greater length (along a length of the cement structure) than width (laterally relative to a side of the cement structure) or height (relative to a height of the cement structure). The cement form and extension may be particularly suited for use in forming a building foundation, such as a monolithic building foundation, and remaining in place after formation of the foundation to provide a thermal barrier for the foundation.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. A cement form, comprising:

a single piece, unitary body member having a solid, continuous construction and a wedge-shaped cross-section, the body member comprising:

a first surface arranged vertically and configured to support a volume of cement;

a second surface arranged horizontally and configured to contact a ground support surface;

a foam material;

an elongate construction with a greater length dimension in a horizontal direction than a height dimension in a vertical direction;

a notch formed at an intersection of the first and second surfaces, the notch being receptive of a portion of a foam sheet;

a weight-bearing surface extending from the first surface to the second surface, the weight-bearing surface facing at least in part in a vertical direction, the weight-bearing surface being arranged at an angle in the range of about 20° to about 60° relative to the second surface;

a connector groove formed in the weight-bearing surface and extending along at least a portion of a length of the body member, the connector groove being configured to receive a connecting member that extends between adjacent positioned cement forms, the connector groove being open in a vertically upward direction and having a closed bottom end.

2. The cement form of claim 1, wherein the cement form has a triangular cross-section shape.

3. The cement form of claim 1, wherein the notch has a rectangular cross-sectional shape.

4. The cement form of claim 1, wherein the notch has a length along the second side that is at least 3 inches and a height along the first surface that is at least 2 inches.

5. A cement form, comprising:

an elongate member, comprising:

a wedge cross-sectional shape;

a foam material;

first and second ends and a length measured therebetween;

a cement support surface extending vertically and configured to support a volume of cement, the cement support surface extending from a bottom most edge to an upper most edge of the elongate member, the cement support surface defining a height of the elongate member, the height being less than the length;

a notch formed in the cement support surface at the bottom most edge;

an extension member having a first end inserted into the notch, a second end extending away from the cement support surface, the extension member having a length that is substantially the same as the length of the elongate member, a thickness that is substantially the same as a height of the notch along the cement support surface, and a width that is less than the length of the extension member.

6. The cement form of claim 5, wherein the elongate member further comprises a connector groove extending along the length of the elongate member and being spaced away from the cement support surface, the connector groove being open in a vertical direction and sized to receive a connecting member that spans between adjacent positioned cement forms.

7. The cement form of claim 5, wherein the width of the extension member is greater than the thickness.

8. The cement form of claim 5, wherein the extension member has a first portion extending horizontally from the elongate member, and a second portion extending at an angle relative to the first portion.

9. The cement form of claim 5, wherein the elongate member includes a bottom surface arranged horizontally and configured to contact a ground support surface, the bottom surface being arranged perpendicular to the cement support surface, the notch being formed at least in part in the cement support surface and at least in part in the ground support surface.

10. The cement form of claim 8, wherein an end of the second portion is arranged at an angle of about 45 degrees relative to the first portion.

11. The cement form of claim 9, further comprising a removable member, wherein the removable member is detachable from the elongate member along the cement support surface at the bottom most edge, and the removable member being positionable at the upper most edge of the elongate member and in alignment with the cement support surface to increase the height of the elongate member.

12. The cement form of claim 9, wherein at least a portion of the extension member is configured to extend underneath the volume of cement.

* * * * *